US010131150B2

(12) United States Patent
Ishizawa et al.

(10) Patent No.: US 10,131,150 B2
(45) Date of Patent: Nov. 20, 2018

(54) INJECTION METHOD AND LIQUID CONTAINER

(71) Applicant: SEIKO EPSON CORPORATION, Tokyo (JP)

(72) Inventors: Taku Ishizawa, Nagano (JP); Hiroyuki Kawate, Yamanashi (JP); Noriaki Okazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 15/124,973

(22) PCT Filed: Mar. 11, 2015

(86) PCT No.: PCT/JP2015/001347

§ 371 (c)(1),
(2) Date: Sep. 9, 2016

(87) PCT Pub. No.: WO2015/136933

PCT Pub. Date: Sep. 17, 2015

(65) Prior Publication Data

US 2017/0100940 A1 Apr. 13, 2017

(30) Foreign Application Priority Data

Mar. 14, 2014 (JP) ..... 2014-051105

(51) Int. Cl.
*B41J 2/17* (2006.01)
*B41J 2/175* (2006.01)
(Continued)

(52) U.S. Cl.
CPC ..... *B41J 2/17506* (2013.01); *B41J 2/1752* (2013.01); *B41J 2/17509* (2013.01);
(Continued)

(58) Field of Classification Search
CPC ..... B41J 2/17506; B41J 2/17513; B41J 2002/17516; B41J 2/1752; B41J 2/1753; B41J 2/17533
See application file for complete search history.

(56) References Cited

U.S. PATENT DOCUMENTS 5,126,767 A * 6/1992 Asai ..... B41J 2/17523 347/86
6,105,821 A * 8/2000 Christine ..... B65D 77/065 222/105

(Continued)

FOREIGN PATENT DOCUMENTS

JP 2004-074801 A 3/2004
JP 2004-306466 A 11/2004

(Continued)

*Primary Examiner* — Henok Legesse

(57) ABSTRACT

A liquid container into which ink is injected comprises a liquid container body configured to contain a liquid therein; and a liquid supply assembly located on one end portion of the liquid container body. The liquid supply assembly has a liquid supply port provided to supply the liquid to a liquid consuming apparatus. The liquid supply port is formed to face in an intersecting direction that intersects with the direction of gravity and to be protruded in the intersecting direction from the one end portion when the liquid supply assembly is supported such as to be located above the liquid container body in the direction of gravity. A liquid injection member is inserted into the liquid supply port, and the liquid is injected into the liquid container body. The liquid supply port is then arranged to be protruded in the intersecting direction, and the liquid injection member is detached from the liquid supply port.

3 Claims, 57 Drawing Sheets

(51) Int. Cl.
*B41J 29/02* (2006.01)
*B41J 29/13* (2006.01)

(52) U.S. Cl.
CPC ..... *B41J 2/17513* (2013.01); *B41J 2/17523* (2013.01); *B41J 2/17546* (2013.01); *B41J 2/17553* (2013.01); *B41J 29/02* (2013.01); *B41J 29/13* (2013.01); *B41J 2002/17516* (2013.01)

(56) References Cited

U.S. PATENT DOCUMENTS 6,554,411 B1 * 4/2003 Hatasa ..... B41J 2/17503 347/86
2004/0036749 A1 2/2004 Petranek
2004/0217127 A1 11/2004 Kimura et al.
2005/0204921 A1 9/2005 Ishizawa et al.
2009/0322832 A1 12/2009 Wanibe et al.
2013/0010038 A1 1/2013 Hayakawa et al.
2013/0187993 A1 * 7/2013 Aoki ..... B41J 2/17503 347/86

FOREIGN PATENT DOCUMENTS

JP 2004-358802 * 12/2004 ..... B41J 2/175
JP 2004-358802 A 12/2004
JP 2005-169851 A 6/2005
JP 3111130 U 7/2005
JP 2006-062282 A 3/2006
JP 2006-069030 A 3/2006
JP 2010-005958 A 1/2010
JP 2011-016236 A 1/2011
JP 2012-016825 A 1/2012
JP 2014-004806 A 1/2014

* cited by examiner 18a-18a PARTIAL SECTIONAL VIEW 18b-18b PARTIAL SECTIONAL VIEW

INJECTION METHOD AND LIQUID CONTAINER

CROSS-REFERENCE TO RELATED APPLICATIONS

The present application claims priority from Japanese patent application 2014-51105 filed on Mar. 14, 2014, the content of which is hereby incorporated by reference into this application.

TECHNICAL FIELD

The present disclosure relates to injection of a liquid.

BACKGROUND ART

A known configuration of ink cartridge contains ink in a flexible bag. This bag may be formed, for example, by welding a plurality of films at their respective ends. This type of ink cartridge generally has a liquid lead-out portion. The liquid lead-out portion is a tube that has rigidity and is connected with inside of the bag. A flow path from the ink cartridge to a printer is provided by connecting the liquid lead-out portion with a flow path provided in the printer. In a known arrangement, the liquid lead-out portion is placed between joint surfaces at an end of the bag and is protruded in a direction parallel to the joint surfaces (for example, Patent Literature 1).

CITATION LIST

Patent Literature

PTL 1: JP 2004-306466A
PTL 2: JP 2006-62282A

SUMMARY

Technical Problem

A problem to be solved by the disclosure is to reduce the possibility that an ink cartridge is stained with ink dripping off during ink injection. The above prior arts have not taken into account this problem. Other demands include downsizing of the apparatus, cost reduction, resource saving, easy manufacture and improvement of the convenience.

Solution to Problem

In order to solve at least one of the problems described above, the disclosure may be implemented by aspects described below.

(1) According to one aspect, there is provided an injection method of injecting a liquid into a liquid container. This liquid container comprises a liquid container body configured to contain a liquid therein and a liquid supply assembly located on one end portion of the liquid container body. The liquid supply assembly has a liquid supply port provided to supply the liquid to a liquid consuming apparatus. The liquid supply port is formed to face in an intersecting direction that intersects with direction of gravity and to be protruded in the intersecting direction from the one end portion when the liquid supply assembly is supported such as to be located above the liquid container body in the direction of gravity. The injection method comprises: inserting a liquid injection member into the liquid supply port and injecting the liquid into the liquid container body; and arranging the liquid supply port to be protruded in the intersecting direction and detaching the liquid injection member from the liquid supply port. The injection method of this aspect arranges the liquid supply port to be protruded in the intersecting direction and detaches the liquid injection member from the liquid supply port. This reduces the likelihood that the liquid drips off from the liquid supply port. This accordingly reduces the possibility that the liquid container is stained with the dripping liquid.

(2) In the injection method of the above aspect, the injecting may comprise supporting the liquid supply assembly such as to be located above the liquid container body in the direction of gravity and injecting the liquid. The injection method of this aspect supports the liquid supply assembly such as to be located above the liquid container body in the direction of gravity and injects the liquid. This ensures smooth injection.

(3) The injection method of the above aspect may further comprise positioning the liquid injection member prior to the injecting. The injection method of this aspect positions the liquid injection member and the liquid supply port relative to each other. This facilitates injection of the liquid.

(4) In the injection method of the above aspect, the liquid container may further comprise a positioning structure that is configured as a separate member from the liquid supply assembly, and the positioning may comprise positioning the liquid injection member by utilizing the positioning structure. According to this aspect, the positioning structure is provided as the separate member from the liquid supply assembly and can thus be formed from a material having the higher durability than the material of the liquid supply assembly. This reduces a cost increase, while enhancing the durability of the positioning structure.

(5) In the injection method of the above aspect, the liquid container body may have a gusset. The configuration of the liquid container body with the gusset enables a greater amount of the liquid to be injected therein, compared with the configuration without a gusset. Additionally, since the remaining liquid is accumulated on the bottom, the presence of the gusset facilitates the operation of discharging the remaining liquid.

(6) According to another aspect, there is provided an injection method of injecting a liquid into a liquid container. This liquid container comprises a liquid containing bag formed from a flexible material and configured to contain a liquid therein; a liquid supply assembly located on one end portion of the liquid containing bag and configured to have a liquid supply port provided to supply the liquid to a liquid consuming apparatus; and a flow path member connected with the liquid supply assembly and configured to form a flow path that connects with the liquid supply port and with inside of the liquid containing bag. The injection method comprises injecting the liquid from the liquid supply port through the flow path member to inside of the liquid containing bag. In the injection method of this aspect, the flow path member is placed in the liquid containing bag. This configuration suppresses flexible members from sticking to each other. As a result, this facilitates the liquid to be filled into the liquid containing bag.

(7) In the injection method of the above aspect, the flow path member may have a hole provided halfway in the flow path to communicate with inside of the liquid containing bag. According to this aspect, the presence of the hole in the flow path member further facilitates the liquid to be filled into the liquid containing bag.

(8) The injection method of the above aspect may further comprise discharging the liquid remaining inside of the liquid containing bag through the flow path member, prior to the injecting. The injection method of this aspect enables the remaining liquid to be discharged out of the liquid containing bag, prior to injection of new liquid.

(9) According to another aspect, there is provided an injection method of injecting a liquid into a liquid container. The liquid container comprises a liquid container body configured to contain a liquid therein; a liquid supply assembly attached to the liquid container body and configured to have a liquid supply passage provided inside thereof to supply the liquid to a liquid ejection apparatus; and a gas trap portion provided in the liquid container body to separate and trap a gas from the liquid. The injection method comprises injecting the liquid into the liquid container body through the liquid supply passage. According to this aspect, even when the gas is included in the injected liquid, the gas is trapped inside of the liquid container. This accordingly suppresses the gas from flowing out to the liquid ejection apparatus.

(10) In the injection method of the above aspect, the gas trap portion may comprise a first opening configured to be connected with the liquid supply passage; a second opening configured to be connected with inside of the liquid container body; a flow path arranged to connect the first opening with the second opening; and a filter provided halfway in the flow path. In this aspect, the filter may be provided in the gas trap portion.

(11) In the injection method of the above aspect, the gas trap portion may comprise a decompression chamber configured to have a lower pressure than atmospheric pressure and a sealing member configured to seal the decompression chamber such as to allow for transmission of the gas. The gas may be trapped, for example, by this configuration.

(12) According to another aspect, there is provided an injection method of injecting a liquid into a liquid containing bag unit. The liquid containing bag unit is detachably connectable with a liquid ejection apparatus and comprises a liquid containing bag configured to contain a liquid therein and to have a liquid supply port through which the liquid flows out; an operation member detachably attached to one end portion of the liquid containing bag; a first positioning structure provided integrally with the operation member and configured to position the liquid supply port when the liquid containing bag unit is connected with the liquid ejection apparatus; a memory unit configured to be electrically connectable with the liquid ejection apparatus; and a second positioning structure provided integrally with the operation member and configured to hold the memory unit and position the memory unit when the liquid containing bag unit is connected with the liquid ejection apparatus. The injection method comprises: detaching the operation member from the liquid containing bag prior to injection; and attaching the operation member provided with a new memory unit to the liquid containing bag. Since the operation member is detachable, the configuration of this aspect facilitates replacement of the memory unit that is to be replaced for injection of the liquid.

(13) According to another aspect, there is provided an injection method of injecting a liquid into a liquid container. The liquid container comprises a liquid container body configured to contain a liquid therein; a liquid supply assembly located on one end portion of the liquid container body and configured to have a liquid supply port provided to supply the liquid to a liquid consuming apparatus; and a flow path member placed inside of the liquid container body and configured to form a flow path that is connected with the liquid supply assembly. The injection method comprises cutting at least part of the liquid container body and injecting the liquid from the cut part. The injection method of this aspect injects the liquid from the cut part of the liquid container body. This configuration enables the liquid to be readily injected into even the liquid container body equipped with the flow path member.

(14) According to another aspect, there is provide an injection method of injecting a liquid into a liquid container. The liquid container comprises a liquid container body configured to contain a liquid therein; a liquid supply assembly located on one end portion of the liquid container body and configured to have a liquid supply port provided to supply the liquid to a liquid consuming apparatus; and a grip portion linked with the liquid container body and the liquid supply assembly. The injection method comprises cutting at least part of the liquid container body and injecting the liquid from the cut part. According to this aspect, the presence of the grip portion facilitates cutting the liquid container body.

Another aspect may be a liquid-container in which a liquid is injected by the injection method of any of the above aspects.

DESCRIPTION OF EMBODIMENTS

Embodiment 1

Configuration of Liquid Ejection System 1000

Figure 1:
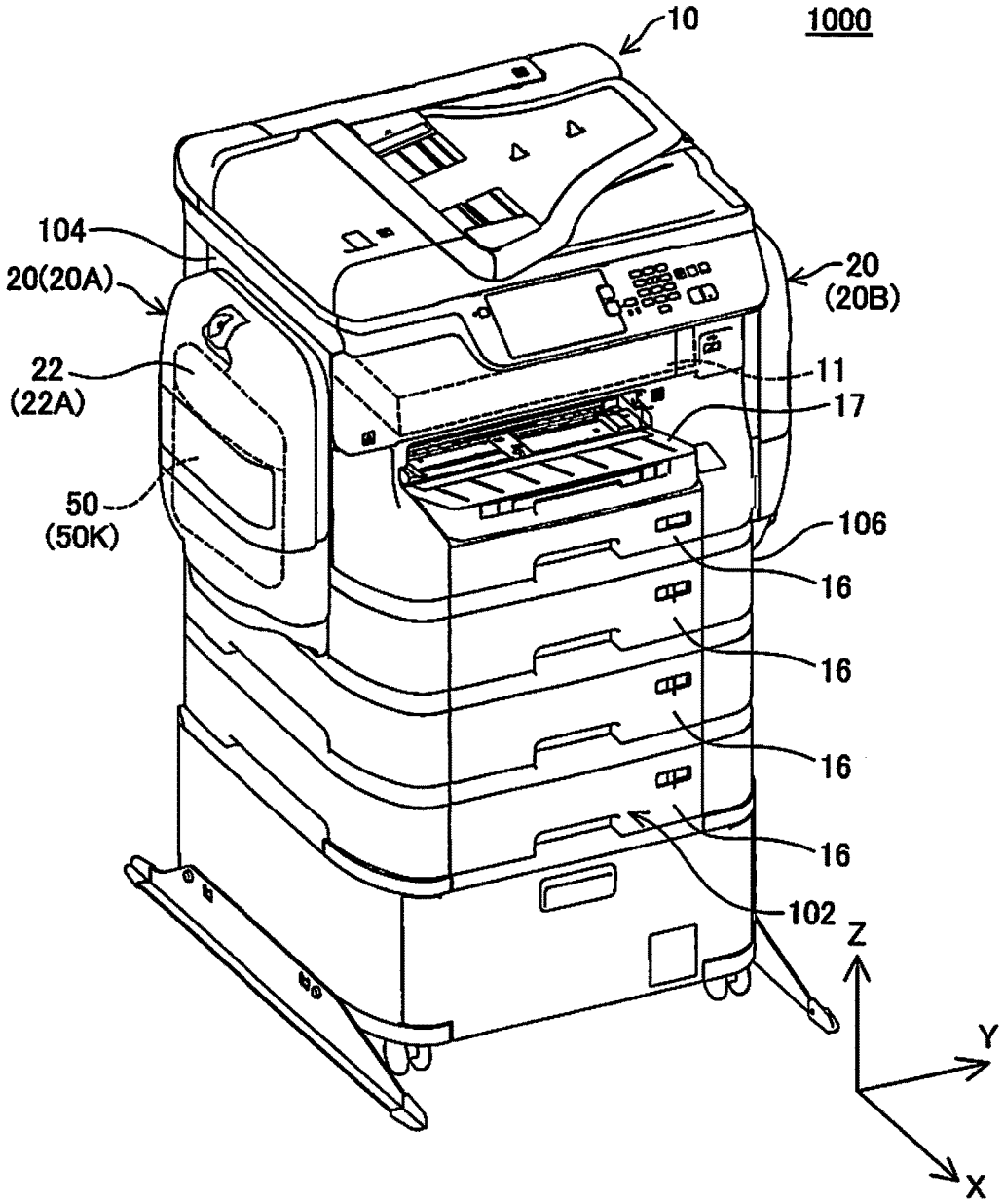
FIG. 1 is a perspective view illustrating the appearance of a liquid ejection system.
Figure 2:
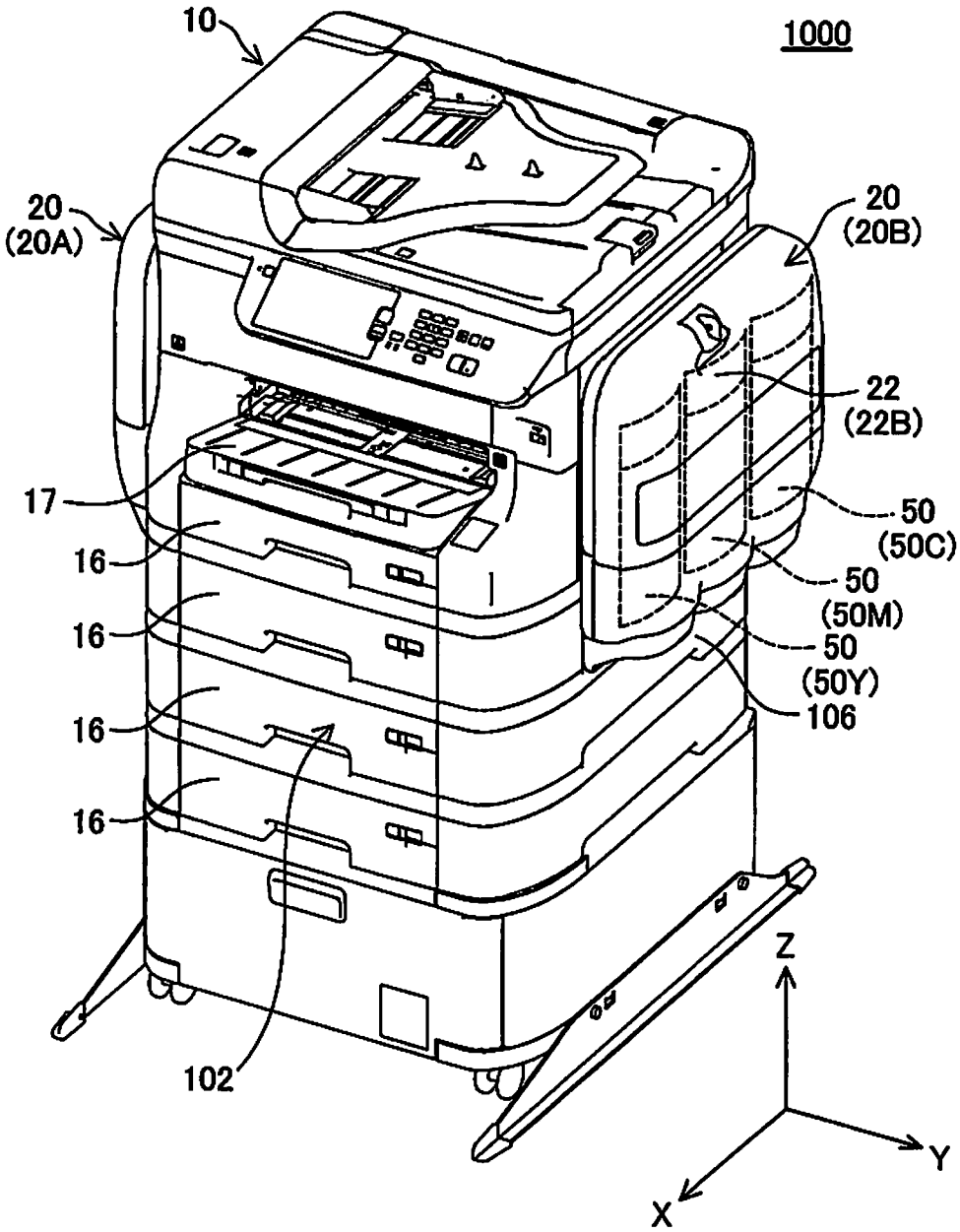
FIG. 2 is a perspective view illustrating the appearance of the liquid ejection system.

FIG. 1 and FIG. 2 are perspective views illustrating the appearance of a liquid ejection system 1000. As shown in FIG. 1, the liquid ejection system 1000 includes a printer 10 and two liquid supply devices 20. The two liquid supply devices 20 are respectively provided on the respective sides of the printer 10. In the use state of the liquid ejection system 1000, the printer 10 is placed on a horizontal plane. An XY plane is a horizontal plane, and a Z-axis direction is the direction of gravity. A positive direction in the Z-axis direction is upward in the direction of gravity, and a negative direction in the Z-axis direction is downward in the direction of gravity. In the description below, the positive direction in the Z-axis direction is expressed as "+Z-axis direction", and the negative direction in the Z-axis direction is expressed as "−Z-axis direction". The same applies to other axes (K1 axis and K2 axis described later, as well as X axis and Y axis).

The liquid supply device 20 is configured to supply ink to the printer 10. Liquid containers 50 (shown in, for example, FIG. 6) included in the liquid supply device 20 are detachably connected (mounted) to the printer 10.

The printer 10 is an inkjet printer. The printer 10 includes a recording mechanism 11, a plurality of paper feed trays 16 and a paper eject tray 17. The plurality of paper feed trays 1 are provided at different locations in the Z-axis direction. The paper feed trays 16 are provided on an apparatus first surface 102 of the printer 10. Recording media (for example, sheets of paper) on which images such as letters and characters are printed (recorded) by the printer 10 are placed in the paper feed trays 16.

The recording mechanism 11 includes a record head (not shown) configured to eject ink. The record head is connected with the liquid supply devices 20 through flow pipes such as tubes. The record head uses and ejects ink supplied from the liquid supply device 20 on the recording medium to perform recording (printing). The recording medium after recording is discharged to the paper eject tray 17.

The two liquid supply devices 20 are respectively provided on an apparatus second surface 104 and on an apparatus third surface 106 that are arranged to intersect with the apparatus first surface 102 of the printer 10. The apparatus first surface 102 to the apparatus third surface 106 are surfaces approximately perpendicular to the installation plane of the printer 10 in the use state of the printer 10. The liquid supply device 20 provided on the apparatus second surface 104 is also called "first liquid supply device 20A", and the liquid supply device 20 provided on the apparatus third surface 106 is also called "second liquid supply device 20B". When there is no need to distinguish between the first and the second liquid supply devices 20A and 20B, these are simply called "liquid supply devices 20".

Figure 3:
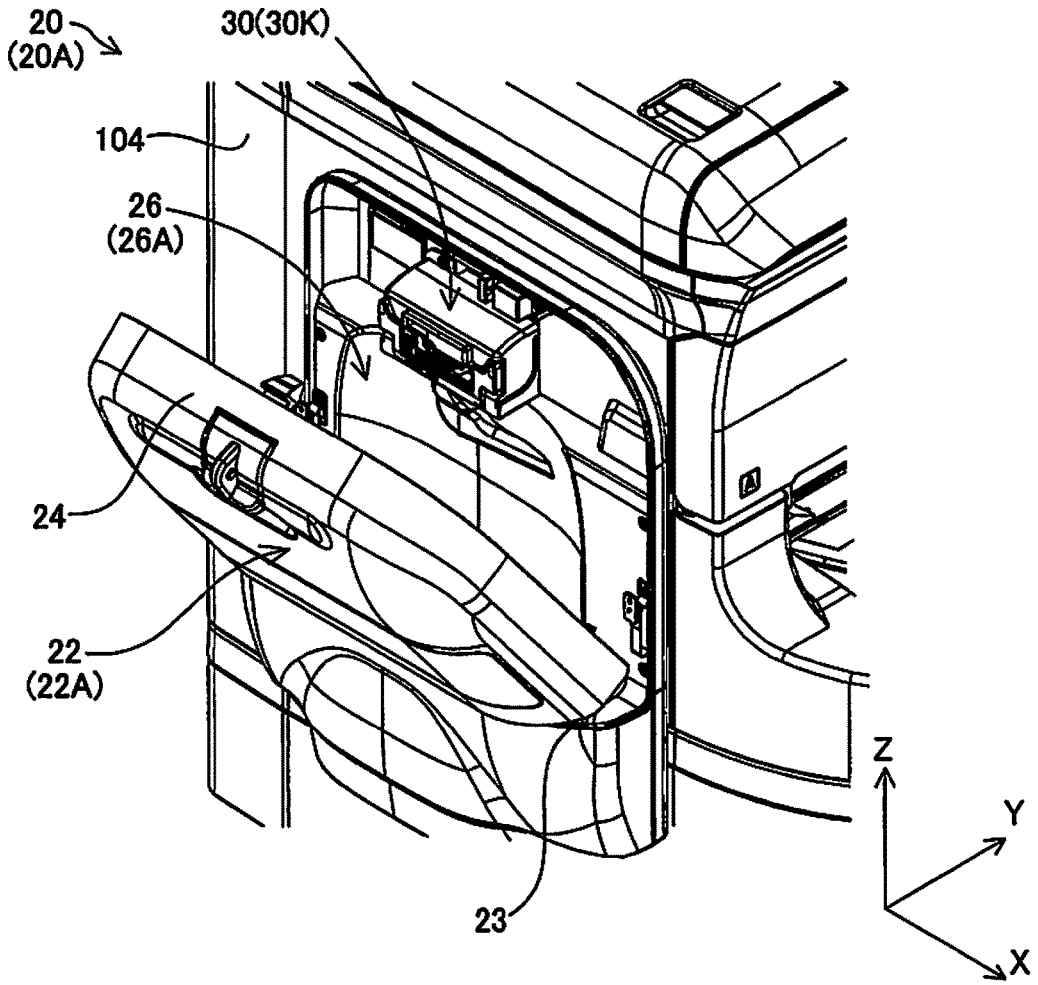
FIG. 3 is a diagram illustrating placement of a liquid container.

As shown in FIG. 1, the first liquid supply device 20A includes one cover member 22, one liquid container 50 (shown in FIGS. 6 and 7) and one mounting/demounting unit 30 (shown in FIG. 3). The liquid container 50 is covered by the cover member 22 and is thus not shown in FIG. 2. As shown in FIG. 2, the second liquid supply device 20B includes one cover member 22, three liquid containers 50 and three mounting/demounting units 30 (shown in FIG. 4) provided corresponding to the respective liquid containers 50. In the description below, when there is a need to distinguish between the two cover members 22, these are expressed by reference signs "22A" and "22B". When there is a need to distinguish among the four liquid containers 50, these are expressed by reference signs "50K", "50C", "50M" and "50Y". When there is a need to distinguish among the four mounting/demounting units 30, these are expressed by reference signs "30K", "30C", "30M" and "30Y".

The four liquid containers 50 respectively container different colors of inks. In Embodiment 1, yellow (Y), magenta (M), cyan (C) and black (K) inks are respectively contained in the different liquid containers 50. The liquid container 50K contains black ink, the liquid container 50C contains cyan ink, the liquid container 50M contains magenta ink and the liquid container 50Y contains yellow ink.

Figure 4:
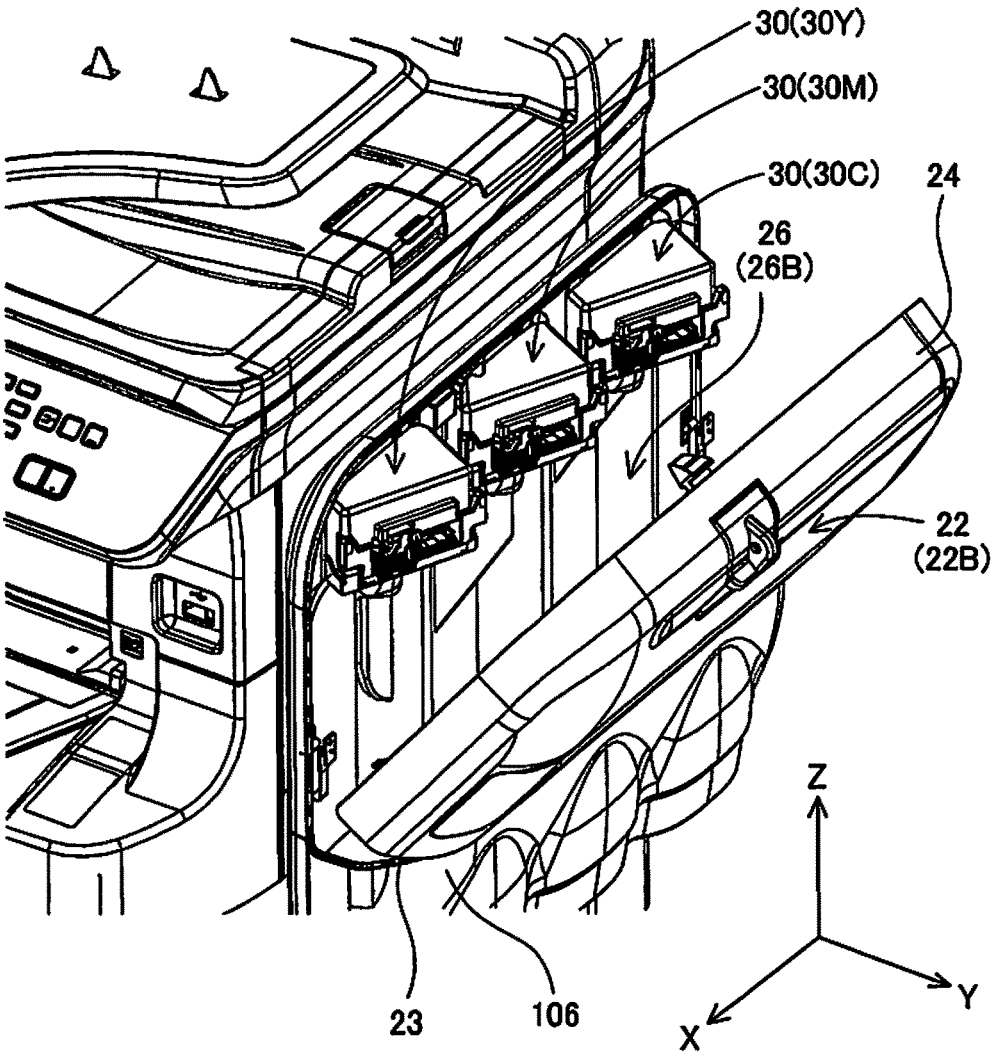
FIG. 4 is a diagram illustrating placement of liquid containers.

FIG. 3 and FIG. 4 are diagrams illustrating placement of the liquid containers 50. FIGS. 3 and 4 illustrate the state that the liquid containers 50 are demounted. As shown in FIGS. 3 and 4, the liquid containers 50 are placed in housing spaces 26 defined by the cover members 22. More specifically, the liquid container 50K is placed in a housing space 26A (shown in FIG. 3), and the liquid containers 50C, 50M and 50Y are placed in a housing space 26B (shown in FIG. 4). The mounting/demounting units 30 shown in FIGS. 3 and 4 are in the state that respective movable members 40 (shown in FIGS. 37 to 42) are pressed in. The movable member 40 is pulled out for mounting the liquid container 50.

The liquid container 50 is detachably mounted to the mounting/demounting unit 30 shown in FIGS. 3 and 4. The mounting/demounting unit 30K is placed inside of the cover member 22A. The mounting/demounting units 30C, 30M and 30Y are placed inside of the cover member 22B. As shown in FIG. 3, the mounting/demounting unit 30K is provided on the apparatus second surface 104 of the printer 10. As shown in FIG. 4, the mounting/demounting units 30C, 30M and 30Y are provided on the apparatus third surface 106 of the printer 10. When the liquid container 50 is mounted to the mounting/demounting unit 30, the ink contained in the liquid container 50 is supplied to the record head of the printer 10.

The cover member 22 is configured to be openable and closable. As shown in FIGS. 3 and 4, the cover member 22 may be opened and closed by rotating the other end portion 24 on the +Z-axis direction side about one end portion 23 on the −Z-axis direction side as the support point. Opening the cover member 22 makes the upper side accessible and allows the liquid container 50 to be demounted upward from the mounting/demounting unit 30 and to be mounted downward to the mounting/demounting unit 30. The liquid container 50 is replaced when ink contained in the liquid container 50 is running low. For such replacement, the user may open the cover member 22, mount a new liquid container 50 to the mounting/demounting unit 30 and close the cover member 22.

Figure 5:
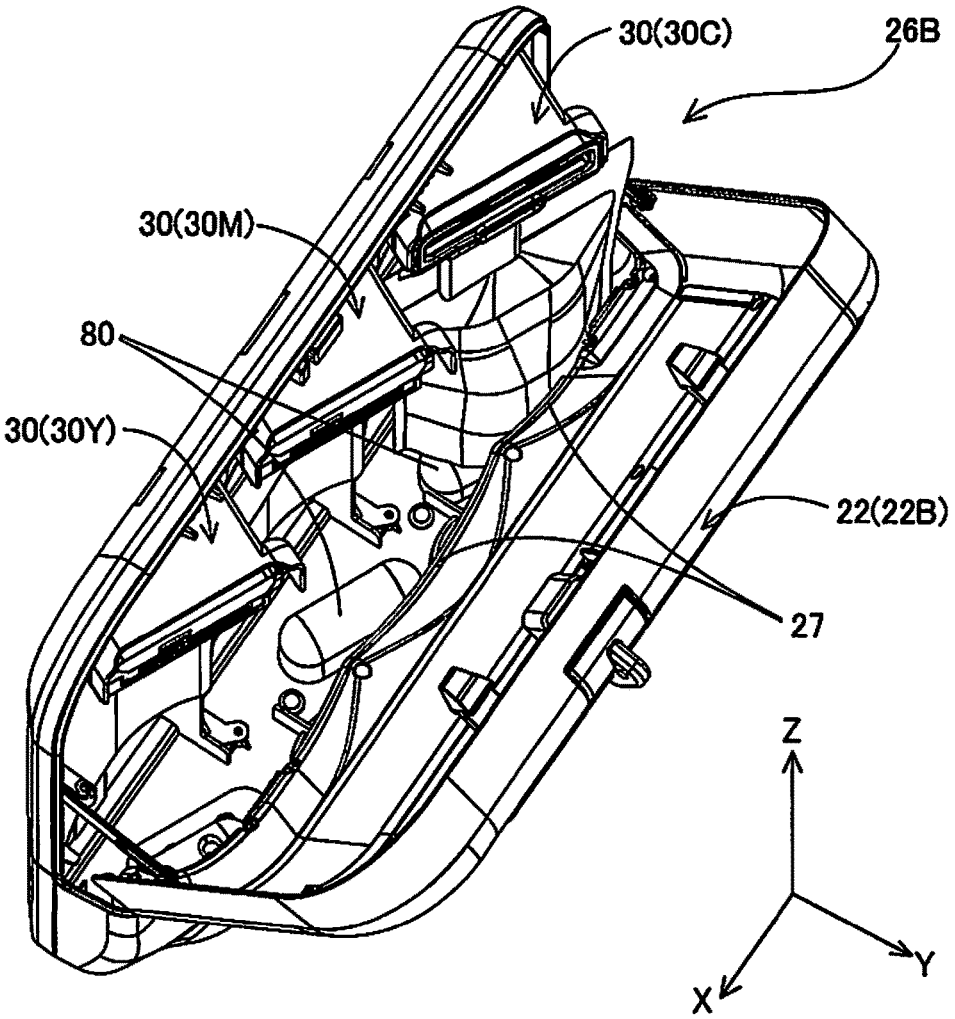
FIG. 5 is a perspective view illustrating a housing space.

FIG. 5 is a perspective view illustrating the housing space 26B (storage portion). FIG. 5 illustrates the state that the liquid container 50C is placed in the housing space 26B. As shown in FIG. 5, the housing space 26B includes guide structures 27 and abutment structures 80. The guide structure 27 and the abutment structure 80 are provided for each of the three mounting/demounting units 30. The abutment structures 80 are provided integrally with the housing space 26B. The abutment structure 80 abuts on the liquid container 50 in the state that the liquid container 50 is mounted to the mounting/demounting unit 30. The abutment structure 80 has a curved convex shape (convex curved surface) or a projection as shown in FIG. 5, with a view to protecting the liquid container 50 from being damaged. The abutment structure 80 will be described later with reference to FIGS. 44 to 50.

The guide structure 27 serves to guide insertion of the liquid container 50 when the user inserts the liquid container 50 from outside into the housing space 26B. The guide structure 27 guides the liquid container 50 such that a third film 523 (shown in FIG. 6) on a bottom of the liquid container 50 abuts on the abutment structure 80. For the purpose of such guiding, the guide structure 27 is in a curved concave shape as shown in FIG. 5. The housing space 26A also has a guide structure 27 and an abutment structure 80, like the housing space 26B.

Figure 6:
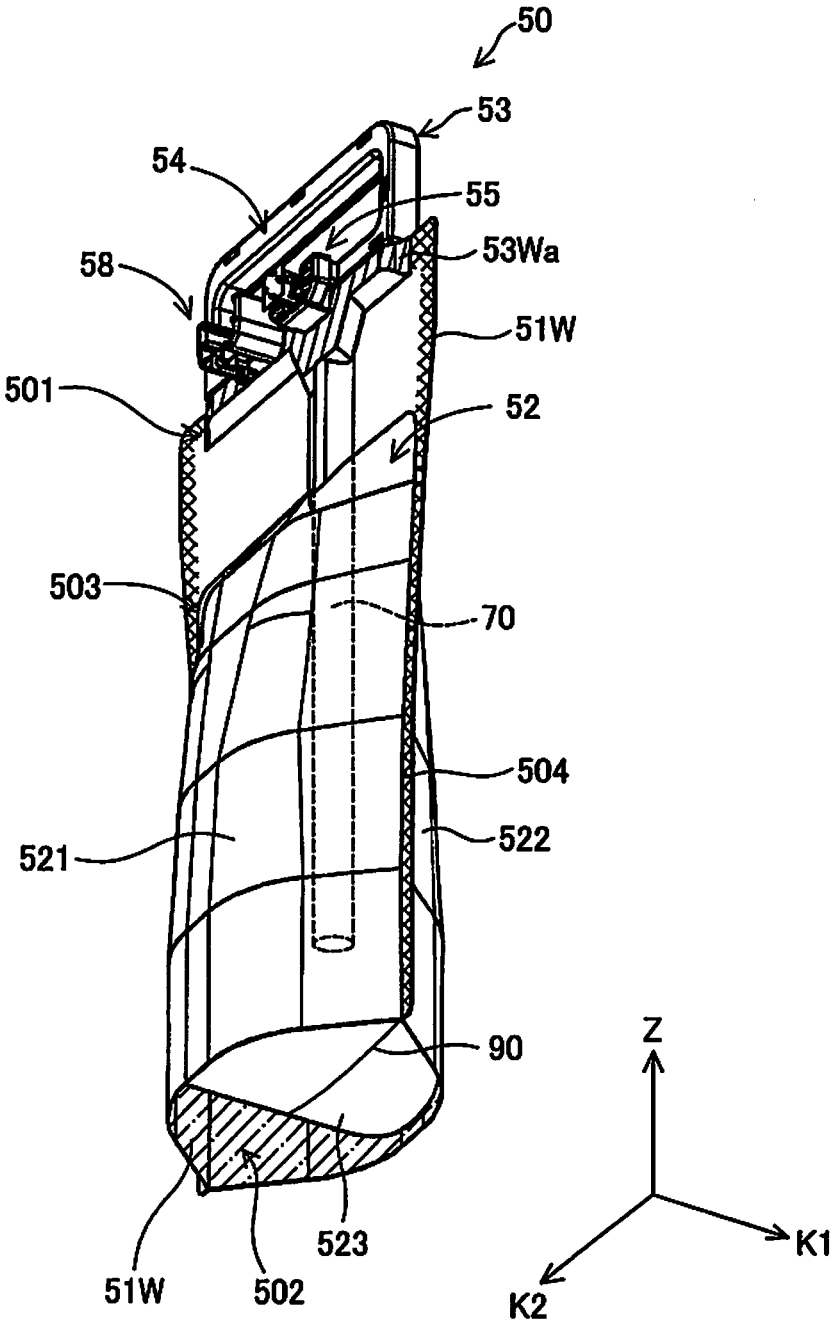
FIG. 6 is a perspective view illustrating the appearance of the liquid container.
Figure 7:
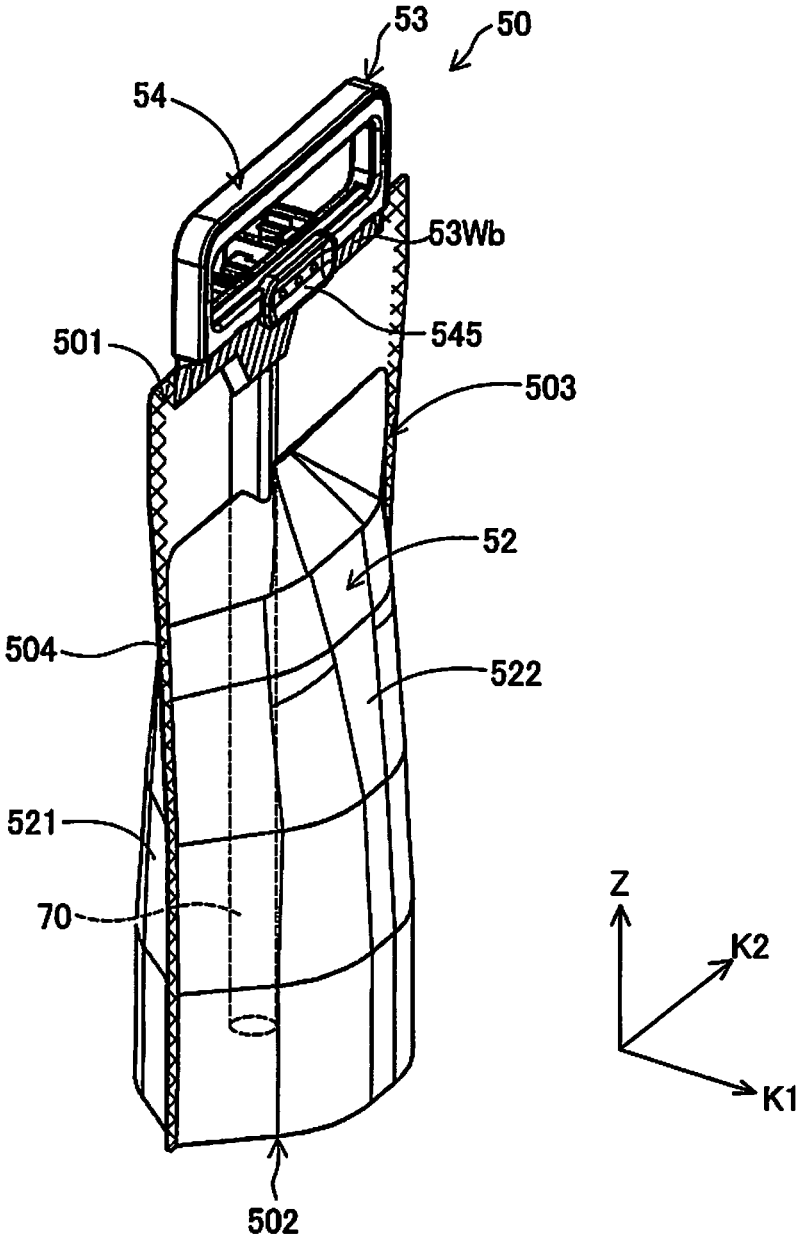
FIG. 7 is a perspective view illustrating the appearance of the liquid container.
Figure 8:
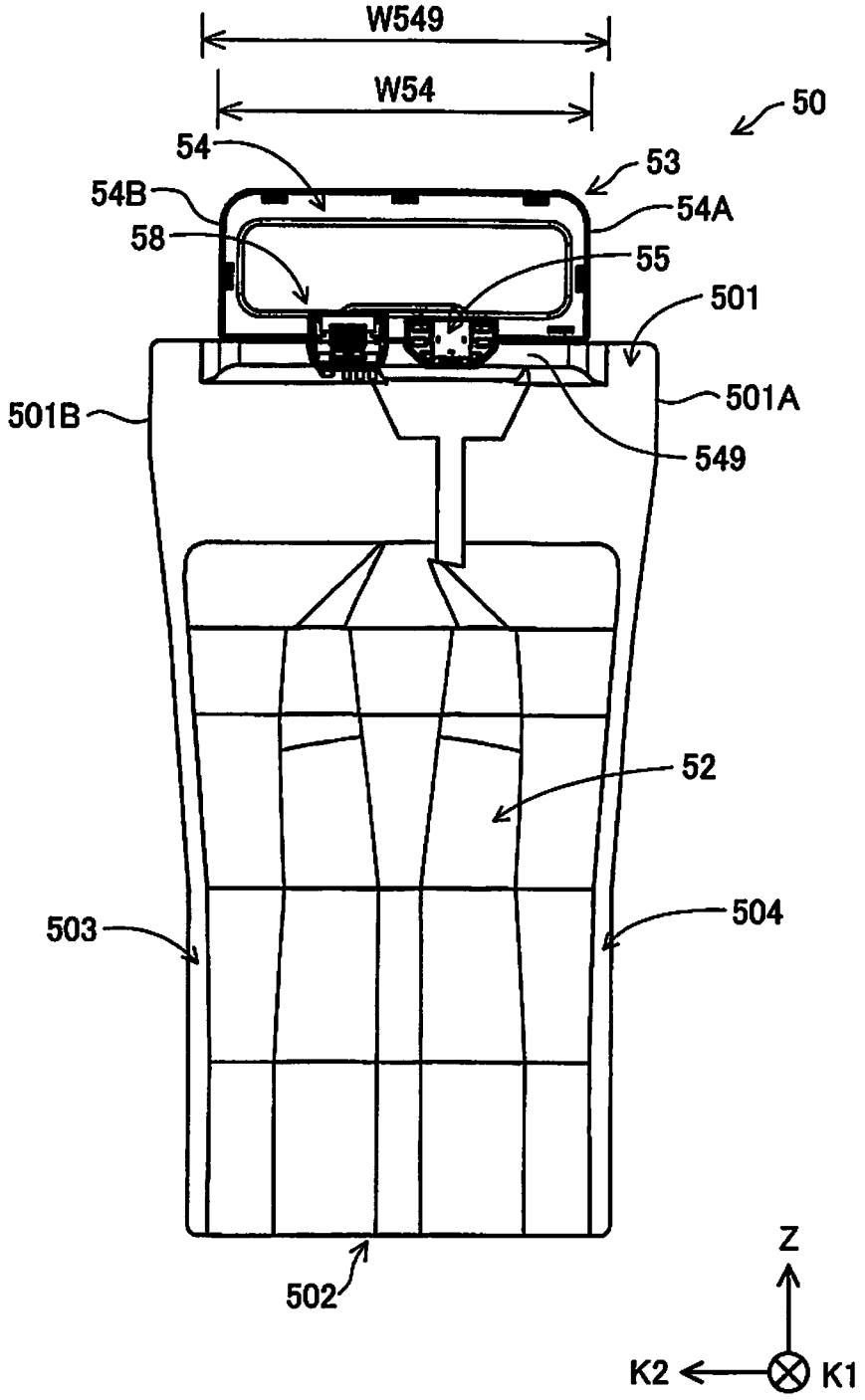
FIG. 8 is a front view illustrating the appearance of the liquid container.

Configuration of Liquid Container 50:

FIG. 6 and FIG. 7 are perspective views illustrating the appearance of the liquid container 50. FIG. 8 is a front view illustrating the appearance of the liquid container 50. FIGS. 6, 7 and 8 show Z axis, K1 axis and K2 axis in the state that the liquid container 50 is mounted to the mounting/demounting unit 30 (mounted state). The Z axis is identical with the Z axis shown in FIGS. 1 and 2.

FIGS. 6 and 7 illustrate the state that the liquid container 50 is filled with ink but is not yet mounted to the mounting unit 30. As shown in FIGS. 6 and 7, the liquid container 50 includes a liquid containing bag 52 and an operation member 53. The operation member 53 includes a grip portion 54, a liquid supply unit 55, a substrate unit 58 and a pressed portion 545. The grip portion 54 is a part held by the user to hold the liquid container 50.

The liquid containing bag 52 is configured to contain ink therein. The liquid containing bag 52 is attached to the operation member 53 in the state that the bag surface is exposed. In other words, the liquid containing bag 52 is not placed in a case or the like but is configured to be visible from outside.

A side of the liquid containing bag 52 to which the operation member 53 is attached is defined as one end 501-side, and an opposite side to the one end 501 is defined as the other end 502-side. A +K2-axis direction end of the liquid containing bag 52 is defined as first side edge 503, and a −K2-axis direction end is defined as second side edge 504.

As shown in FIG. 8, the liquid supply unit 55 and the substrate unit 58 are located on the one end 501-side of the liquid containing bag 52. As shown in FIG. 8, when the liquid container 50 is viewed along the K1-axis direction, the liquid supply unit 55 and the substrate unit 58 are located to at least partially overlap the one end 501. Accordingly the respective lower ends of the liquid supply unit 55 and the substrate unit 58 are located on the −Z-axis direction side of the upper end of the one end 501.

The liquid containing bag 52 includes a first film 521, a second film 522 (shown in FIG. 6) and a third film 523. The first to the third films 521 to 523 define a space for containing ink inside thereof. As shown in FIGS. 6 and 7, the first film 521 and the second film 522 form side faces of the liquid containing bag 52. As shown in FIG. 6, the third film 523 forms a bottom face of the liquid containing bag 52. The first film 521 and the second film 522 are arranged to face each other. Respective peripheral areas 51W of the first film 521 and the second film 522 are partly welded. More specifically, one end 501-portions, first side edge 503-portions and second side edge 504-portions of the respective peripheral areas 51W are welded. The welded portions of the first and the second films 521 and 522 are shown by cross-hatching in FIGS. 6 and 7.

Figure 15:
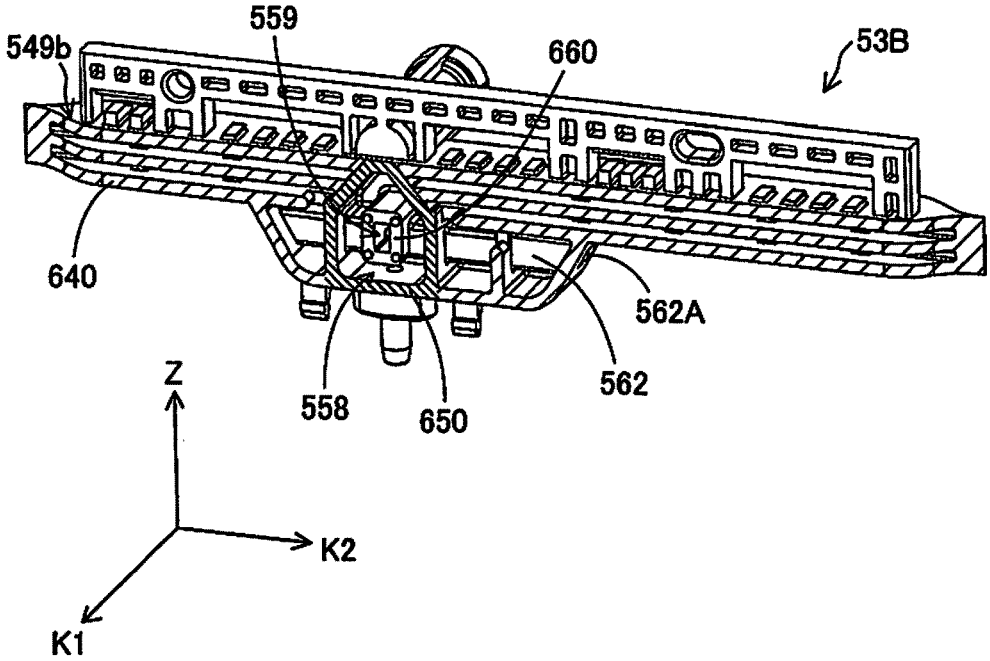
FIG. 15 is a perspective view illustrating a liquid supply assembly.
Figure 16:
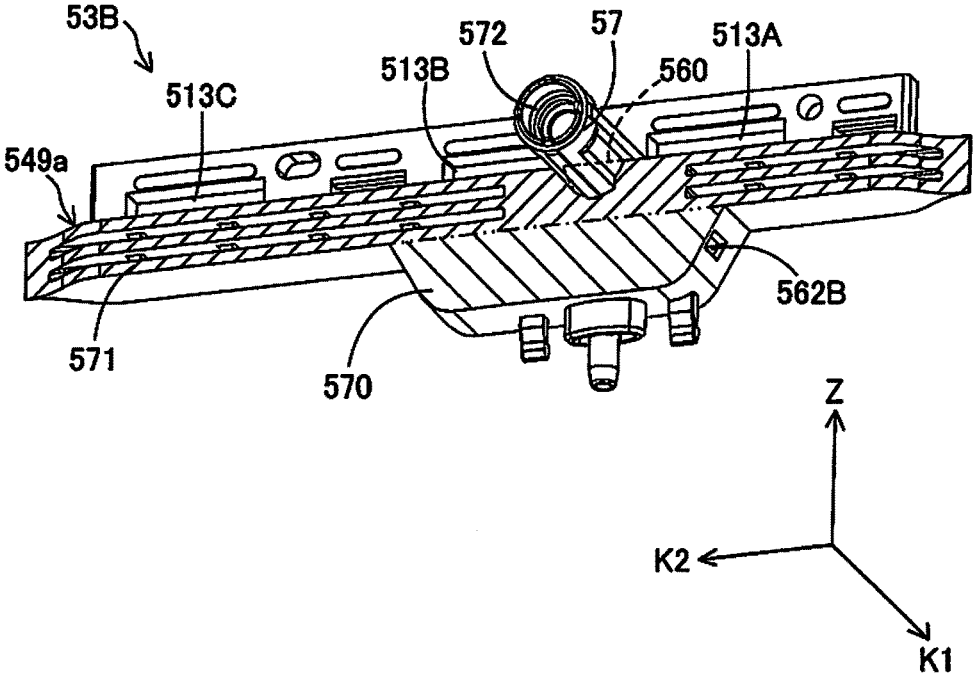
FIG. 16 is a perspective view illustrating the liquid supply assembly.

The one end 501 of the liquid containing bag 52 (more specifically, the one ends of the first and the second films 521 and 522) are welded to joint structures 549 of the operation member 53 (shown in FIG. 15 and FIG. 16). More specifically, a liquid supply assembly 53B of the operation member 53 is placed between the first film 521 and the second film 522 forming the one end 501 of the liquid containing bag 52. A joint structure 549*a* of the liquid supply assembly 53B is joined with an inner surface of the first film 521, and a joint structure 549*b* of the liquid supply assembly 53B is joined with an inner surface of the second film 522. The operation member 53 is a member attachable to the one end 501 of the liquid containing bag 52. Peripheral areas 53W that are welded portions of the operation member 53 to the first and the second films 521 and 522 are shown by solid-line single-hatching in FIGS. 6 and 7.

The third film 523 has a peripheral area 51W that is partly welded to the peripheral areas 51W of the first film 521 and the second film 522. Welded portions of the third film 523 to the first and the second films 521 and 522 are shown by one-dot chain line single-hatching in FIG. 6. The third film 523 serves as gusset.

The first to the third films 521 to 523 are respectively flexible. The material employed for the first to the third films 521 to 523 may be, for example, polyethylene terephthalate (PET), nylon or polyethylene. The flexibility reduces the internal volume of the liquid containing bag 52 with reduction of ink contained in the liquid containing bag 52.

The liquid container 50 has a flow path member 70 configured to cause the ink contained in the liquid containing bag 52 to flow into the liquid supply unit 55 (more specifically, a liquid supply assembly 53B described later). The flow path member 70 is placed inside of the liquid containing bag 52.

The relationship of the respective components of the liquid container 50 is described with reference to FIG. 8. A width W54 denotes the width along the K2-axis direction of the grip portion 54 on the one end 501 of the liquid containing bag 52. A width W549 denotes the width along the K2-axis direction of the joint structure 549. The width W54 is the distance between one end portion 54A and the other end portion 54B of the grip portion 54 in the K2-axis direction. The width W54 is less than the width W549. The liquid supply unit 55 and the substrate unit 58 are located between the respective end portions 54A and 54B of the grip portion 54 with respect to the K2-axis direction.

Figure 9:
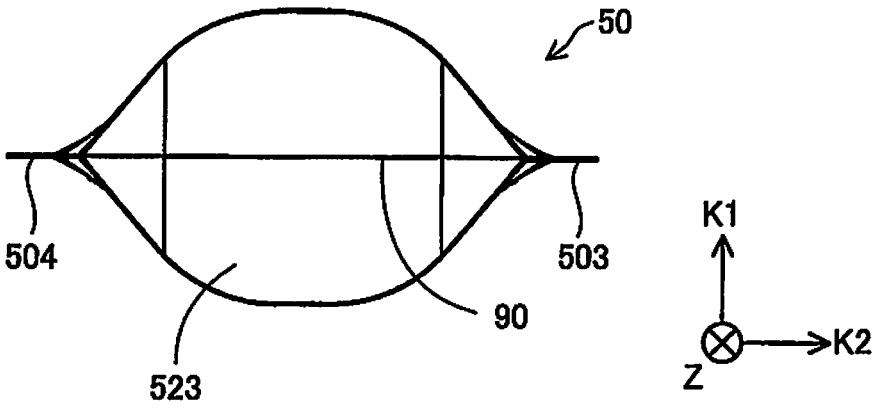
FIG. 9 is a bottom view illustrating the appearance of the liquid container.

FIG. 9 is a bottom view illustrating the appearance of the liquid container 50. As shown in FIG. 9, the third film 523 has a folding line 90. The folding line 90 is provided to connect the first side edge 503 with the second side edge 504 as shown in FIG. 9. The third film 523 is folded along the folding line 90 with reduction in the internal volume of the liquid containing bag 52. Folding the third film 523 in this manner allows for smooth reduction in the internal volume of the liquid containing bag 52. This results in reducing the amount of remaining ink. The remaining ink herein denotes ink left in the liquid containing bag 52 that is removed (detached) for replacement of the liquid container 50.

Figure 10:
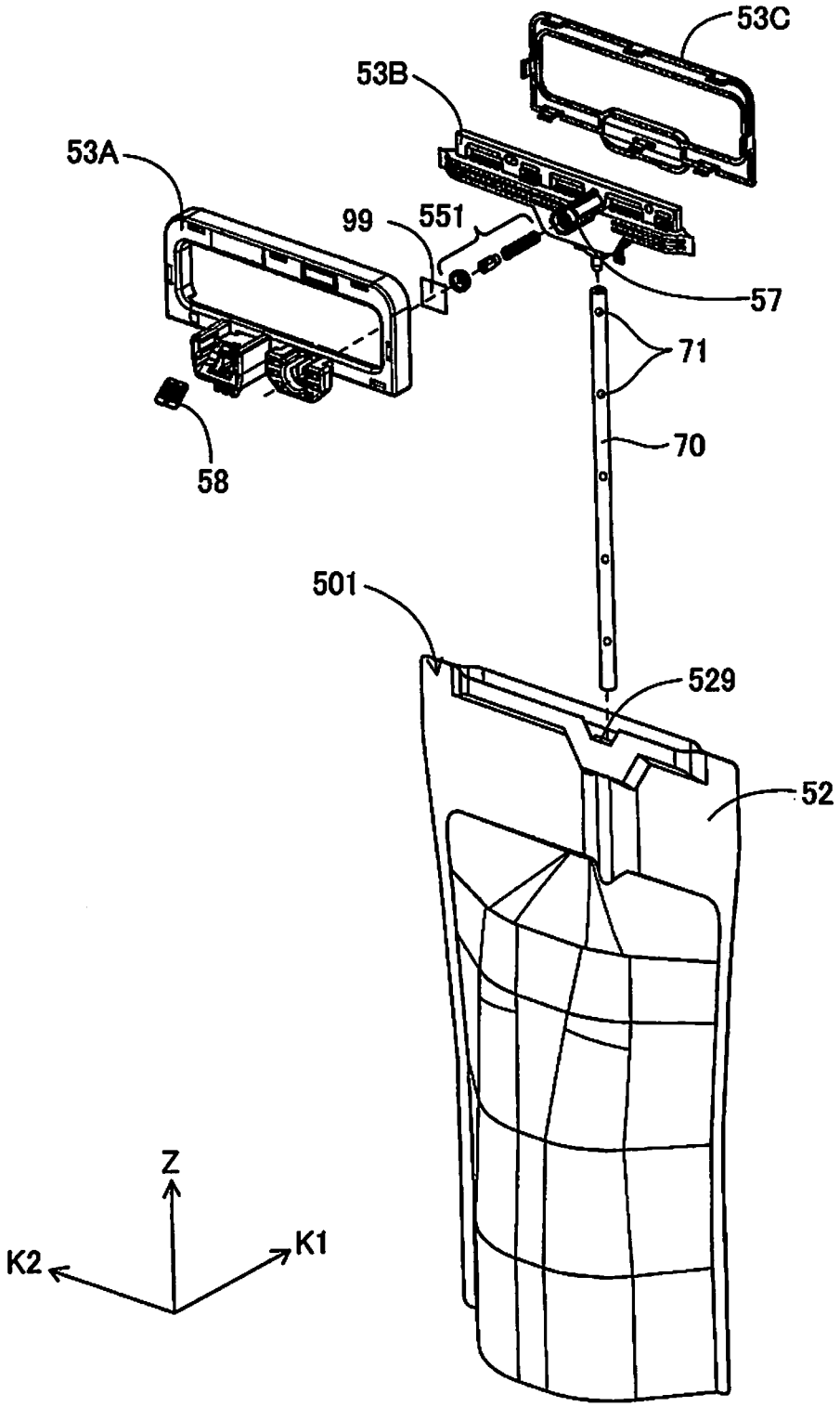
FIG. 10 is a perspective view illustrating the liquid container in the exploded state.

FIG. 10 is a perspective view illustrating the liquid container 50 in the exploded state. The liquid container 50 includes the liquid containing bag 52, a linkage member 53A, the liquid supply assembly 53B, a pressing member 53C, the substrate unit 58, the flow path member 70, a sealing film 99 and a valve mechanism 551.

The liquid containing bag 52 has a cutout portion 529. The cutout portion 529 is a cutout formed in the one end 501. The cutout portion 529 is provided to avoid interference of a liquid supply tube 57 with the one end 501 in the process of welding the liquid supply assembly 53B to the liquid containing bag 52.

The flow path member 70 is a tubular member provided to allow ink to flow inside thereof. The flow path member 70 has a plurality of holes 71. The holes 71 are through holes penetrating the outer wall and the inner wall of the flow path member 70. Providing the holes 71 allows ink to be flowed in and flowed out through the holes 71, as well as through open ends of the flow path member 70.

Figure 11:
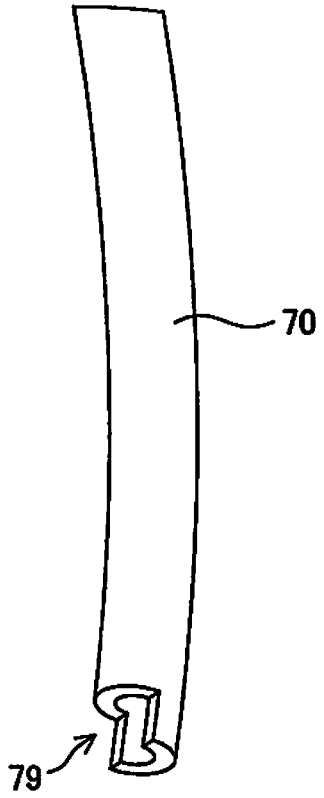
FIG. 11 is a diagram illustrating the neighborhood of an open end of a flow path member.

FIG. 11 is a diagram illustrating the neighborhood of an open end of the flow path member 70. The flow path member 70 has a cut portion 79 on its lower end. The cut portion 79 is a surface formed by cutting out part of the wall of the flow path member 70 near the open end. Providing the cut portion 79 enables ink near the bottom of the liquid containing bag 52 to be readily flowed into the open end of the flow path member 70 even in the state that ink is running low.

Figure 12:
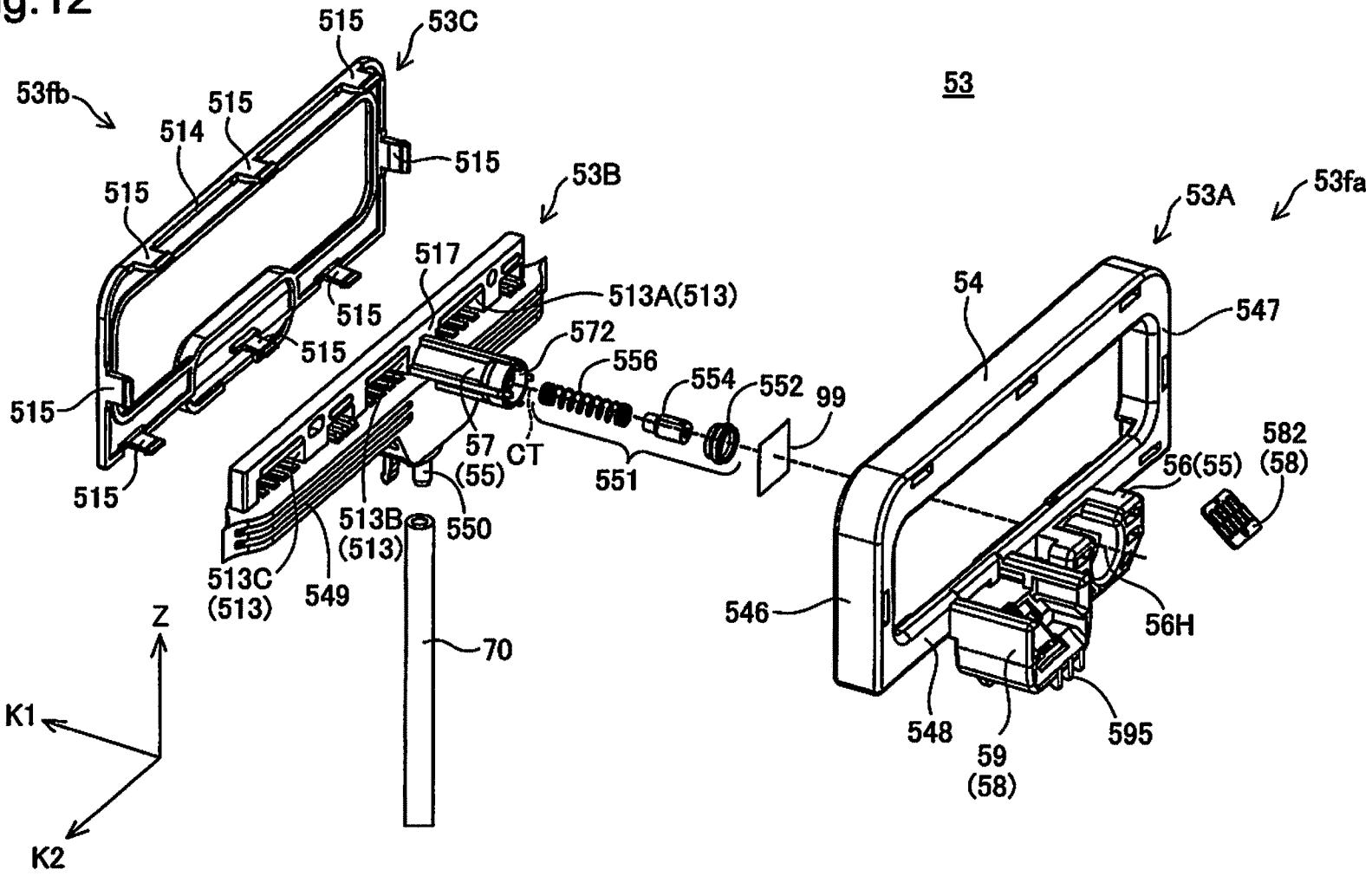
FIG. 12 is a perspective view illustrating an operation member in the exploded state.
Figure 13:
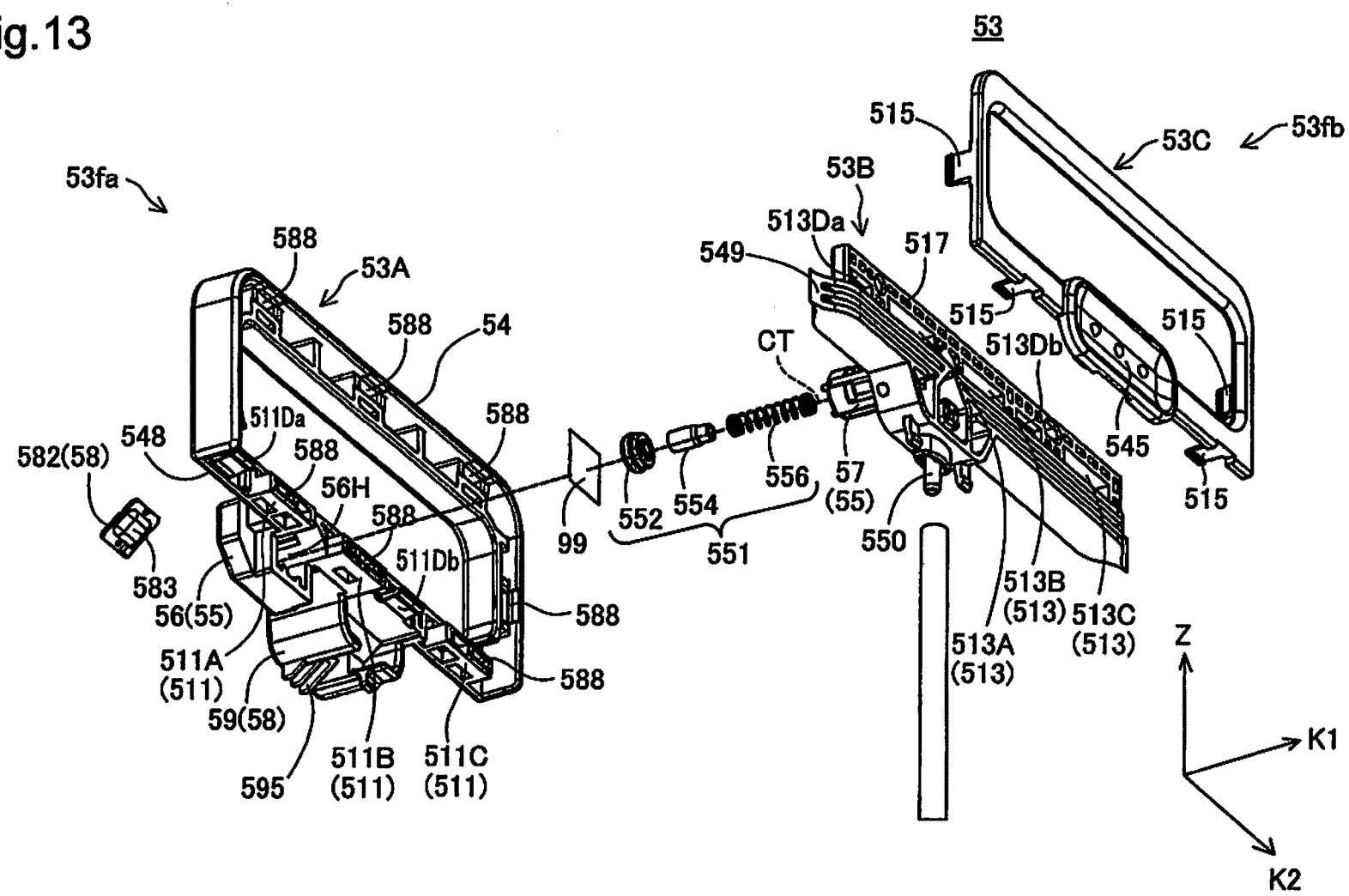
FIG. 13 is a perspective view illustrating the operation member in the exploded state.

FIG. 12 and FIG. 13 are perspective views illustrating the operation member 53 in the exploded state. As shown in FIGS. 12 and 13, the operation member 53 includes the linkage member 53A, the liquid supply assembly 53B and the pressing member 53C. The linkage member 53A and the pressing member 53C are assembled with the liquid supply assembly 53B placed therebetween. The linkage member 53A, the liquid supply assembly 53B and the pressing member 53C are manufactured by resin molding. In Embodiment 1, different materials are employed for resin molding of the linkage member 53A, the liquid supply assembly 53B and the pressing member 53C. The material employed for the linkage member 53A has a higher mechanical rigidity than that of the liquid supply assembly 53B.

As shown in FIGS. 12 and 13, a −K1-axis direction side of the operation member 53 is defined as first side 53*fa*, and a +K1-axis direction side of the operation member 53 is defined as second side 53*fb*.

The linkage member 53A includes the grip portion 54. The grip portion 54 is formed in a frame-like shape. The linkage member 53A is a plate-like member extended along a plane perpendicular to the K1-axis direction (direction of a center axis CT of the liquid supply tube 57). A positioning structure 56 and a circuit board holding structure 59 are integrally formed to be connected with a base portion 548 of the linkage member 53A (more specifically, on the first side 53*fa* of the base portion 548).

As shown in FIG. 13, the linkage member 53A has three engagement elements 511A, 511B and 511C on the second side 53*fb*. The engagement elements 511A, 511B and 511C are members that are engaged with the liquid supply assembly 53B so as to link (connect) the linkage member 53A with the liquid supply assembly 53B. The engagement element 511 is a convex protruded from the base portion 548 toward the liquid supply assembly 53B (+K1-axis direction). The three engagement elements 511A, 511B and 511C are arrayed along the K2-axis direction (the direction in which the positioning structure 56 and the circuit board holding structure 59 are arrayed). When there is no need to distinguish among the three engagement elements 511A, 511B and 511C, these are expressed by a reference sign "511".

The engagement elements 511 are provided on the second side 53*fb* of the base portion 548. The engagement element 511 is formed in an approximately rectangular parallelepiped shape. In other words, the engagement element 511 has an approximately rectangular outer shape to surround a virtual straight line along the K1-axis direction.

As shown in FIG. 13, the linkage member 53A has eight member engagement elements 588 (only seven are shown) on the second side 53*fb*. The member engagement elements 588 are in a concave shape and are engaged with the pressing member 53C so as to link the linkage member 53A with the pressing member 53C.

As shown in FIGS. 12 and 13, the liquid supply assembly 53B includes the liquid supply tube 57 and the joint structures 549. The liquid supply tube 57 and the joint structures 549 are integrally formed as part of the liquid supply assembly 53B.

The liquid supply assembly 53B has three engagement elements 513A, 513B and 513C. The engagement elements 513A, 513B and 513C are engaged with the engagement elements 511 so as to attach the linkage member 53A to the liquid supply assembly 53B. When there is no need to distinguish among the three engagement elements 513A, 513B and 513C, these are expressed by a reference sign "513".

The three engagement elements 513A, 513B and 513C are provided corresponding to the three engagement elements 511A, 511B and 511C of the linkage member 53A. The engagement element 513 is a hole formed to pass through in the K1-axis direction. The engagement element 513 is formed in such an outer shape that allows the engagement element 511 to be fit in. The engagement element 513 has an approximately rectangular outer shape to surround a direction along the K1-axis direction (direction of the center axis CT of the liquid supply tube 57) (K1-axis direction).

Figure 14:
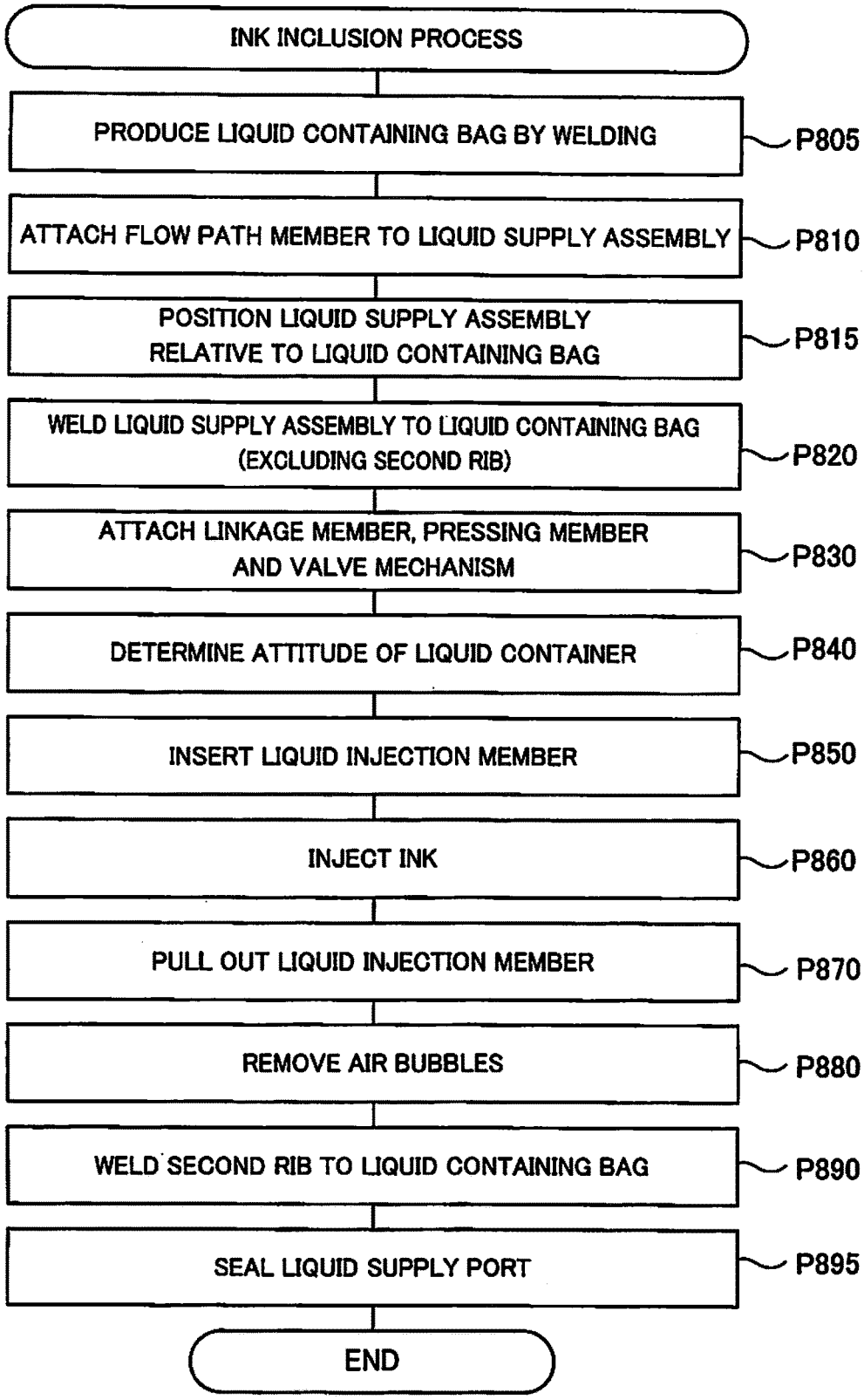
FIG. 14 is a process chart showing an ink inclusion process.

Inclusion of Ink in Liquid Container 50:

FIG. 14 is a process chart showing an ink inclusion process. The ink inclusion process is a process to complete the liquid container 50 with ink contained therein from the disassembled state shown in FIG. 10.

The liquid containing bag 52 is first produced by welding (process P805). More specifically, the liquid containing bag 52 is produced by welding the peripheral areas 51W of the first to the third films 521 to 523. The flow path member 70 is subsequently attached to the liquid supply assembly 53B (process P810). More specifically, a lead-out portion 550 is inserted into the flow path member 70 (as shown in FIGS. 12 and 13).

The liquid supply assembly 53B is then positioned relative to the liquid containing bag 52 (process P815). More specifically, the attached flow path member 70 is inserted into the liquid containing bag 52, and the joint structures 549 of the liquid supply assembly 53B are positioned relative to the first and the second sheet members 521 and 522. The liquid supply assembly 53B is positioned such that the liquid supply tube 57 comes into contact with the cutout portion 529. This positioning is performed for subsequent welding.

The liquid supply assembly 53B is then welded to the liquid containing bag 52 (process P820). At process P820, however, a second rib 660 (shown in FIG. 15) is not welded.

FIG. 15 and FIG. 16 are perspective views illustrating the liquid supply assembly 53B. The joint structures 549*a* and 549*b* are portions of the liquid supply assembly 53B that are to be welded to the liquid containing bag 52. The liquid supply assembly 53B is formed in a boat-like shape when viewed in the −Z-axis direction. The boat-like shape herein denotes a shape having the thickness gradually decreasing toward the respective ends in the longitudinal direction. The liquid supply assembly 53B has two surfaces in a direction orthogonal to the Z axis or more specifically two surfaces opposed to each other in the K1-axis direction. One of the two surfaces has the joint structure 549*a*, and the other has the joint structure 549*b*.

The joint structure 549*b* (shown in FIG. 15) includes an upper end joint portion 640, a first rib 650 and a second rib 660. The upper end joint portion 640 and the first rib 650 are welded at process P820. The upper end joint portion 640 is shown by hatching of top-right to bottom-left lines in FIG. 15. The first rib 650 is shown by hatching of top-left to bottom-right lines in FIG. 15 and is in an approximately pentagonal shape. The first and the second films 521 and 522 are welded to the joint structure 549*a* and the joint structure 549*b* except the second rib 660, so that the one end 501 of the liquid containing bag 52 is sealed.

As shown in FIG. 15, the first rib 650 defines a first chamber 558. The second rib 660 separates a second chamber 559 from the first chamber 558. A bypass 562 shown in FIG. 15 is provided as a flow path arranged to connect the second chamber 559 with inside of the liquid containing bag 52. The second chamber 559 communicates with the first chamber 558 in the state that the second rib 660 is not welded. Accordingly the bypass 562 communicates with the first chamber 558 in the state that the second rib 660 is not welded. The details of the bypass 562 will be described later with reference to FIGS. 25 to 27.

As shown in FIG. 16, the joint structure 549*a* is a combined portion of surfaces shown by two different hatchings. The joint structure 549*a* has a gouged portion 560 as shown in FIG. 16. The gouged portion 560 is formed by gouging the joint structure 549*a* in the plane direction. The liquid supply tube 57 is arranged to abut on the gouged portion 560. In other words, the lower end (−Z-axis direction end) of the liquid supply tube 57 is located below (on the −Z-axis direction side of) the upper end (+Z-axis direction end) of the joint structure 549*a*.

As shown in FIG. 16, the joint structure 549*a* includes an overhang portion 570 and a main joint plane 571. The main joint plane 571 serves as a main joint surface of the joint structure 549*a*. The overhang portion 570 is a portion protruded from the main joint plane 571 in the −Z-axis direction and is shown by hatching of top-left to bottom-right lines. The first chamber 558, the second chamber 559, the bypass 562 and the like are provided on a rear side (−K1-axis direction side) of the welded surface of the overhang portion 570 as shown in FIG. 15.

Figure 17:
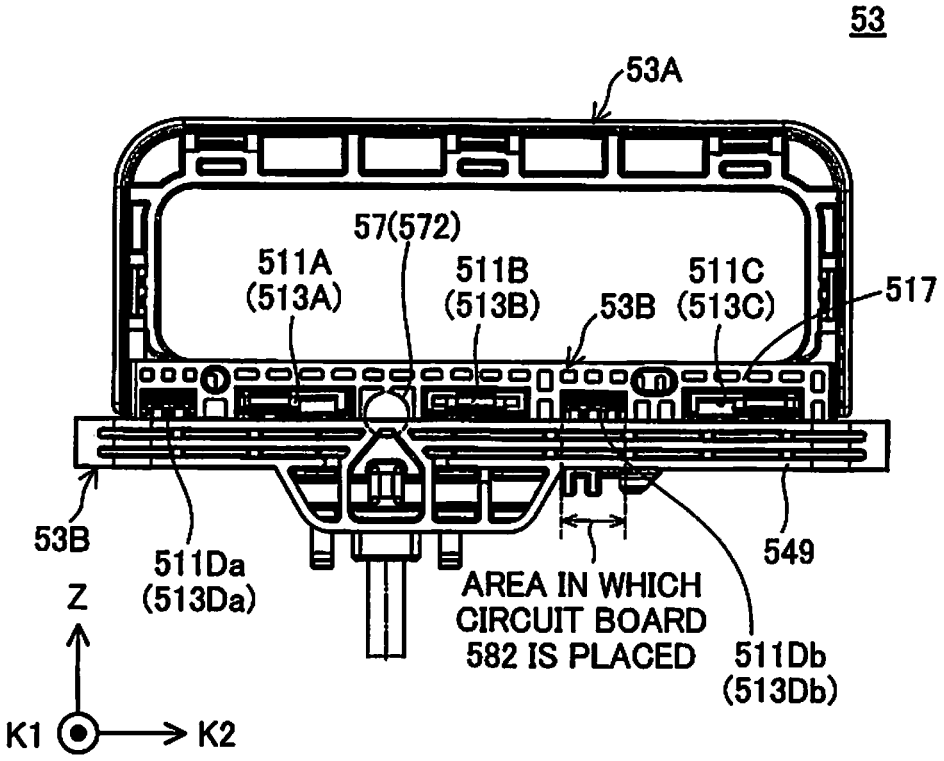
FIG. 17 is a rear view illustrating the state that a linkage member and the liquid supply assembly are assembled.

After the welding as described above, the linkage member 53A, the pressing member 53C, the valve mechanism 551 and a board 582 including a storage device 583 are assembled (process P830). This assembling process is described in detail below. FIG. 17 is a rear view illustrating the state that the linkage member 53A and the liquid supply assembly 53B are assembled. In other words, FIG. 17 shows the state that the pressing member 53C is not assembled. The liquid containing bag 52 is omitted from the illustration of FIG. 17.

As shown in FIG. 17, the engagement elements 511A, 511B and 511C are fit in the corresponding engagement elements 513A, 513B and 513C provided as through holes, so that the liquid supply assembly 53B is attached to the linkage member 53A. A protruded portion 517 provided with the engagement elements 513 is exposed on the outside of the liquid containing bag 52 in the state that the joint structure 549 are welded to the liquid containing bag 52.

The three engagement elements 511A, 511B and 511C of the linkage member 53A are engaged with the liquid supply assembly 53B to which the liquid containing bag 52 is attached, so as to support the load of the liquid containing bag 52.

As shown in FIG. 17, engagement of the engagement element 511B with the engagement element 513B restricts the motions of the liquid supply assembly 53B in the K2-axis direction and in the Z-axis direction relative to the linkage member 53A. Engagement of the engagement element 511A with the engagement element 513A and engagement of the engagement element 511C with the engagement element 513C restrict the motion of the liquid supply assembly 53B in the Z-axis direction relative to the linkage member 53*k* More specifically, the engagement elements 511 and the engagement elements 513 have the outer shapes to surround the direction (K1-axis direction) along the center axis CT direction (K1-axis direction) and thereby reduce a positional misalignment between the linkage member 53A and the liquid supply assembly 53B in a plane direction orthogonal to the center axis CT direction (plane direction defined by the Z-axis direction and the K2-axis direction).

As shown in FIG. 17, the liquid supply tube 57 is provided to at least partly overlap the joint structure 549*b* when viewed along the K1-axis direction from the joint structure 549*b*-side. In other words, a liquid supply port 572 is provided to at least partly overlap the joint structure 549*b* when viewed along the K1-axis direction from the joint structure 549*b*-side.

As shown in FIG. 13, the linkage member 53A also has locking pawls 511Da and 511Db in a convex shape. The locking pawls 511Da and 511Db are provided on the second side 53*fb* of the base portion 548 of the linkage member 53A. The liquid supply assembly 53B has through holes 513Da and 513Db at positions corresponding to the locking pawls 511Da and 511Db in the convex shape.

Figure 18:
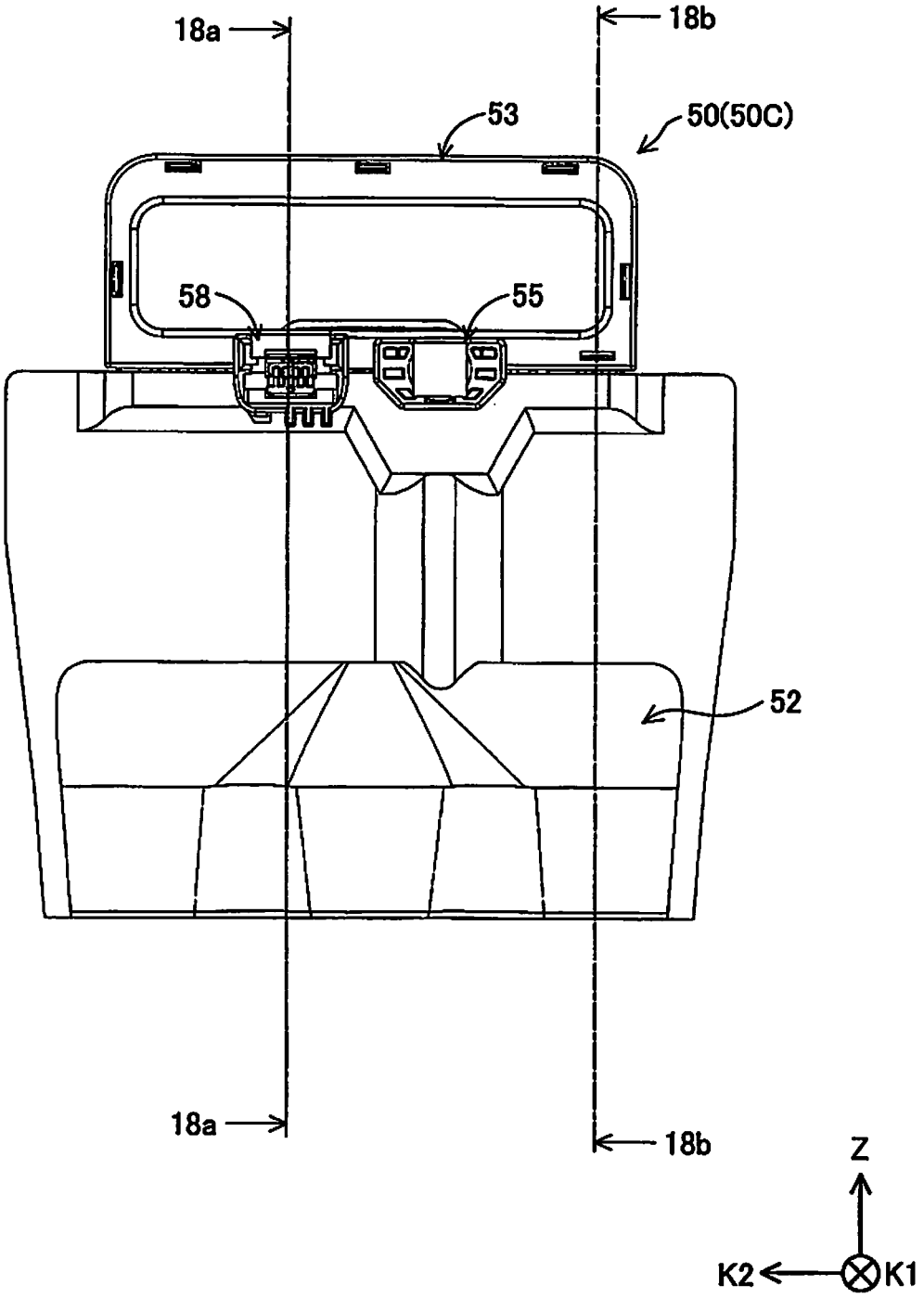
FIG. 18 is a front view illustrating the liquid container.
Figure 19:
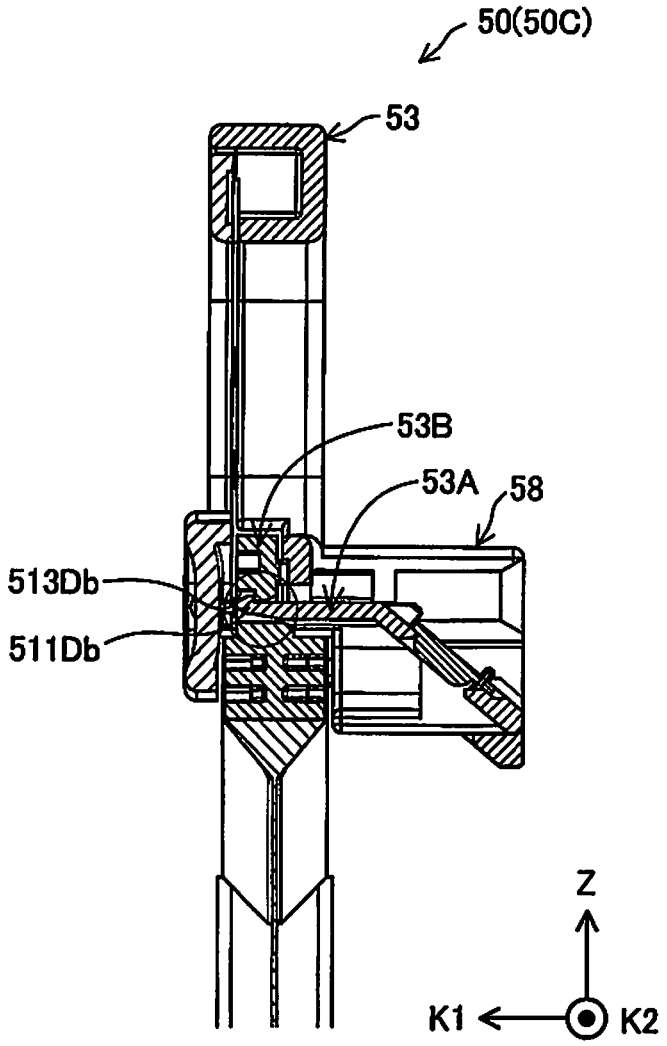
FIG. 19 is a partial sectional view of FIG. 18.
Figure 20:
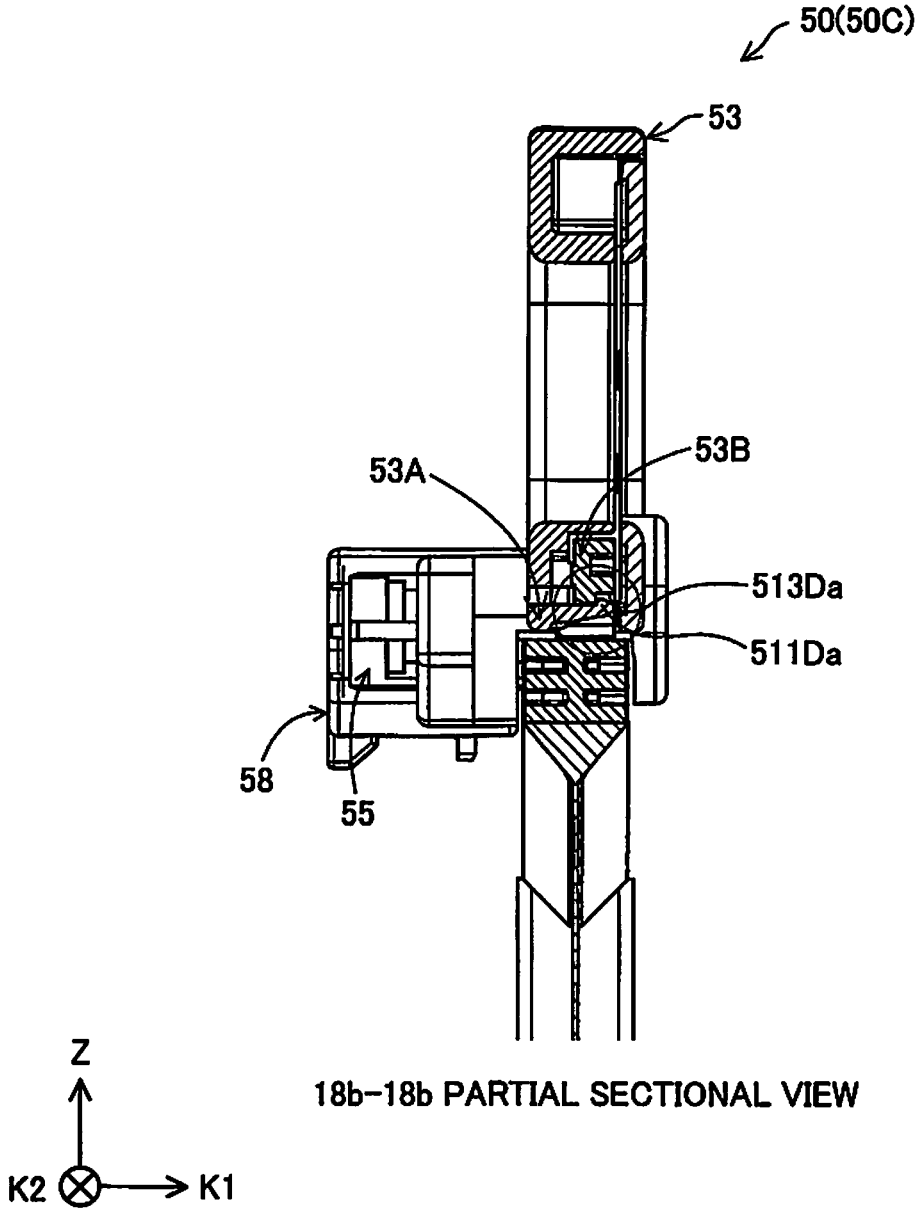
FIG. 20 is a partial sectional view of FIG. 18.

FIG. 18 is a front view illustrating the liquid container 50. FIG. 18 shows the assembled state including the pressing member 53C. FIG. 19 is an 18*a*-18*a* partial sectional view of FIG. 18. FIG. 20 is an 18*b*-18*b* partial sectional view of FIG. 18.

As shown in FIGS. 19 and 20, the locking pawls 511Da and 511D are locked to the member forming the through holes 513Da and 513Db, so as to restrict the motion of the liquid supply assembly 53B in the +K1-axis direction relative to the linkage member 53A. Part of the liquid supply assembly 53B abuts on part of the linkage member 53A, so as to restrict the motion of the liquid supply assembly 53B in the −K1-axis direction relative to the linkage member 53A.

As described above, engagement of the engagement elements 511 of the linkage member 53A with the engagement elements 513 of the liquid supply assembly 53B positions these components 53A and 53B relative to each other. The circuit board holding structure 59 is joined with the linkage member 53A, and the liquid supply tube 57 connected with the printer 10 is joined with the liquid supply assembly 53B. Accordingly engagement of the engagement elements 511 of the linkage member 53A with the engagement elements 513 of the liquid supply assembly 53B positions the liquid supply tube 57 and the circuit board holding structure 59 relative to each other.

As shown in FIG. 17, the engagement element 511A and the engagement element 511B are arranged at positions with the liquid supply tube 57 placed therebetween in the K2-axis direction of the joint structure 549. The engagement element 511A and the engagement element 511C are arranged at positions with the liquid supply tube 57 placed therebetween in the K2-axis direction. The engagement element 511B and the engagement element 511C are arranged at positions with the circuit board 582 placed therebetween in the K2-axis direction. The engagement element 511A and the engagement element 511C are arranged at positions with the circuit board 582 placed therebetween in the K2-axis direction.

As shown in FIG. 13, the pressing member 53C includes the pressed portion 545. The pressing member 53C is formed in a frame-like shape corresponding to the shape of the linkage member 53A. The pressing member 53C is a plate-like member extended along a plane perpendicular to the K1-axis direction (center axis CT direction). Eight engagement elements 515 are provided on the first side 53*fa* of the pressing member 53C. Engagement of the engagement elements 515 with the member engagement elements 588 shown in FIG. 13 links the linkage member 53A with the pressing member 53C.

The pressing member 53C is colored in the color of ink contained in the liquid containing bag 52. For example, in the case of the liquid container 50Y containing yellow ink, the pressing member 53C is colored in yellow.

After attachment of the linkage member 53A and the pressing member 53C, the attitude of the liquid container 50 is determined (process P840). A liquid injection member 13 is then inserted into the liquid supply tube 57 (process P850). Processes P840 and P850 are performed for injection of ink (process P850).

Figure 21:
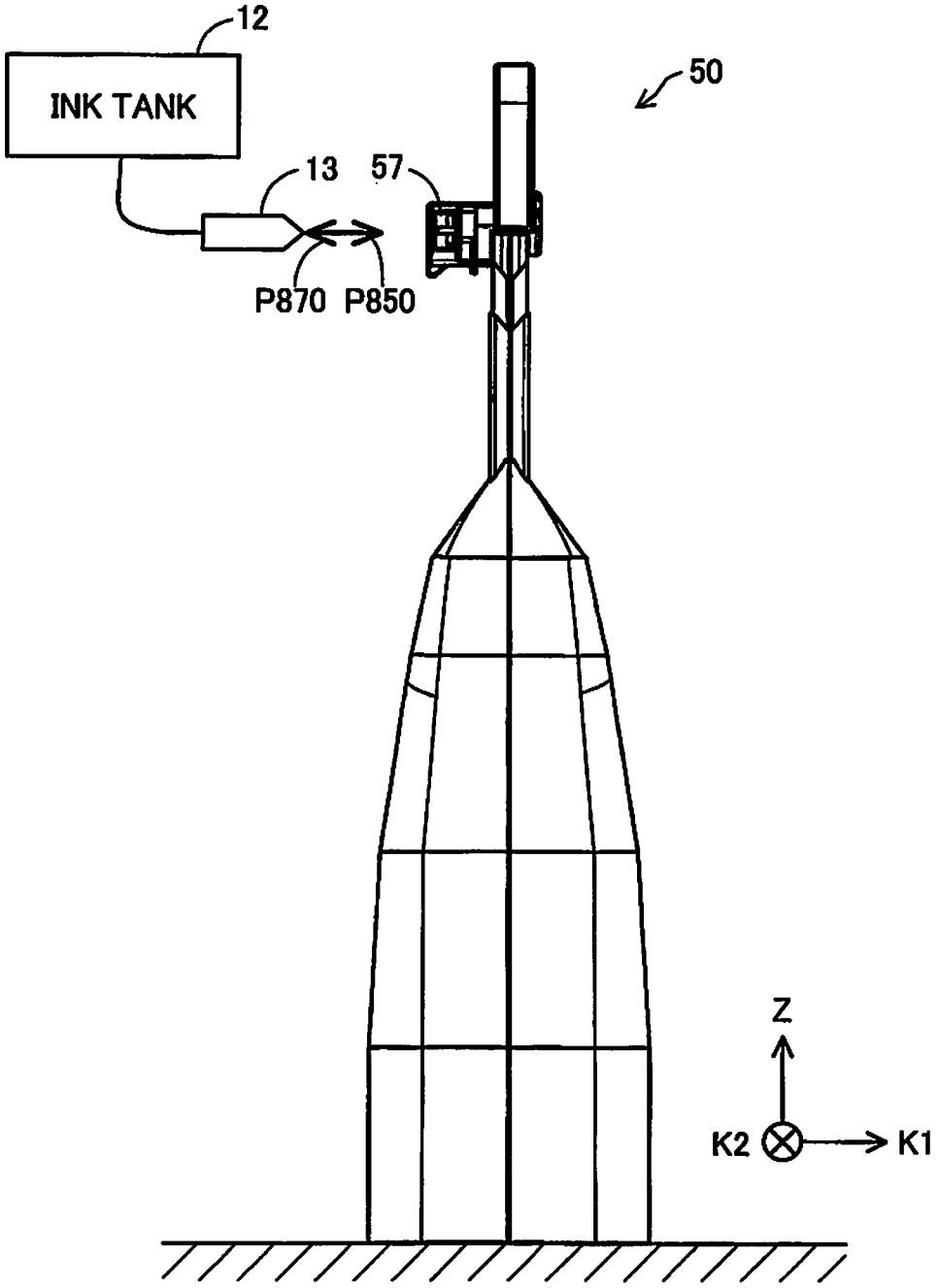
FIG. 21 is a side view illustrating the liquid container in the determined attitude.

FIG. 21 is a side view illustrating the liquid container 50 in the determined attitude. In Embodiment 1, the attitude determined during ink injection is the same attitude as that of the liquid container 50 mounted to the mounting/demounting unit 30. More specifically, the attitude is determined such that the liquid containing bag 52 is located on the −Z-axis direction side of the operation member 53 and the liquid supply tube 57 faces in the direction intersecting with the Z-axis direction or more specifically faces in the horizontal direction.

The liquid container 50 has the gusset as described above. When the amount of ink contained is over a certain level, the attitude of the liquid container 50 is determinable by simply placing the liquid container 50 on a horizontal plane as shown in FIG. 21. Ink is, however, not yet contained at process P840. A jig 14 (shown in FIG. 22) is accordingly used to fix the position of the operation member 53 at process P840.

Ink is then injected into the liquid container 50 (process P860). The ink to be injected is reserved in an ink tank 12. The ink is injected via the inserted liquid injection member 13.

Figure 22:
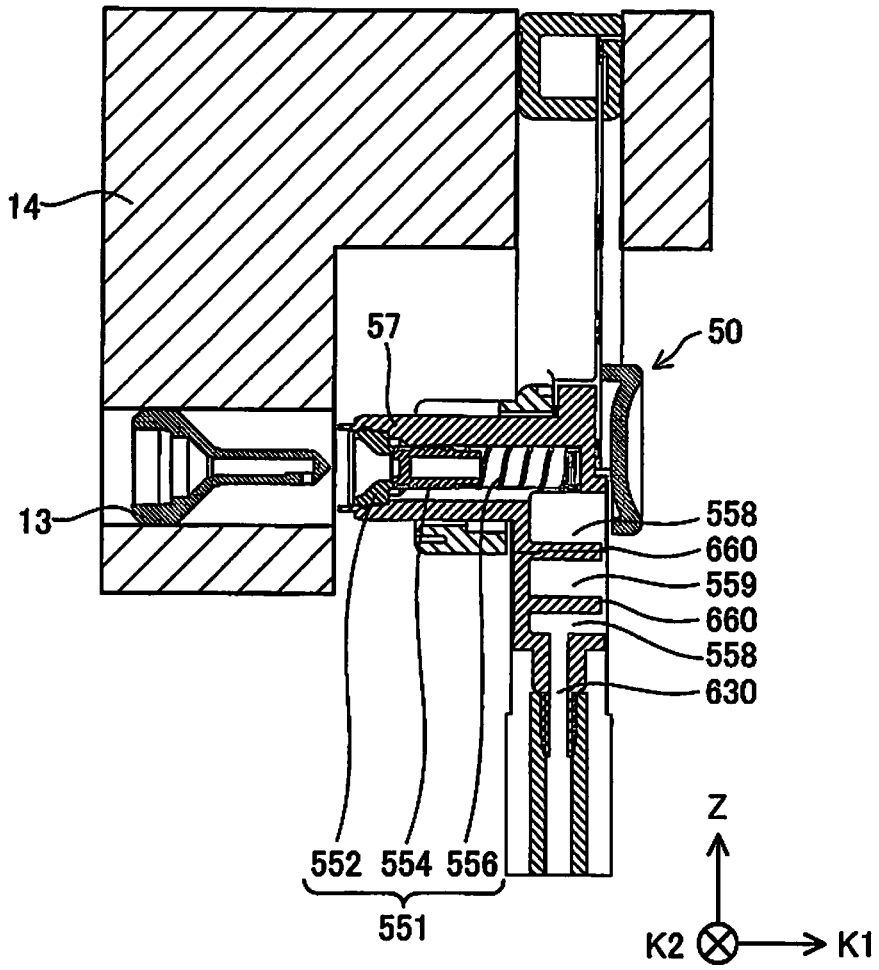
FIG. 22 is a sectional view illustrating a flow path during injection (before insertion)

FIG. 22 is a sectional view illustrating the liquid injection member 13, the jig 14 and the liquid container 50. The section of FIG. 22 is a plane that includes the center axis line of the liquid supply tube 57 and is orthogonal to the horizontal plane (47-47 section in FIG. 47).

FIG. 22 is a sectional view illustrating the state before insertion of the liquid injection member 13 into the liquid supply tube 57. The jig 14 clamps the linkage member 53A and the pressing member 53C so as to position the liquid supply tube 57. The jig 14 positions the liquid injection member 13 in a K2-Z plane by means of a through hole provided inside thereof.

As shown in FIG. 22, the valve mechanism 551 is placed inside of the liquid supply tube 57. The valve mechanism 551 is configured to open and close a flow path formed inside of the liquid supply tube 57. The valve mechanism 551 includes a valve seat 552, a valve element 554 and a spring 556.

The valve seat 552 is an approximately annular member. The valve seat 552 is formed from an elastic body, for example, a rubber or an elastomer. The valve seat 552 is pressed into the liquid supply tube 57. The valve element 554 is an approximately cylindrical member. The valve element 554 is arranged to close a hole formed in the valve seat 552 (valve hole) in the state before mounting of the liquid container 50 to the mounting/demounting unit 30 (state shown in FIG. 22). The spring 556 is a compression coil spring. The spring 556 applies a force to the valve element 554 in a direction toward the valve seat 552.

Figure 23:
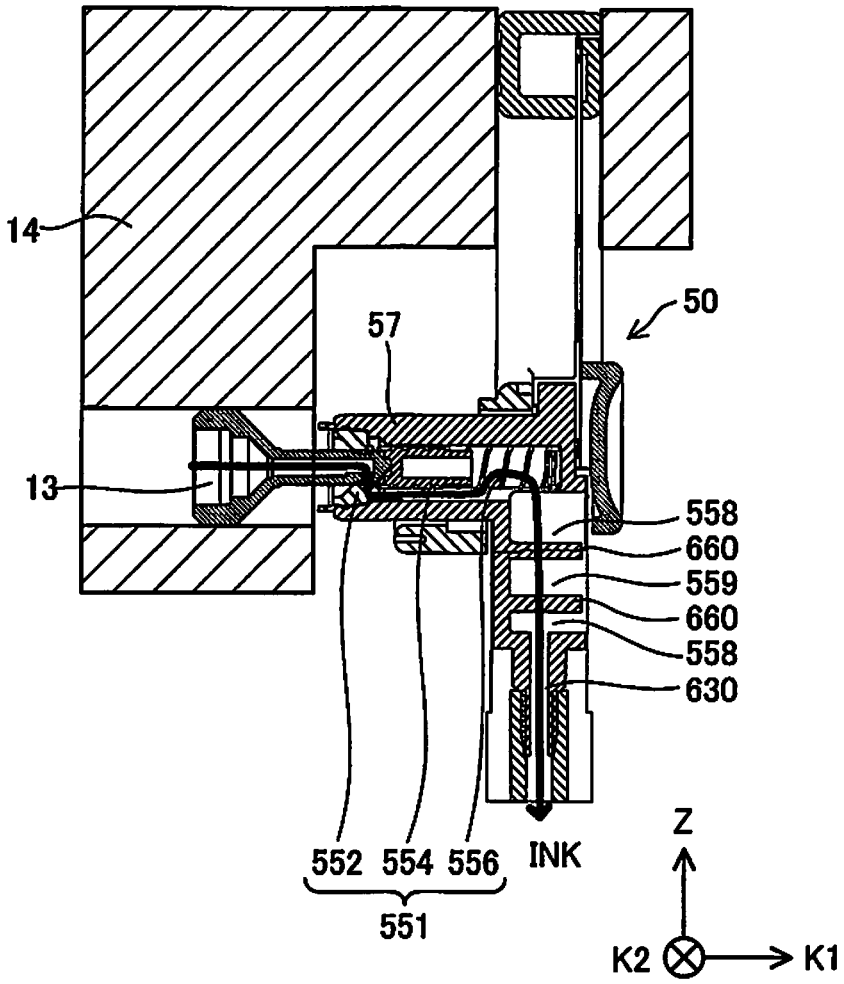
FIG. 23 is a sectional view illustrating the flow path during injection (after insertion)

FIG. 23 is a sectional view illustrating the state that the liquid injection member 13 is inserted in the liquid supply tube 57. In this state, a leading end of the liquid injection member 13 moves the valve element 554 in the +K1 direction, so as to release the seal between the valve seat 552 and the valve element 554 and connect an opening at the leading end of the liquid injection member 13 with the liquid supply tube 57 as a flow path. Connection of the flow path enables ink to be injected into the liquid containing bag 52.

Ink is injected through the bypass 562, in addition to the flow path connected in FIG. 23. The configuration of injecting ink through a plurality of flow paths reduces the flow resistance and ensures smooth injection.

The attitude determined at process P840 is maintained at process P860, so that the liquid supply tube 57 is located above the liquid containing bag 52 in the direction of gravity. This configuration enables ink to be smoothly flowed into the liquid containing bag 52.

Figure 24:
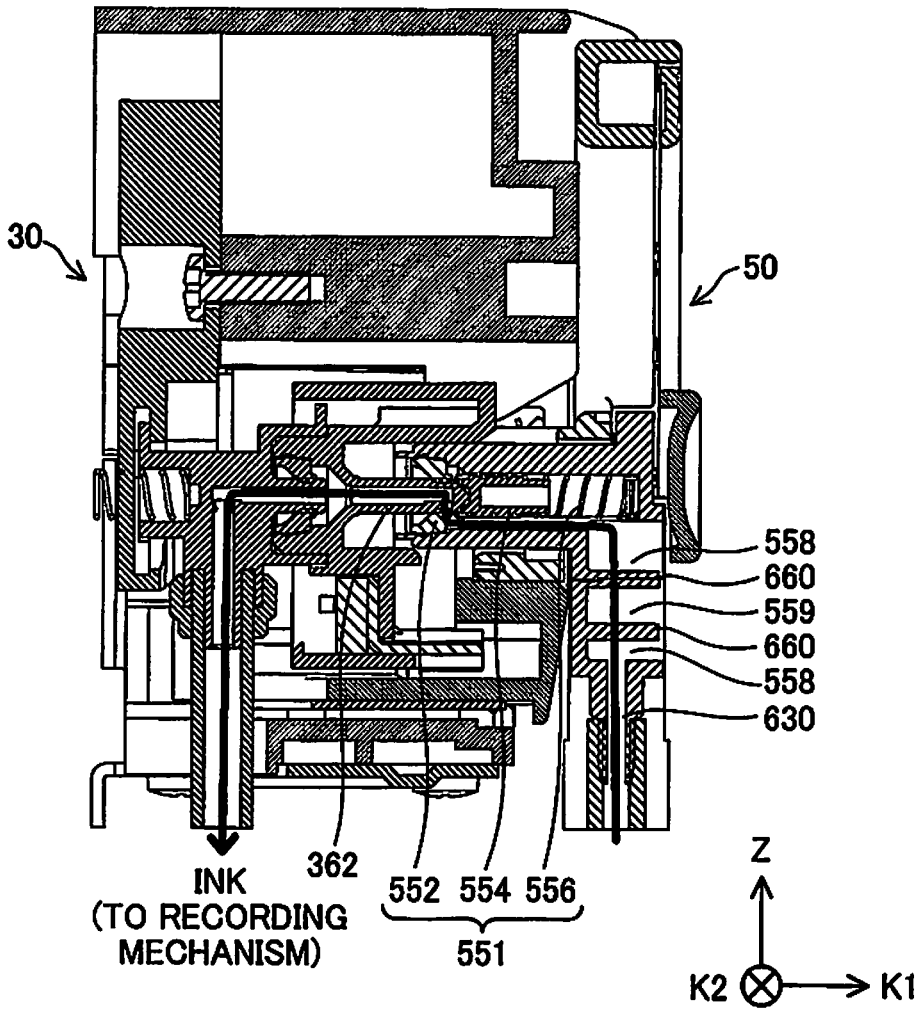
FIG. 24 is a sectional view illustrating a mounting/demounting unit and the liquid container.

FIG. 24 is a sectional view illustrating the state that the liquid container 50 is mounted to the mounting/demounting unit 30. The mounting process will be described in detail later but is briefly described here, since connecting the flow path is common to both the mounting process and the ink injection process. When the liquid container 50 is mounted to the mounting/demounting unit 30, ink is suppliable to the printer 10. Insertion of a liquid introduction portion 362 into the liquid supply tube 57 connects the flow path. The liquid introduction portion 362 is formed in a similar shape to that of the liquid injection member 13 and has an internal flow path communicating with the recording mechanism 11.

After injection of ink, the liquid injection member 13 is pulled out from the liquid supply tube 57 (process P870). The attitude determined at process P840 is maintained at process P870. More specifically, at process P870, the liquid supply tube 57 is protruded in the horizontal direction, and the liquid injection member 13 is pulled out in the horizontal direction. This reduces the likelihood that the liquid container 50 is stained with ink that possibly drips off from the liquid injection member 13 in the process of pulling out the liquid injection member 13 from the liquid supply tube 57.

After the liquid injection member is pulled out, air bubbles are removed from inside of the liquid containing bag 52 (process P880). Air bubbles are removed by discharging a predetermined amount of the ink contained in the liquid containing bag 52 through the liquid supply tube 57 while maintaining the attitude determined at process P840. A syringe (not shown) is used for such removal. The syringe is in a similar shape to that of the liquid injection member 13 and sucks the air bubbles in the state that the syringe is inserted in the liquid supply tube 57. The air bubbles are removed through the second chamber 559 and the bypass 562. The following describes the bypass 562.

Figure 25:
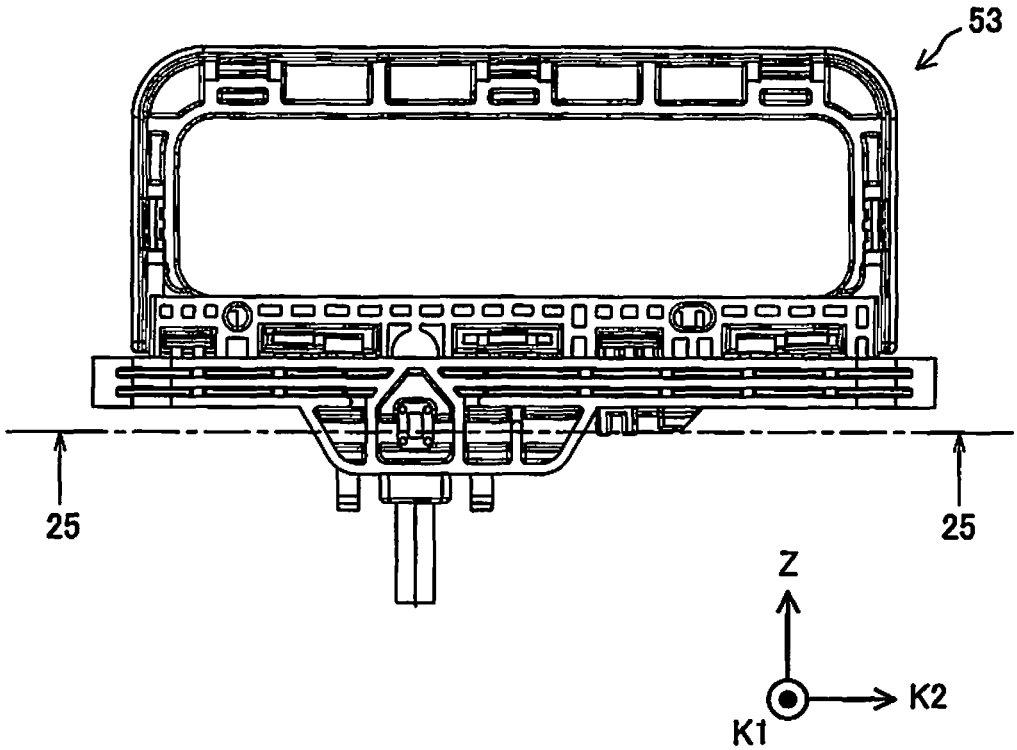
FIG. 25 is a rear view illustrating the state that the linkage member and the liquid supply assembly are assembled.
Figure 26:
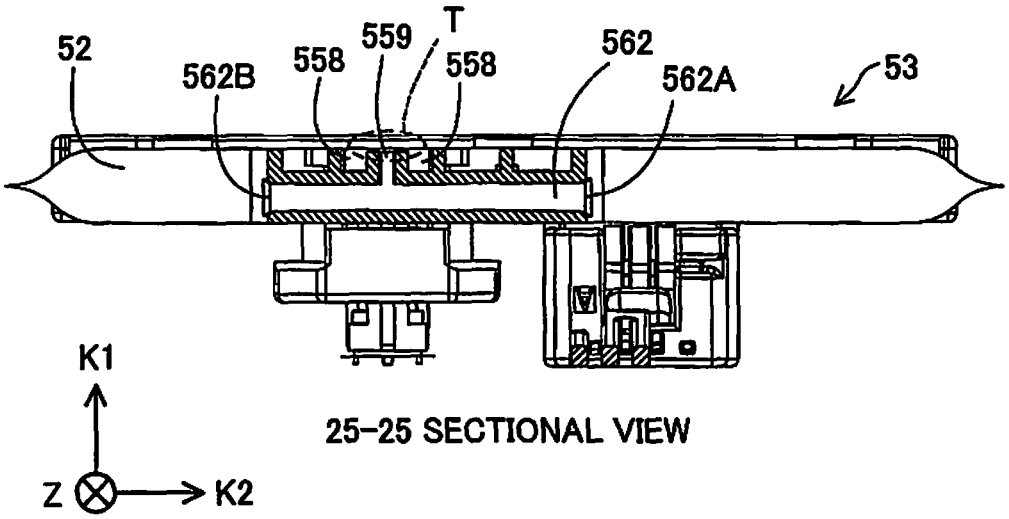
FIG. 26 is a sectional view of FIG. 25.
Figure 27:
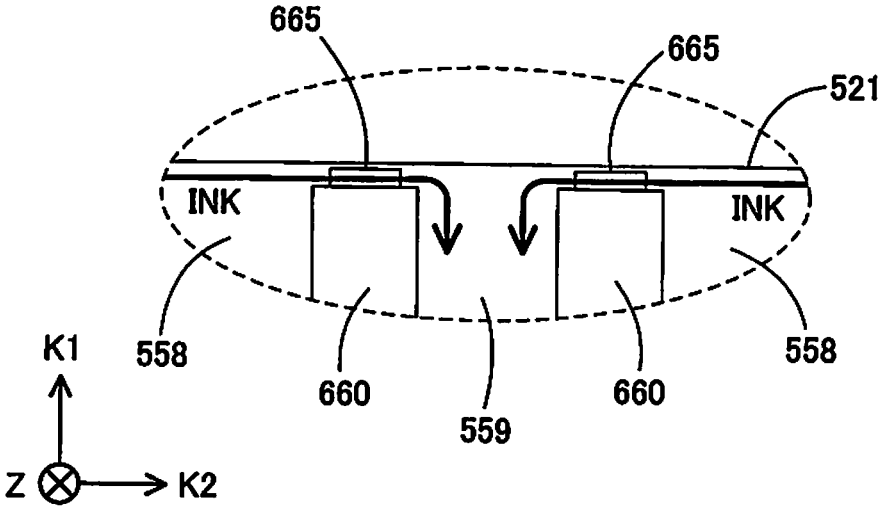
FIG. 27 is an enlarged view of FIG. 26.

FIG. 25 is a rear view illustrating the state that the linkage member 53A and the liquid supply assembly 53B are assembled. FIG. 26 is a 25-25 sectional view of FIG. 25. FIG. 27 is an enlarged view illustrating a region T in FIG. 26. The liquid containing bag 52 shown in FIG. 26 is omitted from the illustration of FIG. 25. The pressing member 53C is also omitted from the illustration of FIG. 25.

As shown in FIG. 26, the bypass 562 has openings 562A and 562B. The openings 562A and 562B are open near the one end 501 of the liquid containing bag 52. The openings 562A and 562B are accordingly located close to the upper end of the liquid containing bag 52.

As shown in FIG. 26, the bypass 562 communicates with the second chamber 559. As shown in FIG. 27, ink is allowed to flow between the first film 521 and the second rib 660 in the state that the second rib 660 is not welded to the first film 521. Accordingly the bypass 562 communicates with the first chamber 558 across the second chamber 559 at process P880.

As shown in FIG. 27, a protrusion 665 is provided on an end face of the second rib 660. The protrusion 665 is configured to provide the flow passage area between the first film 521 and the second rib 660.

The bypass 562 is used for removal of the gas at process P880. More specifically, the air bubbles accumulated near the upper end of the liquid containing bag 52 flow into the openings 562A and 562B and then sequentially pass through the bypass 562, the second chamber 559, the first chamber 558 and the liquid supply tube 57 to be removed.

After removal of the air bubbles, the end face of the second rib 660 is welded to the liquid containing bag 52 (process P890). The protrusion 665 is melted to disappear in the process of welding the second rib 660.

Figure 28:
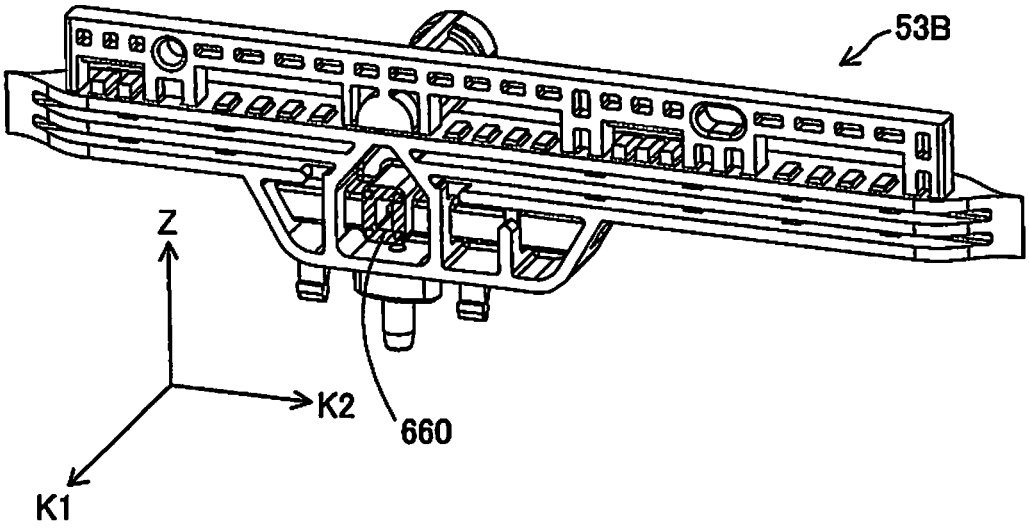
FIG. 28 is a perspective view illustrating the liquid supply assembly.

FIG. 28 is a perspective view illustrating the liquid supply assembly 53B. The end face of the second rib 660 is shown by hatching in FIG. 28. When the end face of the second rib 660 is welded to the liquid containing bag 52, ink is not allowed to flow from the second chamber 559 into the first chamber 558. As a result, ink is supplied from the liquid containing bag 52 to the liquid supply tube 57 through the flow path member 70.

The liquid supply port 572 is lastly sealed with the sealing film 99 (shown in FIG. 12) (process P895). The sealing film 99 prevents ink from leaking out of the liquid supply port 572 before the liquid container 50 is mounted to the mounting/demounting unit 30. Additionally, the sealing film 99 prevents the valve seat 552 and the valve element 554 from being moved in the −K1-axis direction by the biasing force of the spring 556 and dropping out of the liquid supply tube 57. The sealing film 99 is broken by the liquid introduction portion 362 when the liquid container 50 is mounted to the mounting/demounting unit 30.

Figure 33:
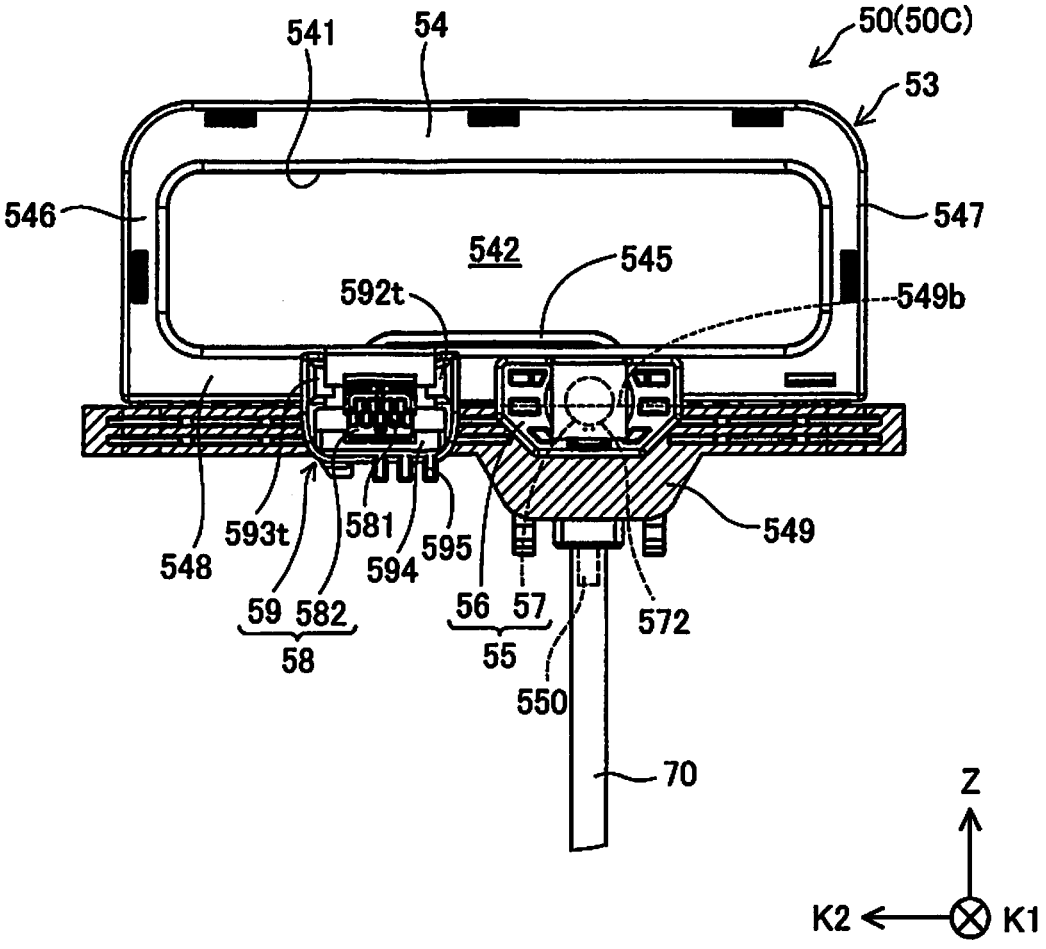
FIG. 33 is a front view illustrating part of the liquid container.
Figure 34:
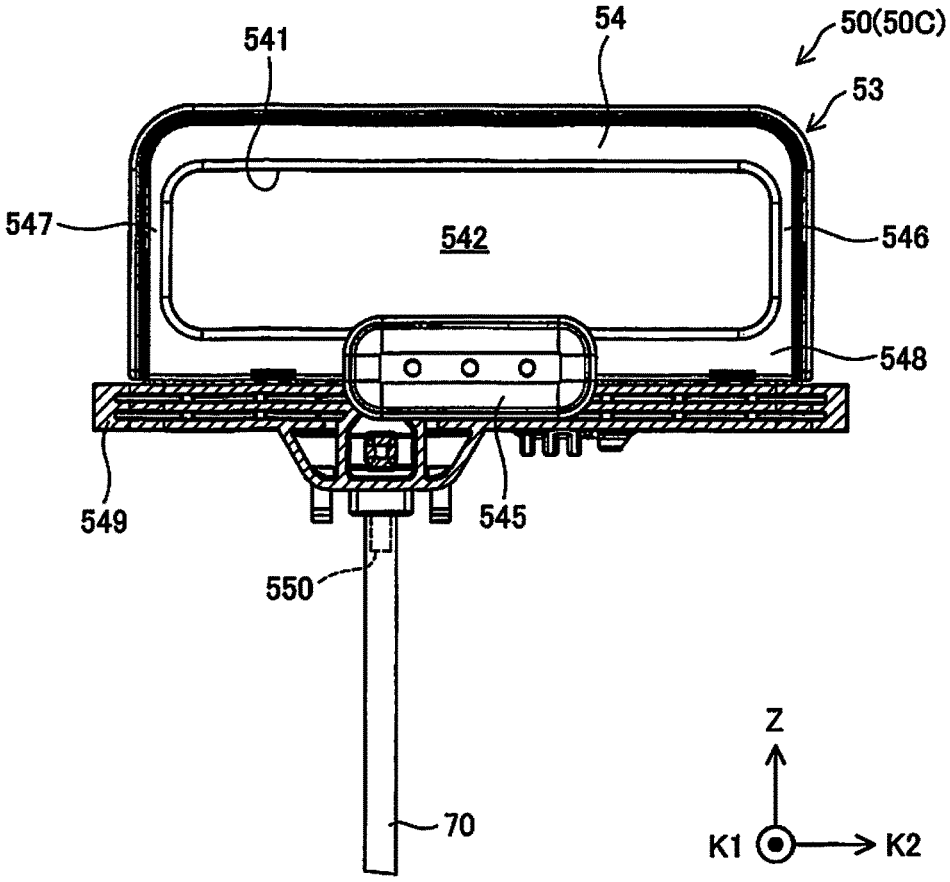
FIG. 34 is a rear view illustrating part of the liquid container.
Figure 35:
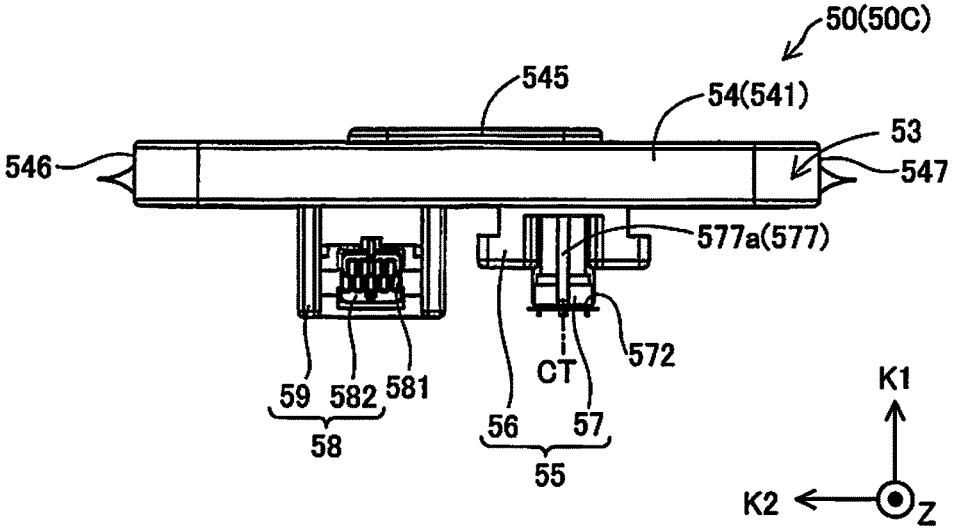
FIG. 35 is a top view illustrating part of the liquid container.
Figure 36:
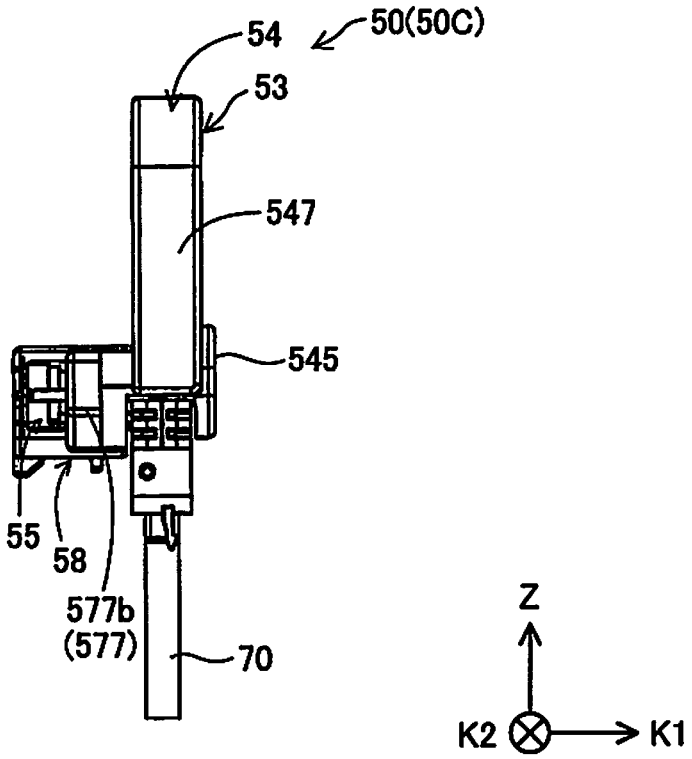
FIG. 36 is a right side view illustrating part of the liquid container.

Configuration of Operation Member 53:

FIG. 29, FIG. 30, FIG. 31 and FIG. 32 are perspective views illustrating part of the liquid container 50. This part excludes part of the flow path member 70 and the liquid containing bag 52. FIG. 33 is a front view illustrating part of the liquid container 50. FIG. 34 is a rear view illustrating part of the liquid container 50. FIG. 35 is a top view illustrating part of the liquid container 50. FIG. 36 is a right side view illustrating part of the liquid container 50.

Figure 29:
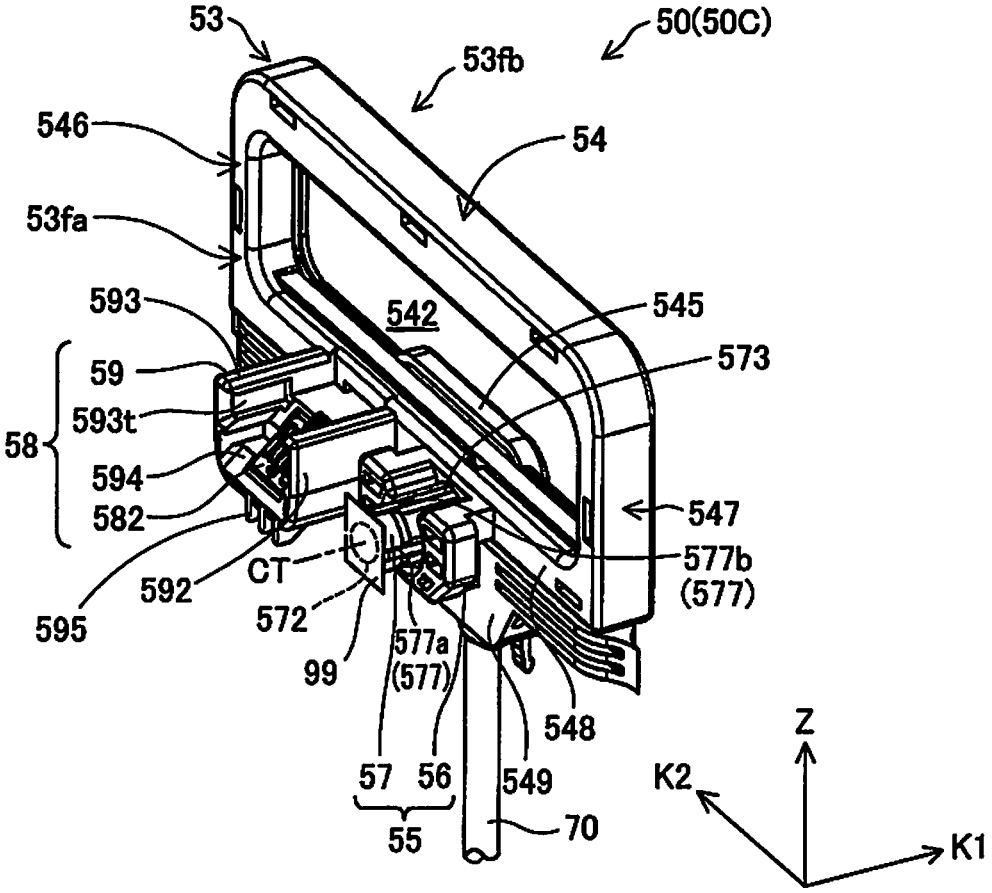
FIG. 29 is a perspective view illustrating part of the liquid container.
Figure 30:
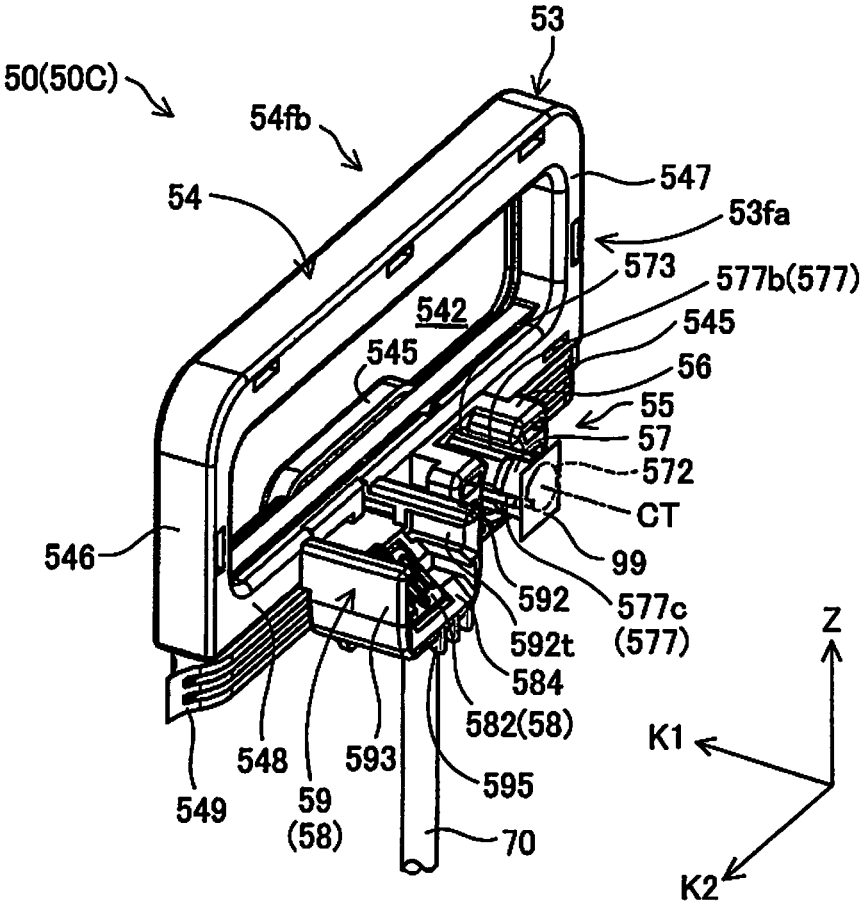
FIG. 30 is a perspective view illustrating part of the liquid container.

As shown in FIGS. 29 and 30, the operation member 53 includes the grip portion 54, a first connecting portion 546, a second connecting portion 547, the base portion 548 and the joint structures 549.

The grip portion 54, the first connecting portion 546, the second connecting portion 547 and the base portion 548 form a frame. This frame defines a receiving space 542. The user's hand is accessible to and insertable in the receiving space 542.

Figure 31:
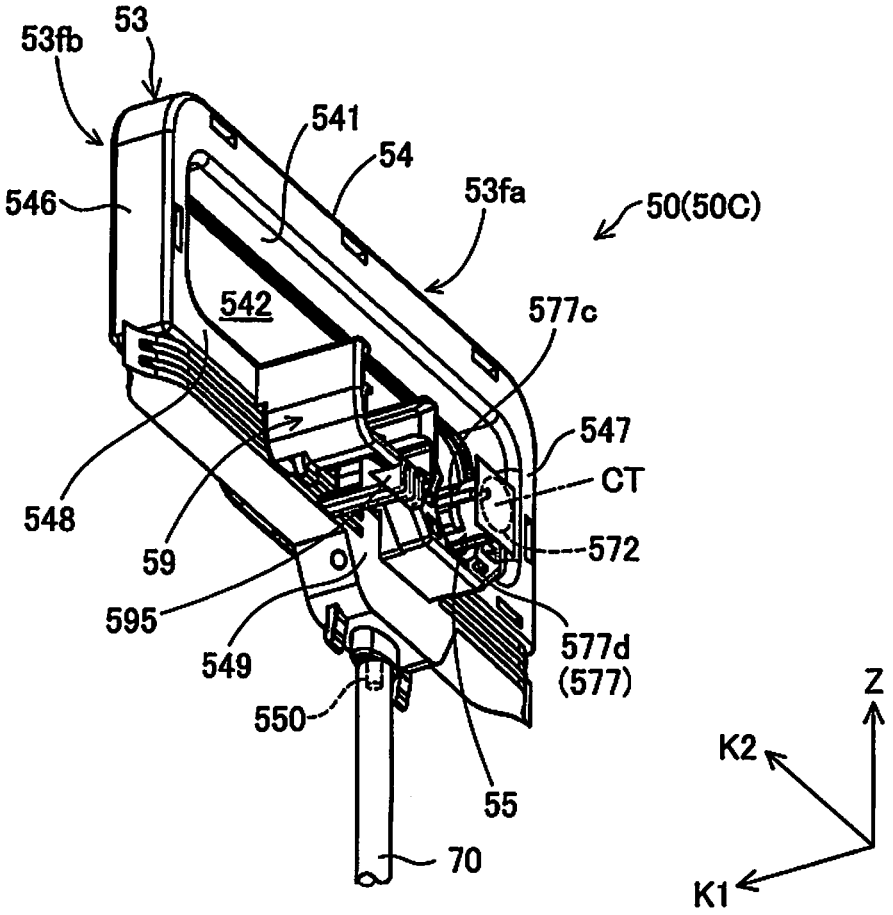
FIG. 31 is a perspective view illustrating part of the liquid container.

The grip portion 54 is a portion held by the user. The grip portion 54 is extended along the K2-axis direction. As shown in FIG. 31, the grip portion 54 has a grip surface 541 that is exposed to the receiving space 542. The grip surface 541 is a part held by the user. The grip surface 541 is approximately horizontal in the mounted state.

As shown in FIG. 29, the first connecting portion 546 is a member extended from one end of the grip portion 54 in the K2-axis direction toward the base portion 548 (in the −Z-axis direction, toward the liquid containing bag 52). The second connecting portion 547 is a member extended from the other end of the grip portion 54 in the K2-axis direction toward the base portion 548 (in the −Z-axis direction, toward the liquid containing bag 52)

The base portion 548 is a portion opposed to the grip portion 54 across the receiving space 542. The base portion 548 is extended along the K2-axis direction. The positioning structure 56, the circuit board holding structure 59 and the pressed portion 545 (shown in FIG. 32) are attached to the base portion 548. Accordingly the liquid supply unit 55 and the circuit board holding structure 59 are linked with each other via the base portion 548. This linkage means that members linked with each other are connected to be movable in conjunction with each other. This configuration enables the operation member 53 and thereby the liquid container 50 to be moved integrally.

The joint structures 549 are located on the opposite side of the grip portion 54 across the base portion 548. The joint structures 549 are provided adjacent to the base portion 548. The joint structures 549 are extended along the K2-axis direction. The joint structures 549 are portions that are to be joined with the one end 501 of the liquid containing bag 52 (shown in FIG. 7) by welding or the like as described above. Joint planes with the liquid containing bag 52 are shown by single hatching in FIGS. 33 and 34.

As shown in FIGS. 29 and 30, the liquid supply unit 55 includes the liquid supply tube 57 and the positioning structure 56. The liquid supply unit 55 is provided to be protruded outward (in the −K1-axis direction) from the operation member 53.

As shown in FIG. 33, the grip surface 541 is located on the +Z-axis direction side of the liquid supply tube 57. As shown in FIG. 35, the liquid supply port 572 is arranged to be offset relative to the grip portion 54 in the −K1-axis direction. In other words, the liquid supply port 572 does not overlap the grip surface 541 when the liquid container 50 is viewed in a direction that is orthogonal to the grip surface 541 and is from the grip surface 541 toward the liquid supply tube 57 (−Z-axis direction). Accordingly the grip surface 541 and the liquid supply port 572 do not overlap each other in projection of the liquid container 50 onto a plane perpendicular to the grip surface 541. As shown in FIG. 33, the liquid supply tube 57 is provided to partly overlap the joint structure 549*b* when viewed along the K1-axis direction from the liquid supply port 572-side. In other words, the liquid supply port 572 is provided to at least partly overlap the joint structure 549*b* when viewed along the K1-axis direction from the liquid supply port 572-side.

The positioning structure 56 roughly positions the liquid container 50 including the liquid supply port 572 relative to the printer 10 in the process of connecting the liquid container 50 with the printer 10. The positioning structure 56 is integrally provided with the linkage member 53A. In Embodiment 1, the positioning structure 56 is integrally molded with the linkage member 53A so as to be integrally provided with the linkage member 53A.

As shown in FIGS. 29 and 30, the positioning structure 56 is placed around the liquid supply tube 57 about the center axis CT. The center axis CT represents a virtual center axis line of the liquid supply tube 57. The center axis CT is parallel to the K1-axis direction. The positioning structure 56 is, however, placed around the liquid supply tube 57 except the grip portion 54-side. The positioning structure 56 is placed on the inner side of a supply assembly support structure 42 (shown in FIGS. 37 to 43) of the mounting/demounting unit 30 when the liquid container 50 is connected with the mounting/demounting unit 30.

As shown in FIGS. 29 and 30, the substrate unit 58 includes the circuit board 582 and the circuit board holding structure 59. The substrate unit 58 is provided to be protruded outward (in the −K1-axis direction) from the operation member 53. The direction of protrusion of the substrate unit 58 is identical with the direction of protrusion of the liquid supply tube 57 (−K1-axis direction). The direction of protrusion of the substrate unit 58 and the direction of protrusion of the liquid supply tube 57 may, however, be not necessarily identical with each other but may be approximately parallel to each other. The substrate unit 58 and the liquid supply tube 57 are protruded from the operation member 53 in the same direction (−K1-axis direction) relative to the operation member 53.

As shown in FIG. 35, the substrate unit 58 is provided to be arrayed with the liquid supply unit 55 in a direction parallel to the grip surface 541. More specifically, the substrate unit 58 and the liquid supply unit 55 are provided to be arrayed in a direction that is parallel to the grip surface 541 and is orthogonal to the center axis CT (K2-axis direction).

As shown in FIG. 29, the circuit board holding structure 59 positions the circuit board 582 relative to the mounting/demounting unit 30 in the process of connecting the liquid container 50 with the mounting/demounting unit 30. The circuit board holding structure 59 is integrally provided with the operation member 53. In Embodiment 1, the circuit board holding structure 59 is integrally molded as part of the linkage member 53A so as to be integrally provided with the linkage member 53A.

The circuit board holding structure 59 has a recessed shape. This recessed shape means that the rough outline looks like a U shape in the front view as shown in FIG. 21. A bottom 594 corresponding to the recess of the U shape is inclined relative to the grip surface 541. The circuit board 582 is mounted on the bottom 594 and is accordingly held to be inclined to the circuit board holding structure 59.

The circuit board holding structure 59 has a first side wall portion 591 and a second side wall portion 593 extended in the +Z-axis direction from respective sides in the K2-axis direction of the bottom 594. As shown in FIG. 30, the first side wall portion 592 has a groove 592*t*. As shown in FIG. 29, the second side wall portion 593 has a groove 593*t*. The grooves 592*t* and 593*t* are used for positioning the circuit board holding structure 59.

As shown in FIG. 33, the circuit board 582 has a plurality of terminals 581 on the surface. In Embodiment 1, nine terminals 581 are provided corresponding to the number of (nine) apparatus-side terminals 381. In Embodiment 1, the terminal 581 has an approximately rectangular outer shape. The storage device 583 (shown in FIG. 13) is placed on the rear face of the circuit board 582. The storage device 583 stores information regarding the liquid container 50 (for example, the color of ink and the date of manufacture). The storage device 583 is electrically connected with the plurality of terminals 581. In the mounted state, the plurality of terminals 581 are electrically connected with the respective corresponding apparatus-side terminals 381 of the printer 10 (shown in FIGS. 37 to 42).

As shown in FIG. 35, the grip surface 541 is arranged on a side of the direction perpendicular to the center axis CT direction of the liquid supply tube 57 (+Z-axis direction). The substrate unit 58 is provided to be offset in the center axis CT direction relative to the operation member 53 including the grip surface 541. In other words, the substrate unit 58 is arranged at such a position that does not overlap the grip surface 541 (operation member 53) when the liquid container 50 is viewed in a direction that is orthogonal to the grip surface 541 and is from the grip surface 541 toward the liquid supply tube 57 (−Z-axis direction). Accordingly the grip surface 541 and the substrate unit 58 are in the positional relationship not to overlap each other in projection of the liquid container 50 onto a plane perpendicular to the grip surface 541.

Figure 32:
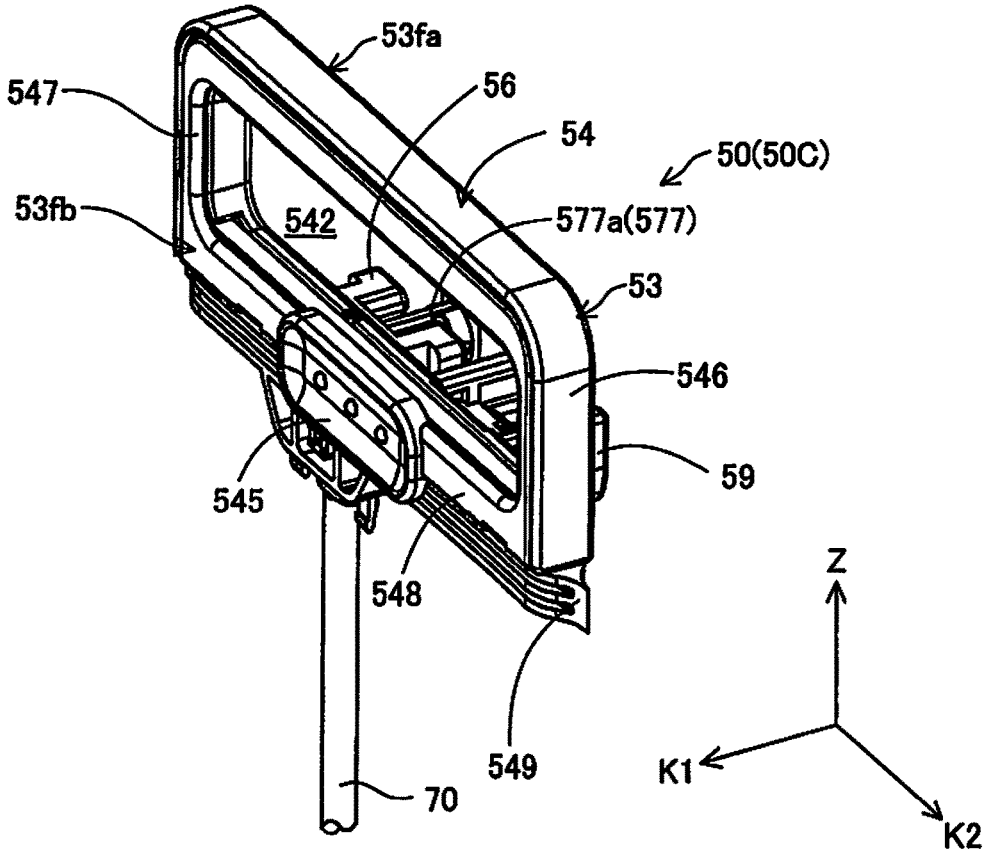
FIG. 32 is a perspective view illustrating part of the liquid container.

As shown in FIGS. 31 and 32, the circuit board holding structure 59 and the positioning structure 56 are provided on the same side, i.e., on the first side 53*fa*.

While the positioning structure 56 and the circuit board holding structure 59 are provided on the surface of the first side 53*fa* as shown in FIG. 31, the pressed portion 545 is provided on the surface of the second side 53*fb* as shown in FIG. 32.

The pressed portion 545 is a portion pressed by the user in the process of connecting the liquid container 50 with the printer 10. The user presses the pressed portion 545 in the −K1-axis direction, so as to move the movable member 40 (shown in FIGS. 37 to 42) with the liquid container 50 set thereon in the −K1-axis direction.

The pressed portion 545 is provided to be protruded outward (in the +K1-axis direction) from the operation member 53. This configuration facilitates discrimination of the pressed portion 545 from the remaining part. As a result, the user is encouraged to press the pressed portion 545 in the process of connecting the liquid container 50 with the printer 10.

As shown in FIG. 34, part of the outer shape of the pressed portion 545 is protruded outside of the base portion 548 in the Z-axis direction when the operation member 53 is viewed in a direction along the K1-axis direction. The pressed portion 545 is set to have a large area and can thus be readily pressed.

As shown in FIGS. 29 to 33, identification ribs 595 are provided in a lower portion of the circuit board holding structure 59. The identification ribs 595 are in a different configuration corresponding to each color of ink contained. The mounting/demounting unit 30 has engagement grooves 596 (shown in FIG. 40) arranged to receive only the liquid container 50 of the correct color of ink.

Figure 37:
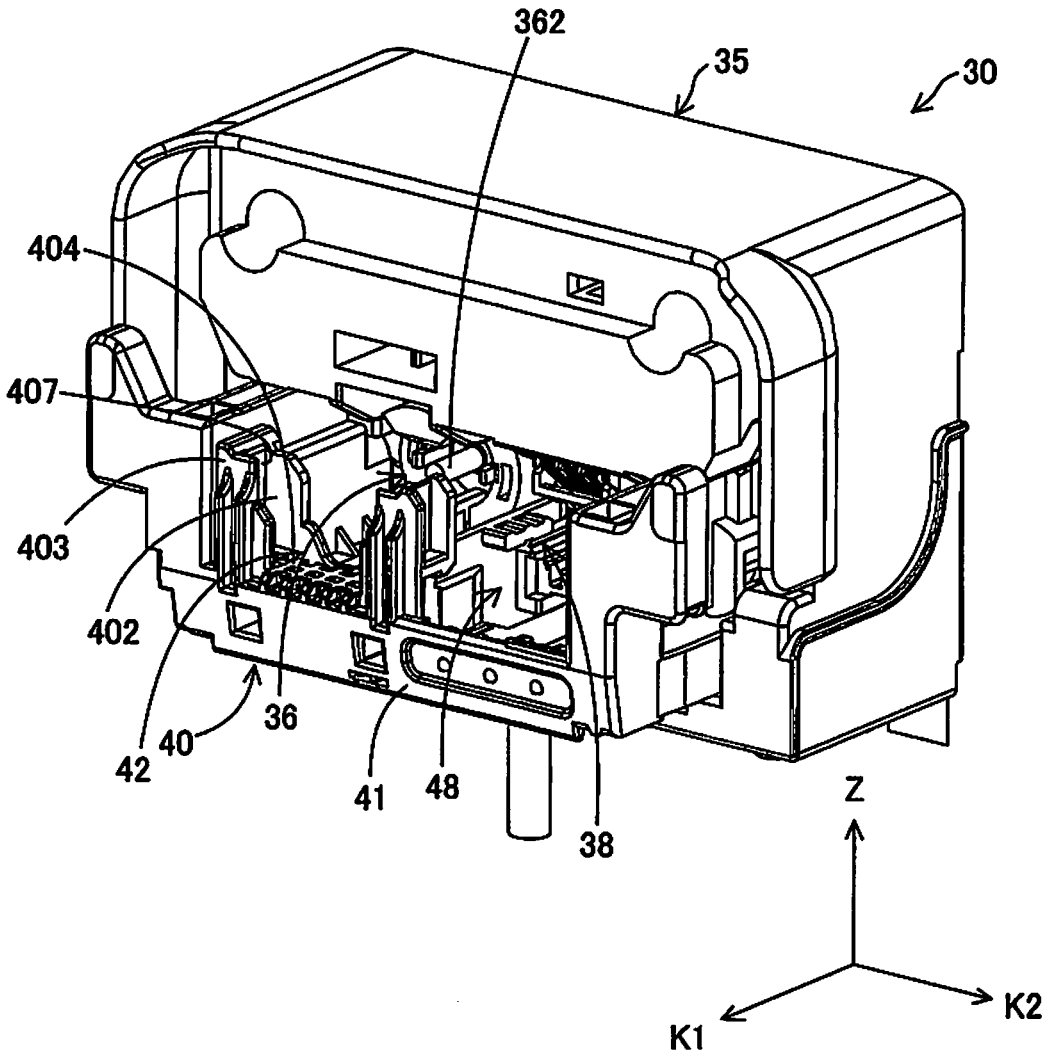
FIG. 37 is a perspective view illustrating the mounting/demounting unit.
Figure 38:
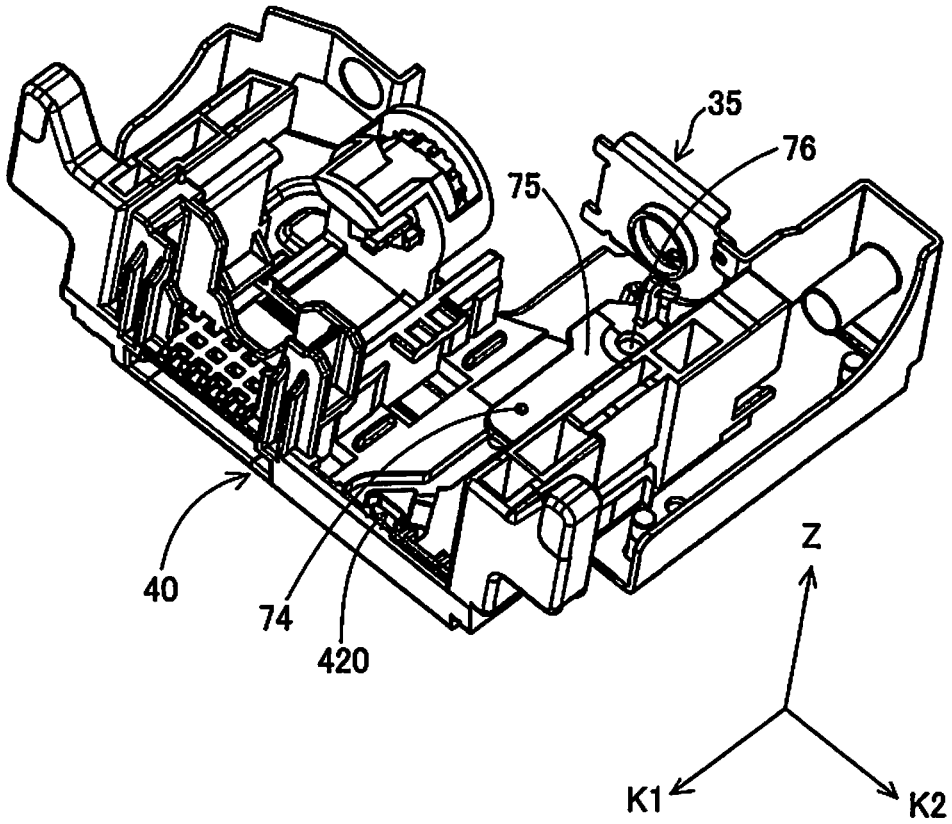
FIG. 38 is a perspective view illustrating the mounting/demounting unit.
Figure 39:
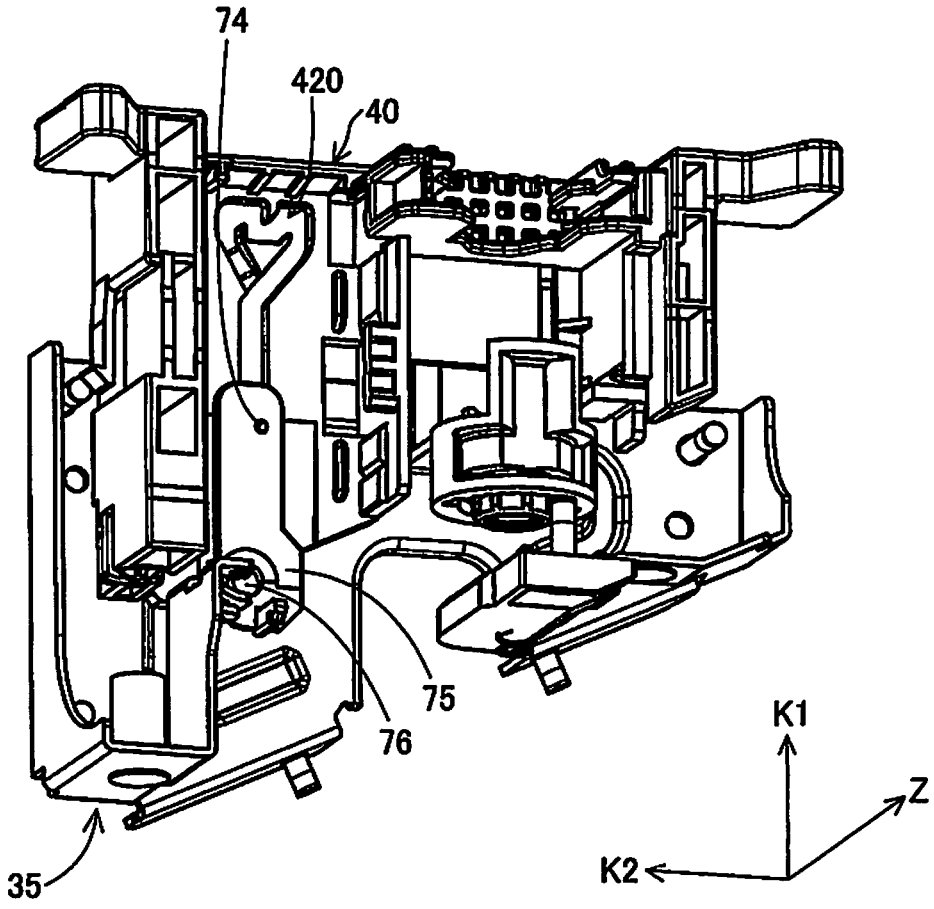
FIG. 39 is a perspective view illustrating the mounting/demounting unit.
Figure 40:
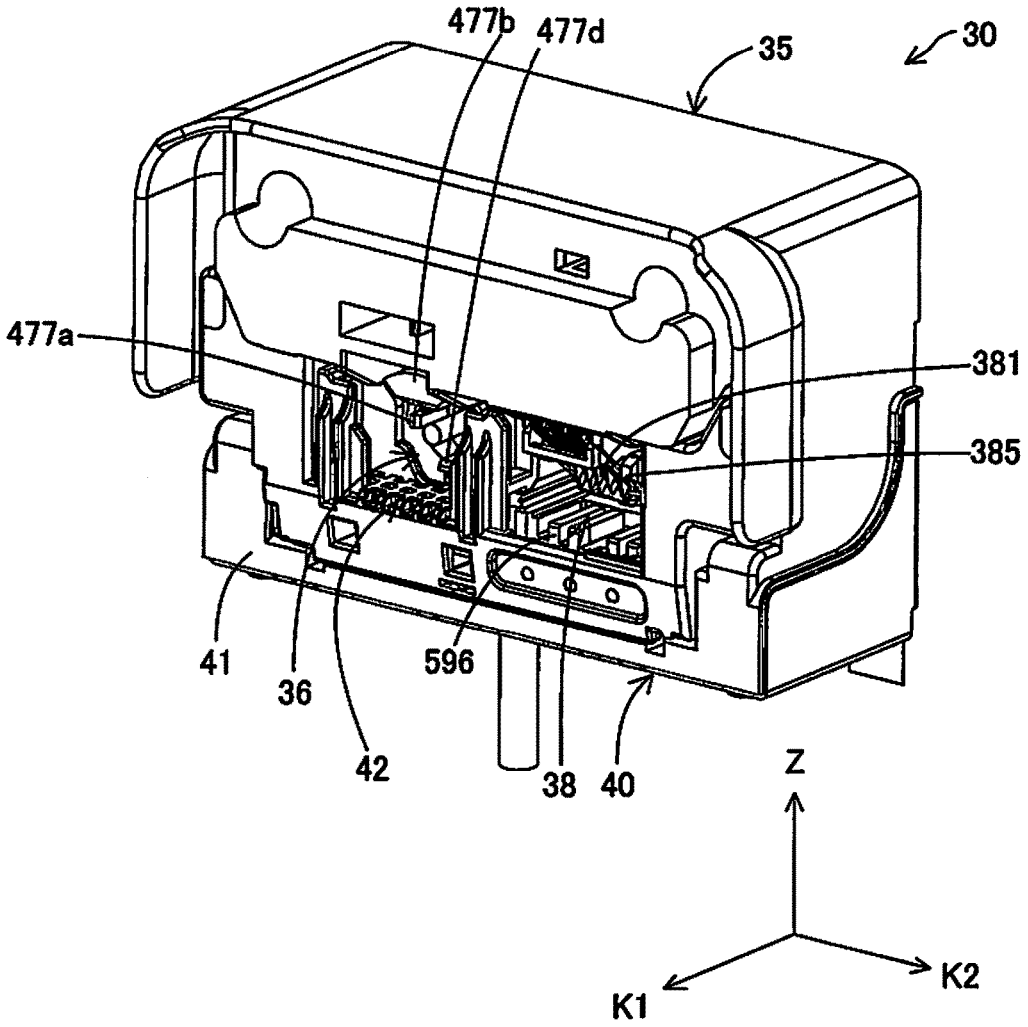
FIG. 40 is a perspective view illustrating the mounting/demounting unit.

Configuration of Mounting/Demounting Unit 30:

FIGS. 37 to 42 are perspective views illustrating the mounting/demounting unit 30. Part of a stationary member 35 is omitted from the illustration of FIGS. 38, 39, 41 and 42. As shown in FIG. 37 and FIG. 40, the mounting/demounting unit 30 includes a stationary member 35 and a movable member 40. FIGS. 37 to 39 are perspective views illustrating the mounting/demounting unit 30 and illustrate the state that the movable member 40 is protruded outward relative to the stationary member 35. The state that the liquid container 50 is set on the movable member 40 in this protruded condition is called "set state". The "set state" denotes a state that the positioning structure 56 and the circuit board holding structure 59 are engaged with the movable member 40.

Figure 41:
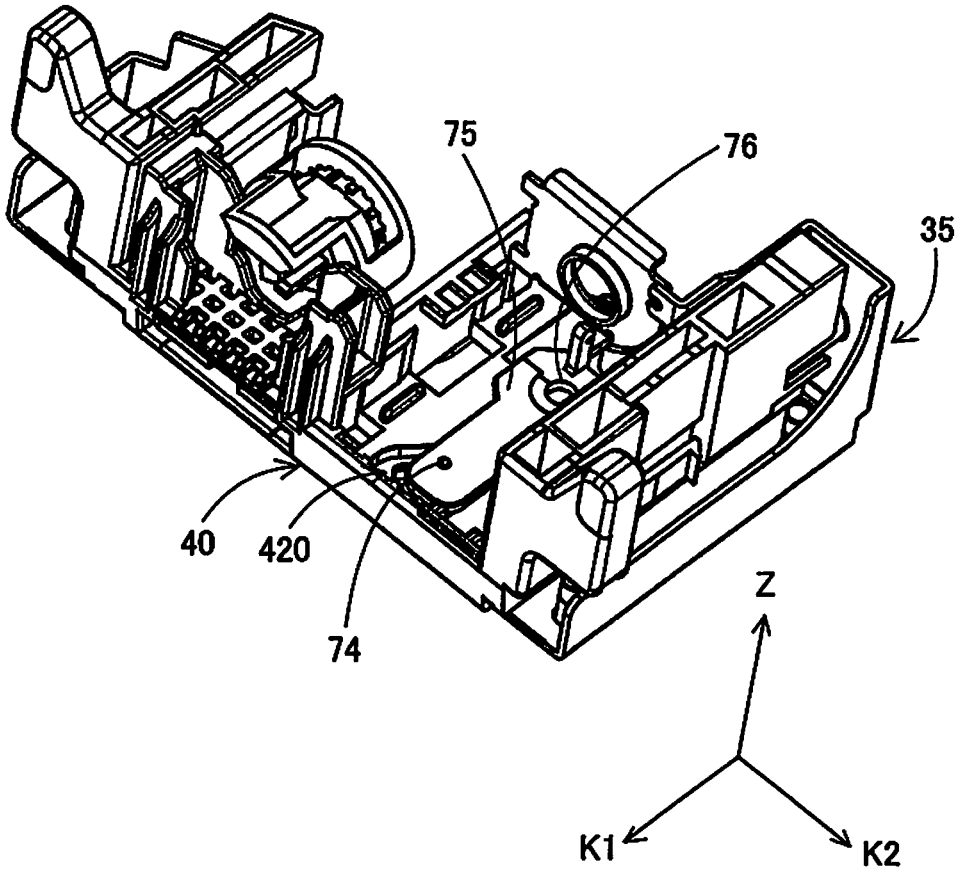
FIG. 41 is a perspective view illustrating the mounting/demounting unit.
Figure 42:
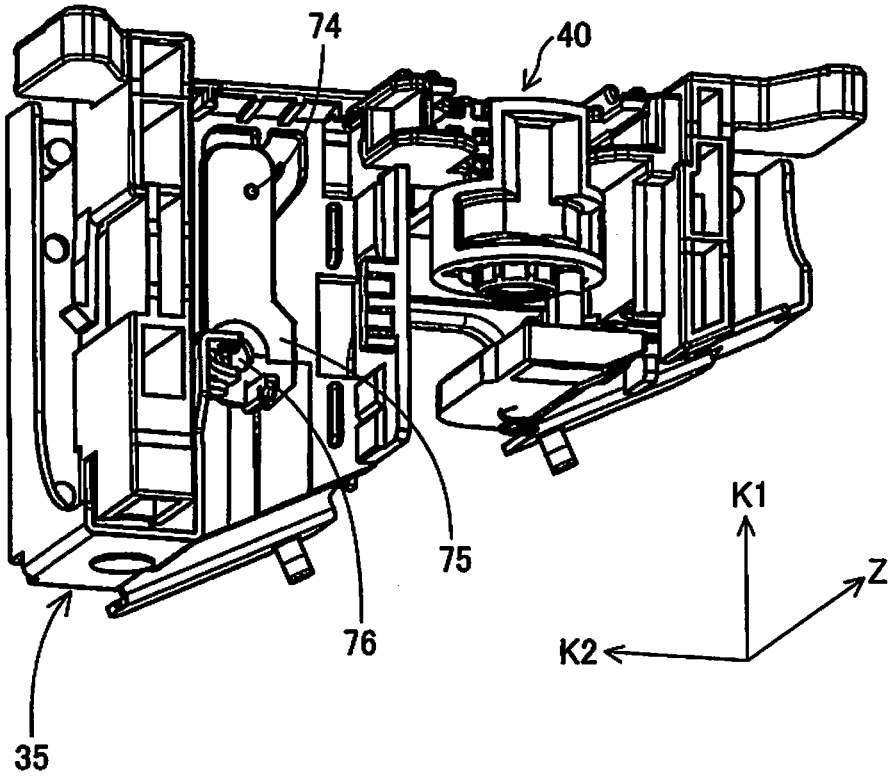
FIG. 42 is a perspective view illustrating the mounting/demounting unit.

FIGS. 40 to 42 are perspective views illustrating the mounting/demounting unit 30 and illustrate the state that the movable member 40 is placed in the stationary member 35. This state shifted from the set state is called mounted state.

The movable member 40 is colored in the corresponding color of ink. The corresponding color of ink denotes the same type of color as the color of ink contained in a correct liquid container to be connected among the liquid containers 50K, 50C, 50M and 50Y.

The stationary member 35 includes a liquid introduction mechanism 36 and a contact mechanism 38. The liquid introduction mechanism 36 and the contact mechanism 38 are arrayed along the K2-axis direction. The liquid introduction mechanism 36 includes a liquid introduction portion 362.

The movable member 40 is configured to be movable along the K1-axis direction relative to the stationary member 35. The movable member 40 includes a base portion 41, a supply assembly support structure 42 and a board support structure 48. The supply assembly support structure 42 and the board support structure 48 are respectively connected with the base portion 41. The supply assembly support structure 42 and the board support structure 48 are members provided on the +Z-axis direction side of the base portion 41.

As shown in FIG. 40, the contact mechanism 38 includes a plurality of (nine in Embodiment 1) apparatus-side terminals 381 and a plurality of (two in Embodiment 1) board positioning structures 385. In the mounted state of the liquid container 50, the apparatus-side terminals 381 are electrically connected with the circuit board 582 of the liquid container 50. This connection enables various pieces of information (for example, the color of ink and the date of manufacture of the liquid container 50) to be sent and received between the circuit board 582 and the printer 10. The apparatus-side terminal 381 is formed from a leaf spring.

The board positioning structures 385 are arranged on respective sides in the K2-axis direction (the direction in which the liquid introduction mechanism 36 and the contact mechanism 38 are arrayed) (only one is shown in FIG. 40). The board positioning structures 385 determine the final position of the circuit board of the liquid container 50 relative to the apparatus-side terminals 381 when the liquid container 50 is mounted to the mounting/demounting unit 30. The board positioning structures 385 are members extended along the K1-axis direction.

The supply assembly support structure 42 is a member configured to roughly position the liquid container 50 relative to the liquid introduction portion 362. When the mounting/demounting unit 30 is viewed along the K1-axis direction, the supply assembly support structure 42 is provided at a position overlapping the liquid introduction portion 362.

The supply assembly support structure 42 is provided to form a recessed shape. This recessed shape means that the rough outline looks like a U shape in the front view. The front denotes a surface specified by the +Z-axis direction as upward and the −K1-axis direction as rearward. The supply assembly support structure 42 has grooves 407 formed on respective sides in the K2-axis direction. Downward insertion of the positioning structure 56 (shown in FIGS. 29 to 31) described above into the grooves 407 restricts the motion of the liquid supply tube 57. More specifically, the motion of the liquid supply tube 57 is restricted by a plurality of surfaces defining and forming the supply assembly support structure 42 (for example, a first support surface 402, a second support surface 403 and a third support surface 403). This results in roughly positioning the liquid container 50 relative to the mounting/demounting unit 50.

The positioning structure 56 is located inside of the supply assembly support structure 42 when the liquid container 50 is connected with the printer 10. This configuration causes the positioning structure 56 to abut on the plurality of surfaces defining and forming the supply assembly support structure 42 (the first support surface 402, the second support surface 403 and the third support surface 404 shown in FIG. 37) in the set state. This results in restricting the motion of the liquid supply tube 57 and thereby roughly positions the liquid container 50 with respect to the K2-Z plane. Such abutting may determine the position with regard to parallel displacement (translation) in the K2-Z plane but may not determine the position with regard to rotation in the K2-Z plane.

The board support structure 48 is a member configured to determine the position of the circuit board 582 relative to the contact mechanism 38. When the mounting/demounting unit 30 is viewed along the K1-axis direction, the board support structure 48 is provided at a position overlapping the contact mechanism 38. The board support structure 48 is provided to form a recessed shape like the supply assembly support structure 42. The motion of the circuit board of the liquid container 50 is restricted by a plurality of surfaces defining and forming the board support structure 48 (for example, a first board support surface 482).

When the liquid container 50 is newly mounted to the mounting/demounting unit 30, the circuit board holding structure 59 is supported by the board support structure 48 (shown in FIG. 37). This configuration causes the circuit board holding structure 59 and the circuit board 582 to be roughly positioned relative to the apparatus-side terminals 381 (shown in FIG. 46) with respect to the K2-Z plane. Moving the movable member 40 in the −K1-axis direction causes one board positioning structure 385 (shown in FIG. 40) to enter the groove 593*t* of the circuit board holding structure 59 (shown in FIG. 29), while causing the other board positioning structure 385 (not shown) to enter the groove 592*t* of the circuit board holding structure 59 (shown in FIG. 30). This positions the circuit board holding structure 59 and the circuit board 582 relative to the apparatus-side terminals 381.

In the mounted state, the liquid supply port 572 is positioned by projections 577 provided on the liquid supply tube 57 (577*a*, 577*b*, 577*c* and 577*d* shown in FIGS. 29 to 31) abutting on positioning projections 477 provided on the stationary member 35 (477*a*, 477*b*, 477*c* and 477*d* shown in FIG. 40) and is connected with the liquid introduction portion 362. The liquid introduction portion 362 includes a flow path formed therein, like the liquid injection member 13. Ink is supplied through this flow path to the printer 10.

As shown in FIGS. 38, 39, 41 and 42, the movable member 40 includes a heart-shaped cam 420, and the mounting/demounting unit 30 includes a follower 75. The follower 75 has an engagement projection 74. The engagement projection 74 is a member protruded in the −Z-axis direction. An engagement portion of the engagement projection 74 with the follower 75 on the +Z-axis direction side is shown in FIGS. 38, 39, 41 and 42. The follower 75 is a member linked with the stationary member 35 via a connecting structure 76. The follower 75 is engaged with the movable member 40 by engagement of the engagement projection 74 with the heart-shaped cam 420.

Figure 43:
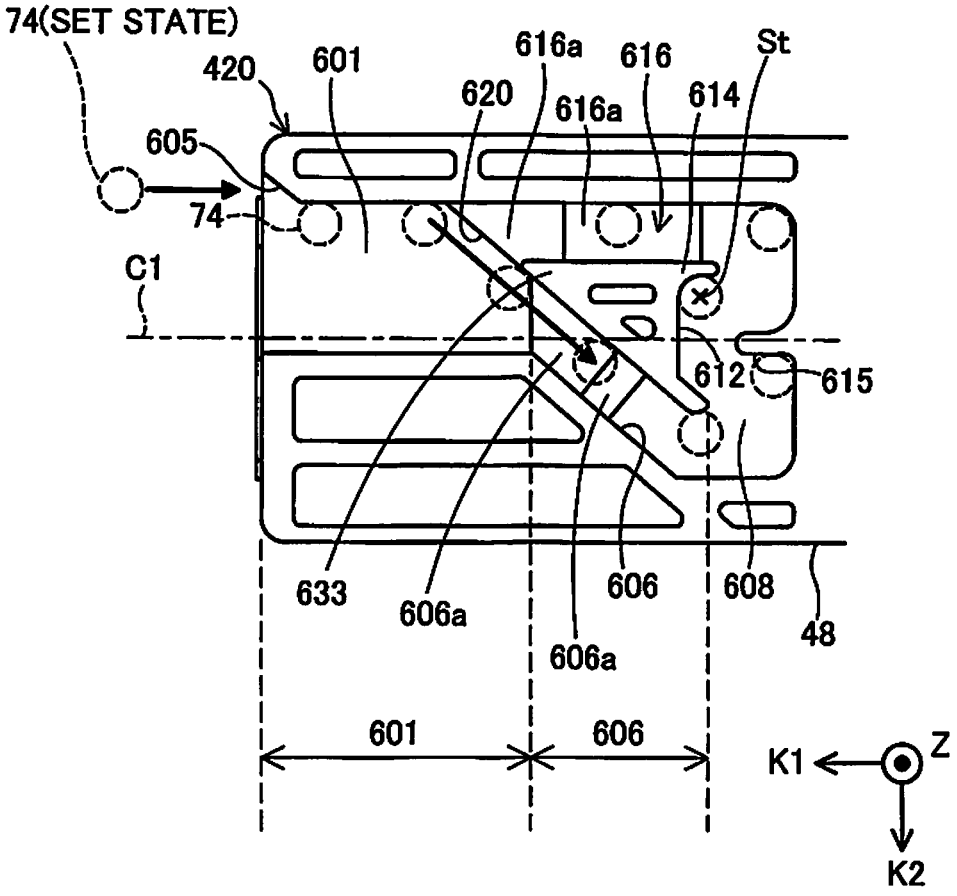
FIG. 43 is a diagram illustrating holding and shifting in respective states.

FIG. 43 is a diagram illustrating holding and shifting in the respective states. The respective states mean the set state and the mounted state described above. In the description below, a shift from the set state to the mounted state is called "mounting operation", and a shift from the mounted state to the set state is called "demounting operation".

FIG. 43 schematically illustrates the heart-shaped cam 420. As shown in FIG. 43, the heart-shaped cam 420 includes a receiving portion 601, a guiding portion 606, a connecting portion 608, an engaging portion 612 and an outlet portion 616.

During the mounting operation, the engagement projection 74 moves in the sequence of the receiving portion 601, the guiding portion 606, the connecting portion 608 and the engaging portion 612. In the mounted state, the engagement projection 74 is engaged with the engaging portion 612 at a predetermined engagement position St of the engaging portion 612. During the demounting operation, the engagement projection 74 moves in the sequence of the engaging portion 612, the outlet portion 616 and the receiving portion 601.

The receiving portion 601 forms an opening 605 and receives the engagement projection 74 through the opening 605. The receiving portion 601 is made deeper than the other portions 606, 608, 612 and 616 of the heart-shaped cam 420. The term "deeper" means located on the −Z-axis direction side.

The guiding portion 606 is a portion serving to guide the engagement projection 74 to the engagement position St (to the location where the engaging portion 612 is formed). The guiding portion 606 is connected with the receiving portion 601. The guiding portion 606 guides the engagement projection 74 obliquely to the moving direction of the movable member 40 (−K1-axis direction). The guiding portion 606 includes an inclined portion 606*a*. The groove of the inclined portion 606*a* becomes shallower with an increase in distance from the receiving portion 601. There is no step at the boundary between the guiding portion 606 and the receiving portion 601.

The connecting portion 608 is arranged to connect the guiding portion 606 with the engaging portion 612. The connecting portion 608 includes a protruded wall 615. The protruded wall 615 is protruded toward the +K1-axis direction from a wall that forms a dead end in the −K1-axis direction.

The engaging portion 612 is opposed to the protruded wall 615. The engaging portion 612 includes an engagement wall 614. The engagement wall 614 is formed by a wall portion 633. The wall portion 633 is one of a plurality of wall portions defining and forming the groove of the heart-shaped cam 420. The outlet portion 616 is arranged to connect the engaging portion 612 with the receiving portion 601. The outlet portion 616 includes an inclined portion 616*a*. The groove of the inclined portion 616*a* becomes deeper with a decrease in distance from the receiving portion 601. There is a step 620 at the boundary between the outlet portion 616 and the receiving portion 601.

The motion of the engagement projection 74 in the heart-shaped cam 420 is described with reference to FIG. 43. FIG. 43 shows the motion of the engagement projection 74 relative to the movable member 40. In the actual state, the movable member 40 moves in the K1-axis direction relative to the stationary member 35, and the engagement projection 74 rotates about the connecting structure 76.

The movable member 40 constantly receives a force in the +K1-axis direction from the stationary member 35 by means of the elastic force of an elastic body such as a spring (not shown). The connecting structure 76 constantly applies a torque to the follower 75, while connecting the follower 75 to be rotatable. This axis of rotation is the Z axis passing through the connecting structure 76. The direction of the torque generated by the connecting structure 76 is the direction of rotating a right-hand screw when moving in the +Z-axis direction.

The engagement projection 74 moves from the receiving portion 601 along the step 620 to the guiding portion 606 during the mounting operation. The engagement projection 74 then reaches the connecting portion 608 by pressing the movable member 40 in the mounting direction (−K1-axis direction) against the elastic force described above. The engagement projection 74 reaching the connecting portion 608 is subsequently moved in a direction including a −K2-axis direction component by the torque described above. The engagement projection 74 then comes into collision with the protruded wall 615 and stops. This produces a click. The click informs the user of no need for further pressing.

When the user stops pressing in the mounting direction, the movable member 40 is pressed back in the demounting direction (+K1-axis direction) by the elastic force described above. This releases the engagement by the protruded wall 615 and causes the engagement projection 74 to reach the engaging portion 612. The engagement projection 74 then comes into collision with the engagement wall 614 by the torque described above. This collision produces a click. The click informs the user of completion of the mounting operation.

The demounting operation is performed by the following procedure. When the user presses in the movable member 40 in the mounting direction, the engagement projection 74 separates from the engagement wall 614. This causes the movable member 40 to move in the −K2-axis direction by the torque described above and releases the engagement. The engagement projection 74 then comes into collision with the wall. This collision produces a click. The click informs the user of no need for further pressing.

When the user stops pressing in the mounting direction in the disengaged state, the movable member 40 is moved in the demounting direction by the elastic force described above, and the engagement projection 74 passes through the outlet portion 616 and reaches the receiving portion 601. This results in completing the demounting operation.

Figure 44:
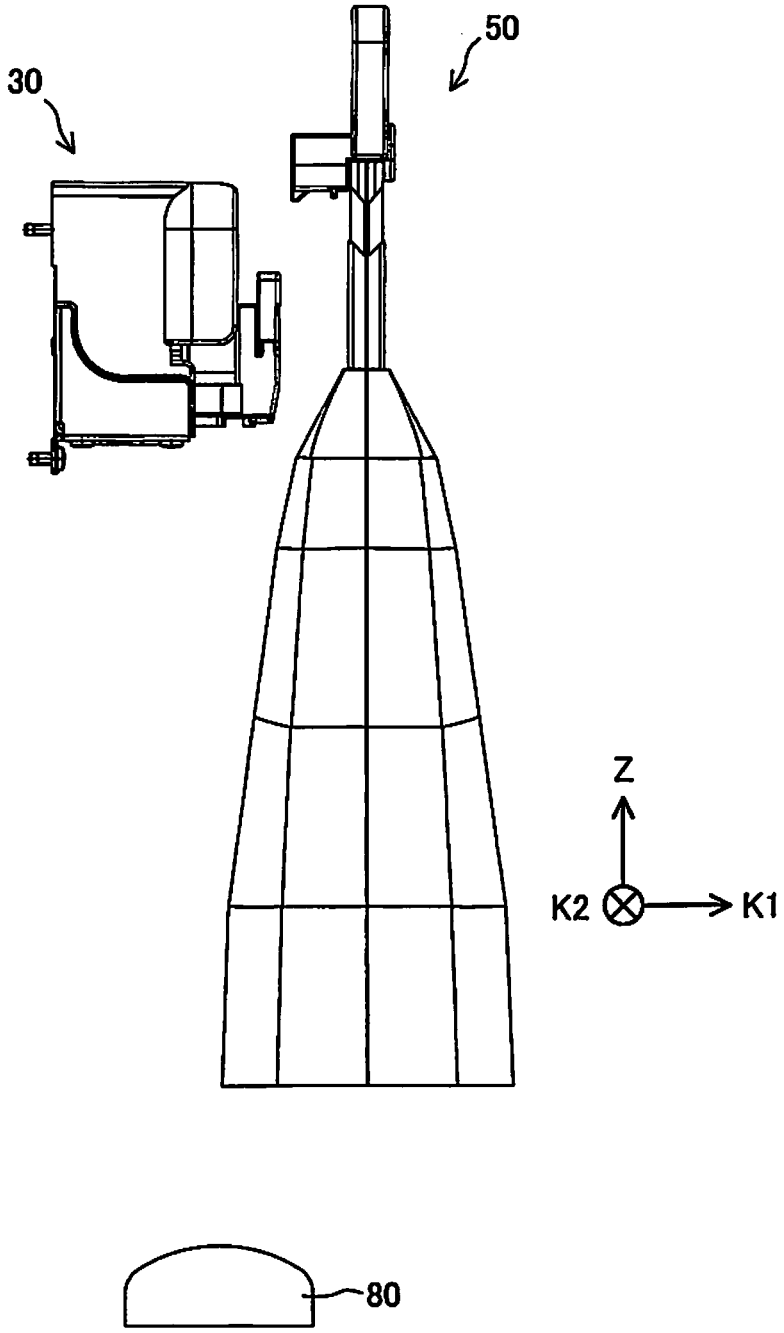
FIG. 44 is a side view illustrating the mounting/demounting unit, the liquid container and an abutment structure (in the non-contact state)
Figure 45:
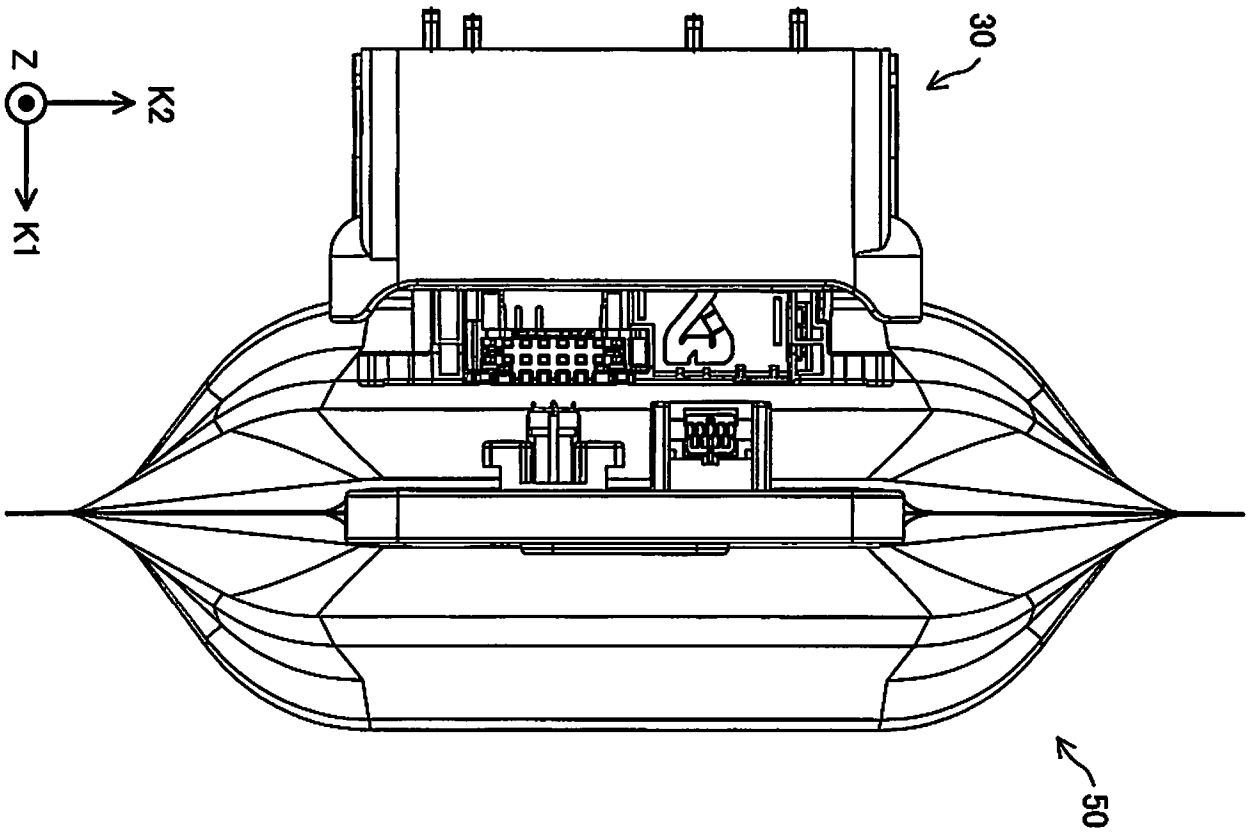
FIG. 45 is a top view illustrating the mounting/demounting unit and the liquid container (in the non-contact state)
Figure 46:
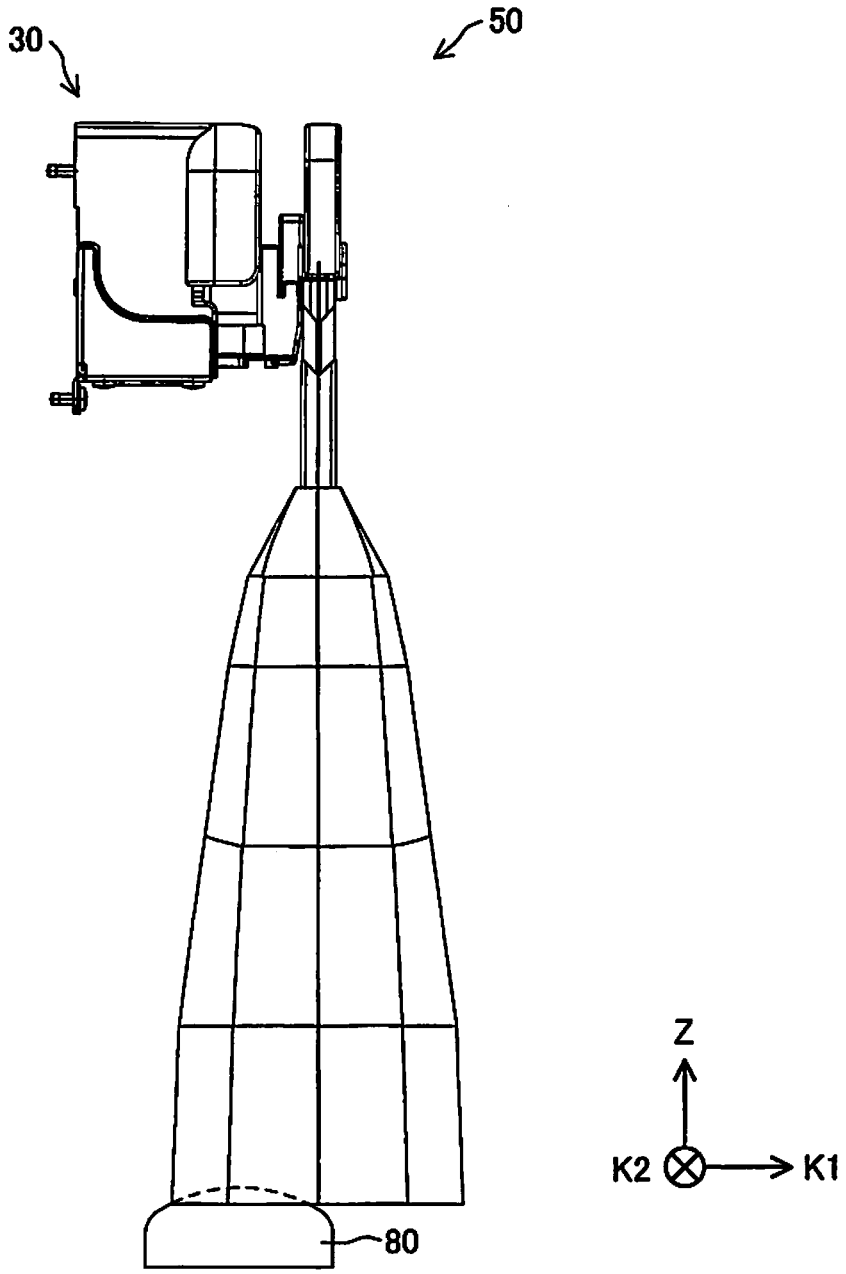
FIG. 46 is a side view illustrating the mounting/demounting unit, the liquid container and the abutment structure (in the set state)
Figure 47:
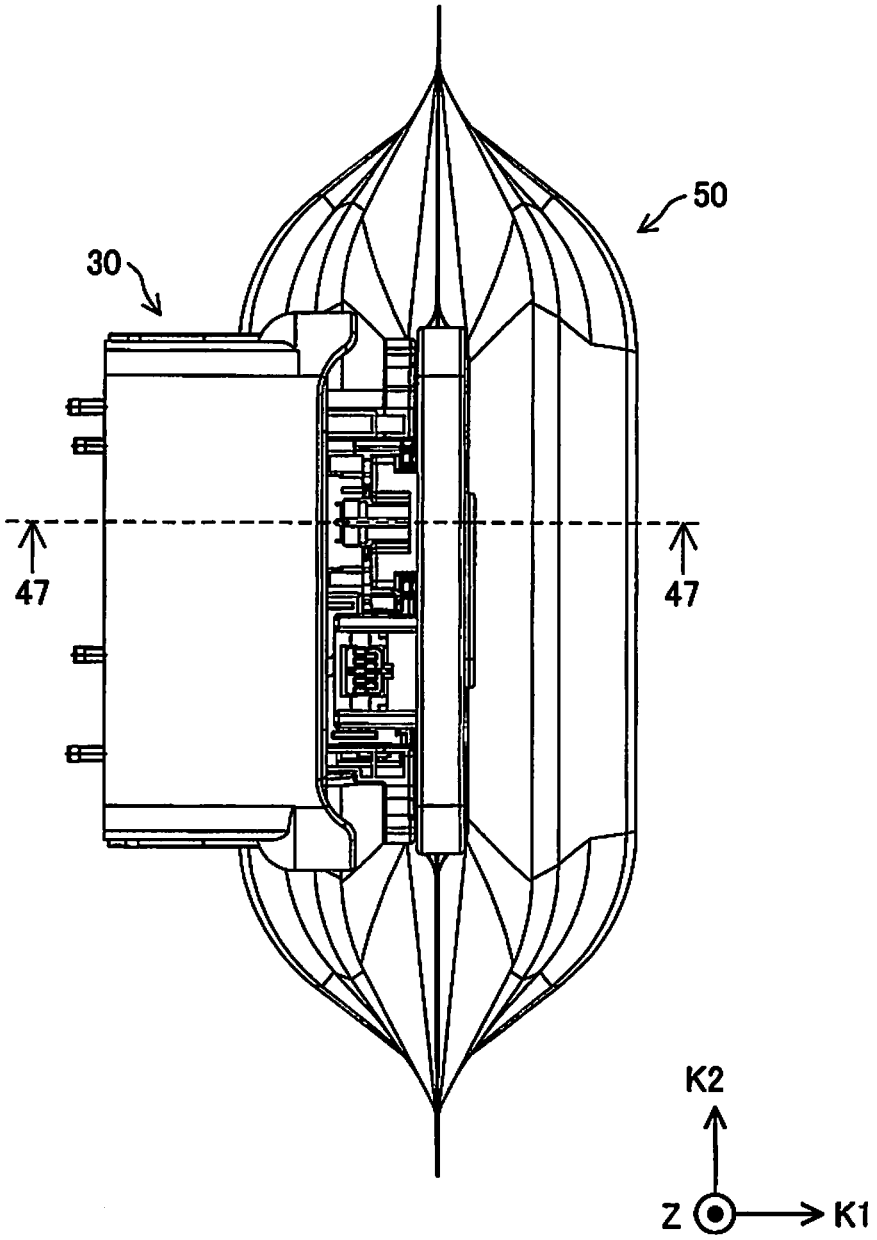
FIG. 47 is a top view illustrating the mounting/demounting unit and the liquid container (in the set state)
Figure 48:
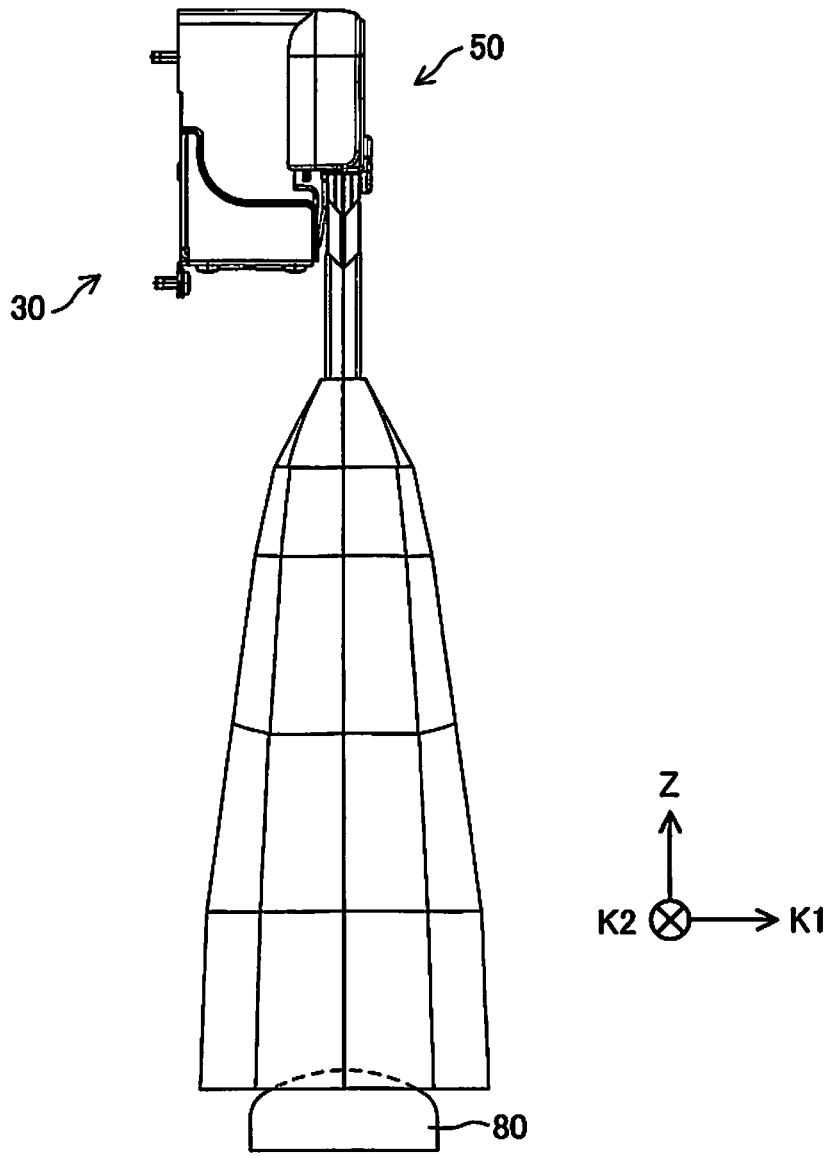
FIG. 48 is a side view illustrating the mounting/demounting unit, the liquid container and the abutment structure (in the mounted state)
Figure 49:
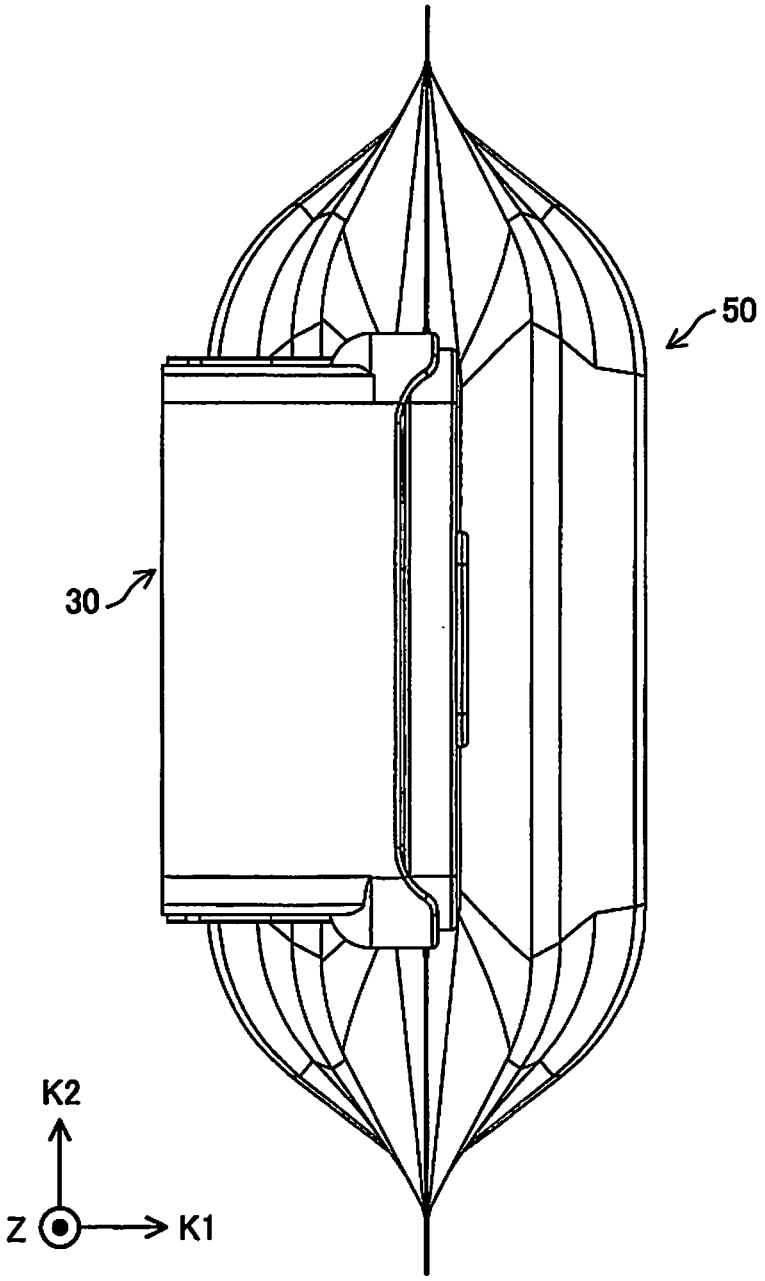
FIG. 49 is a top view illustrating the mounting/demounting unit and the liquid container (in the mounted state)

Mounting of Liquid Container 50 to Mounting/Demounting Unit 30:

The process of mounting the liquid container 50 to the mounting/demounting unit 30 is described. FIG. 44, FIG. 46 and FIG. 48 are side views illustrating the mounting/demounting unit 30, the liquid container 50 and the abutment structure 80. FIG. 45, FIG. 47 and FIG. 49 are top views illustrating the mounting/demounting unit 30 and the liquid container 50. FIGS. 44 and 45 show the state before the contact of the liquid container 50 with the mounting/demounting unit 30 (non-contact state). FIGS. 46 and 47 show the set state. FIGS. 48 and 49 show the mounted state.

The user moves the liquid container 50 along the guide structure 27 (shown in FIG. 5, not shown in FIGS. 44 to 49) for a shift from the non-contact state (shown in FIGS. 44 and 45) to the set state (shown in FIGS. 46 and 47). In the set state, the positioning structure 56 is supported by the movable member 40, such that the liquid supply assembly 53B is located on the +Z-axis direction side of the liquid containing bag 52. The state that "the liquid supply assembly 53B is located on the +Z-axis direction side of the liquid containing bag 52" includes the case that the liquid supply assembly 53B enters the liquid containing bag 52 with respect to the Z-axis direction, like this embodiment. More specifically, this state includes the case that the lower end of the liquid supply assembly 53B is located on the −Z-axis direction side of the upper end of the liquid containing bag 52, like this embodiment. In the set state, the third film 523 that forms the bottom of the liquid container 50 abuts on the abutment structure 80 as shown in FIG. 46.

The abutment structure 80 is arranged not to interfere with a shift from the non-contact state to the set state. Significant displacement of the abutment structure 80 in the +Z-axis direction from the position shown in FIG. 46 interferes with moving the operation member 53 to the position in the set state. The abutment structure 80 is arranged by taking into account such possibility. As a result, the abutment structure 80 shares part of the load of the liquid container 50 in the set state.

During a shift from the set state to the mounted state, the abutment structure 80 also shares part of the load of the liquid container 50. This accordingly reduces the load applied to the movable member 40 during the shift. As a result, this ensures smooth motion of the movable member 40 and enhances the durability of the movable member 40.

Figure 50:
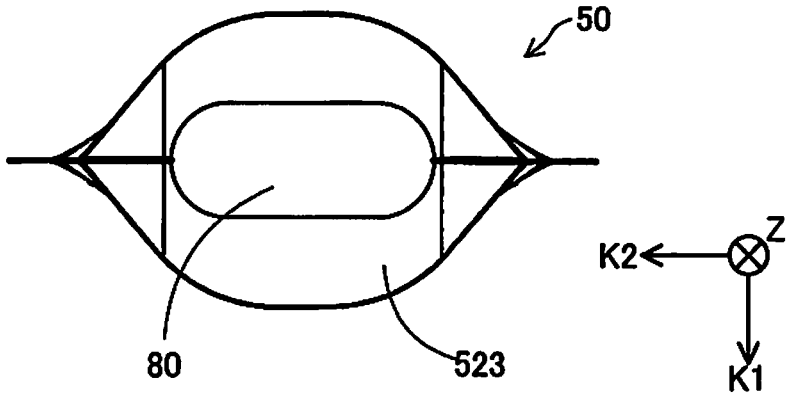
FIG. 50 is a bottom view illustrating the liquid container and the abutment structure in the mounted state (in the mounted state)

FIG. 50 is a bottom view illustrating the liquid container 50 and the abutment structure 80 in the mounted state. As shown in FIG. 50, the abutment structure 80 is located near the center of the third film 523 in the mounted state. In other words, the two-dimensional center of gravity of the third film 523 is equal to or is approximate to the two-dimensional center of gravity of the abutment structure 80 as shown in FIG. 50. The two-dimensional center of gravity means the center of gravity of a two-dimensional figure obtained by projection of the outline onto a horizontal plane.

The abutment structure 80 abutting near the center of the third film 523 in the mounted state restricts the outward motion (motion in the −Z-axis direction) of the third film 523. Such restriction of the motion facilitates the third film 523 to be moved inward in the course of contraction of the liquid containing bag 52 with reduction of remaining ink. This results in readily reducing the amount of remaining ink.

Ink Refill

Figure 51:
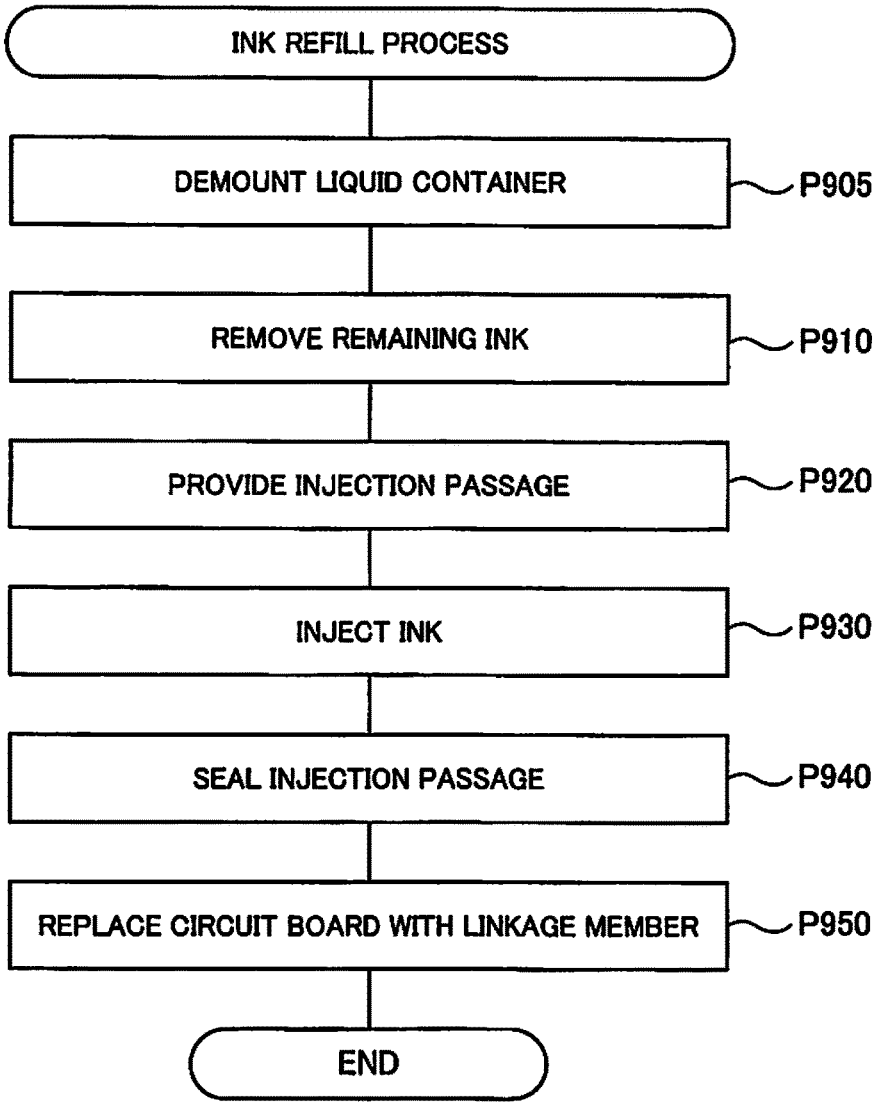
FIG. 51 is a process chart showing an ink refill process.

FIG. 51 is a process chart showing an ink refill process. Refill of ink means that the liquid container 50 is refilled with ink when ink is used for printing and is running low.

The liquid container 50 is first demounted from the housing space 26 (process P905). The remaining ink is then removed (process P910). An injection passage is provided (process P920), and ink is injected (process P930).

Process P910 to process P930 may be performed by any of various methods. According to Embodiment 1, the liquid supply tube 57 is used for all process P910 to process P930. At process P910 in Embodiment 1, the syringe used at process P880 is inserted into the liquid supply tube 57 to suck out the remaining ink. Process P920 and process P930 in Embodiment 1 are performed by the same techniques as those at process P850 and at process P850 in the ink inclusion process.

Figure 52:
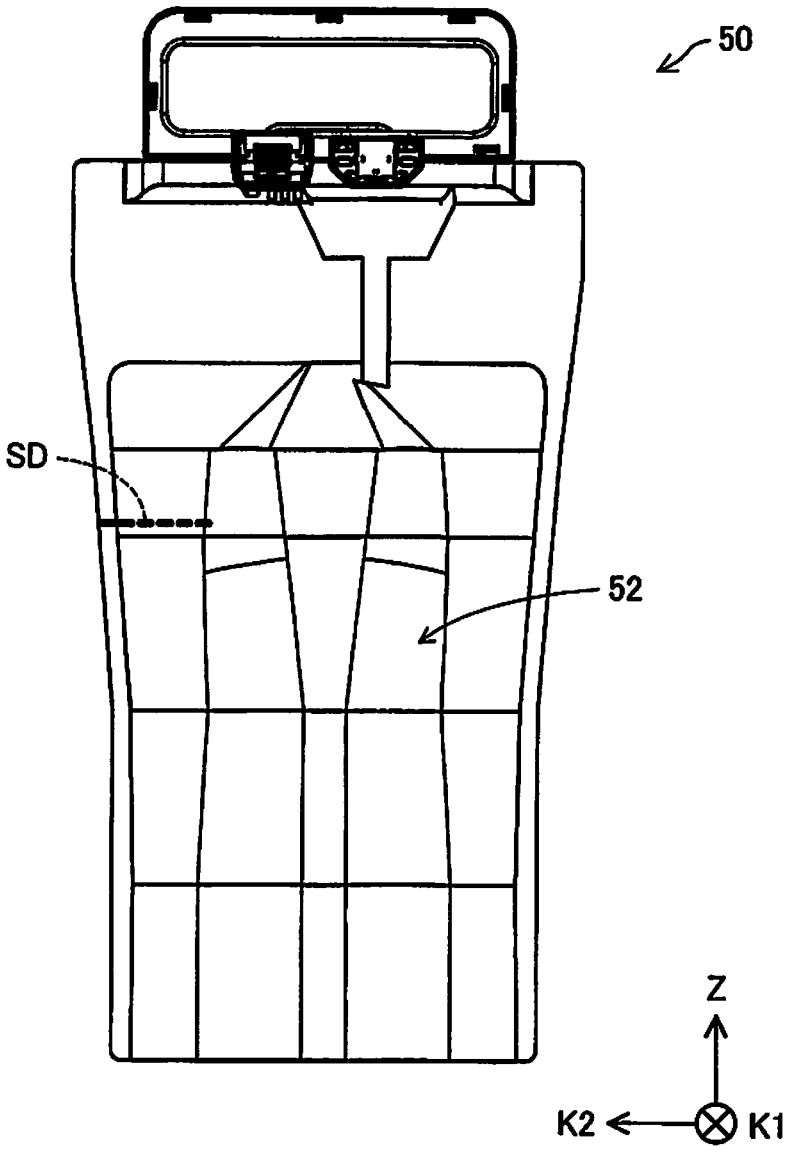
FIG. 52 is a diagram illustrating a cut section for refill of ink.
Figure 53:
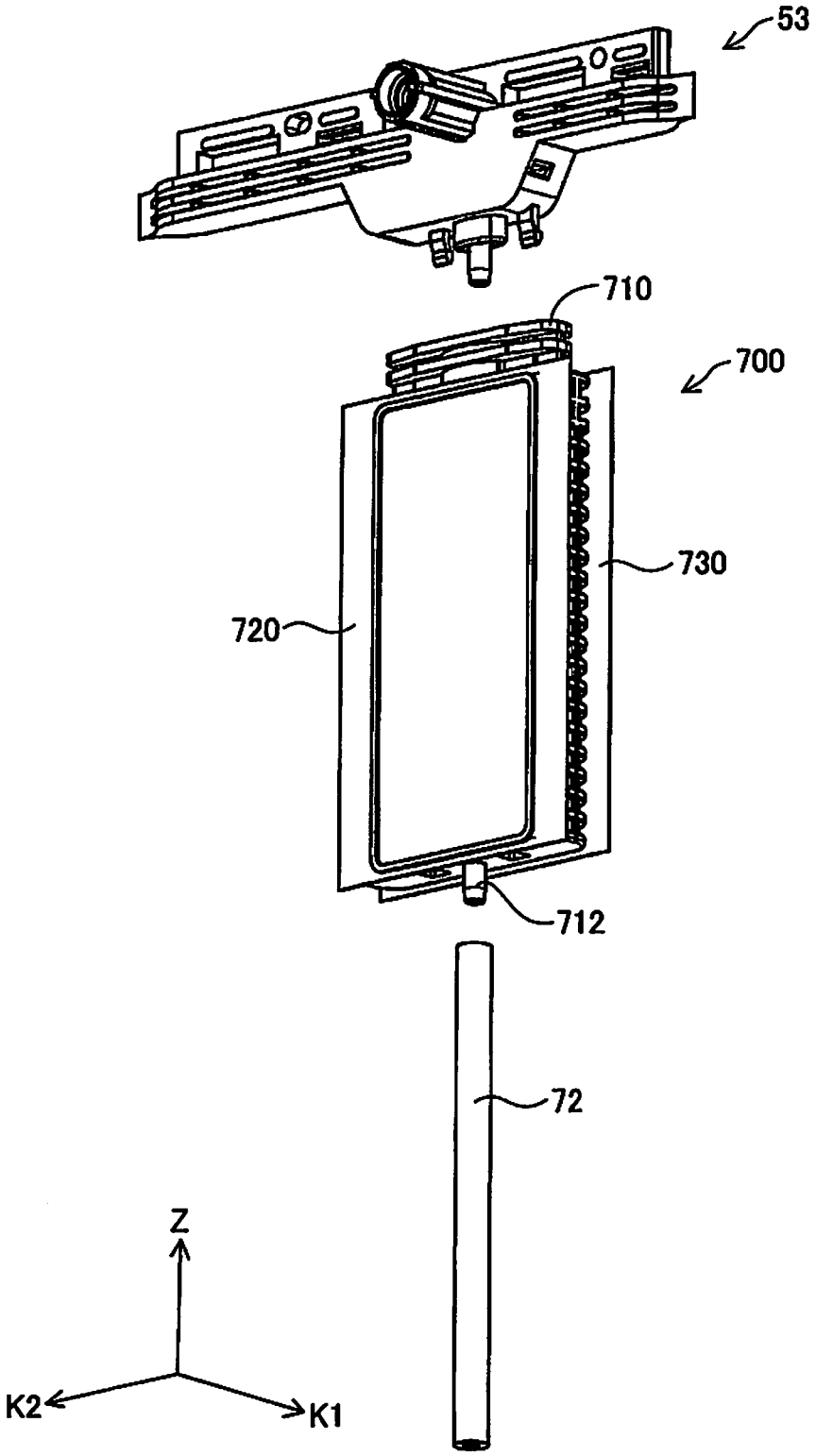
FIG. 53 is a perspective view illustrating a preliminary phase for the ink inclusion process.

According to another embodiment, for example, at process P910, part of the liquid containing bag 52 may be cut, and the remaining ink may be discharged from a cut section. FIG. 52 illustrates a cut section SD for process P910. In this embodiment, process P920 is achieved simultaneously with process P910 since the cut section SD serves as an injection passage. At process P930, ink is injected from this cut section. The operation member 53 may be helpful for formation of the cut section SD, since holding the operation member 53 stabilizes the attitude of the liquid container 50 during cutting.

After injection of ink, the injection passage is sealed (process P940). Process P940 is performed according to the technique employed at process P920. When the liquid injection member 13 is used at process P920, the injection passage is sealed by pulling out the liquid injection member 13. Additionally, the liquid supply port 572 may be blocked with the sealing film 99 or the like. When the cutting technique is employed at process P920, process P940 may be achieved by closing the cut section by welding or the like.

Lastly the circuit board 582 with the linkage member 53A is replaced (process P950). The circuit board 582 after replacement stores information regarding the replacement. The information regarding the replacement is, for example, the date of replacement and the number of refills. The linkage member 53A is a separate member from the liquid supply assembly 53B that is involved in inclusion of ink and is thus readily replaceable.

Advantageous Effects

Embodiment 1 provides at least the following advantageous effects.

The third film 523 serving as the gusset enables a large amount of ink to be contained.

The third film 523 having the folding line 90 enables the amount of remaining ink to be reduced.

Providing the flow path member 70 enables ink near the bottom of the liquid containing bag 52 to be sucked and thereby reduces the amount of remaining ink.

The liquid supply tube 57 is provided to partly come into contact with the gouged portion 560. This configuration enables the liquid supply tube 57 to be offset in the −Z-axis direction, compared with the configuration without the gouged portion 560. As a result, this provides the receiving space 542 in the grip portion 54 and thereby suppresses an increase in height (length in the Z-axis direction) of the liquid container 50.

The liquid supply assembly 53B is readily positioned relative to the liquid containing bag 52 as preparatory for welding by placing the liquid supply tube 57 to come into contact with the cutout portion 529.

The presence of the overhang portion 570 in the joint structure 549*a* increases the area of the joint structure 549*a*. This results in increasing the joint force.

Providing the first chamber 558, the second chamber 559 and the bypass 562 on the rear side of the overhang portion 570 suppresses expansion of the liquid supply assembly 53B in the Z-axis direction.

The presence of the hole 71 in the flow path member 70 ensures smooth injection of ink.

The lead-out portion 550 and the bypass 562 serve as the injection passage during ink injection. This ensures smooth injection.

Providing the protrusion 665 suppresses the second film 22 from sticking to the end face of the second rib 660. This ensures the smooth flow between the first chamber 558 and the second chamber 559.

The bypass 562 serves as the ink injection passage and is sealed on completion of the ink inclusion process. This configuration does not need any part that is welded twice or more times, while achieving the ink injection process. This accordingly reduces the likelihood that the first film 521 and the second film 522 and damaged or peeled off. The absence of any part that is welded twice or more times is attributed to the configuration that the welded surface of the second rib 660 is not continuous with the welded surface of the first rib 650.

The liquid supply tube 57 faces in the horizontal direction in the process of pulling out the liquid injection member 13. This configuration reduces the likelihood that the liquid container 50 is stained with ink dripping off from the liquid injection member 13 or the liquid supply port 572.

The jig 14 is used to keep the liquid injection member 13 and the liquid supply tube 57 at the determined positions during a time period from insertion to pull-out of the liquid injection member 13. This configuration ensures stable ink injection. Additionally, no large stress is generated in the liquid supply assembly 53B by such positioning. There is accordingly no need that the entire operation member 53 has the strength required for positioning.

The flow path member 70 is inserted into the liquid containing bag 52 during ink injection. This suppresses the first film 521 and the second film 522 from sticking to each other. Sticking the sheets may interfere with ink injection.

The bypass 562 is used to remove the gas included in the ink.

By taking advantage of guiding by the guide structure 27, the user can readily insert the liquid container 50 into the housing space 26.

The abutment structure 80 has the curved convex shape in the part that abuts on the third film 523. This suppresses the third film 523 from being damaged.

The liquid supply tube 57 faces in the horizontal direction and is located at the higher position than the liquid containing bag 52 in the set state. Additionally, the cover member 22 has open top in the set state. This positional relationship causes the liquid supply tube 57 and the liquid introduction portion 362 to be readily visible by the user and thereby facilitates the mounting operation.

In the set state, in the mounted state and during a shift from one of these two states to the other, the abutment structure 80 abuts on the third film 523. This configuration reduces the load applied to the mounting/demounting unit 30. This results in suppressing the mounting/demounting unit 30 from being damaged. Additionally, this configuration facilitates the motion of the movable member 40 during a shift of the state.

During the mounting operation, the user can move the movable member 40 and the liquid container 50 by simply pressing the pressing member 53C. This facilitates the mounting operation.

In the mounted state, the abutment structure 80 abuts on the third film 523. This configuration reduces the amount of remaining ink.

Positioning the liquid supply tube 57 in the mounted state ensures stable ink supply.

Providing the flow path member 70 enables the remaining ink to be readily discharged.

Replacement of the linkage member 53A leads to replacement of the substrate unit 58. There is accordingly no need to detach the substrate unit 58 from the linkage member 53A.

Embodiment 2

Embodiment 2 differs from Embodiment 1 by providing a filter unit 700 inside of the liquid containing bag 52. FIG.

Figure 54:
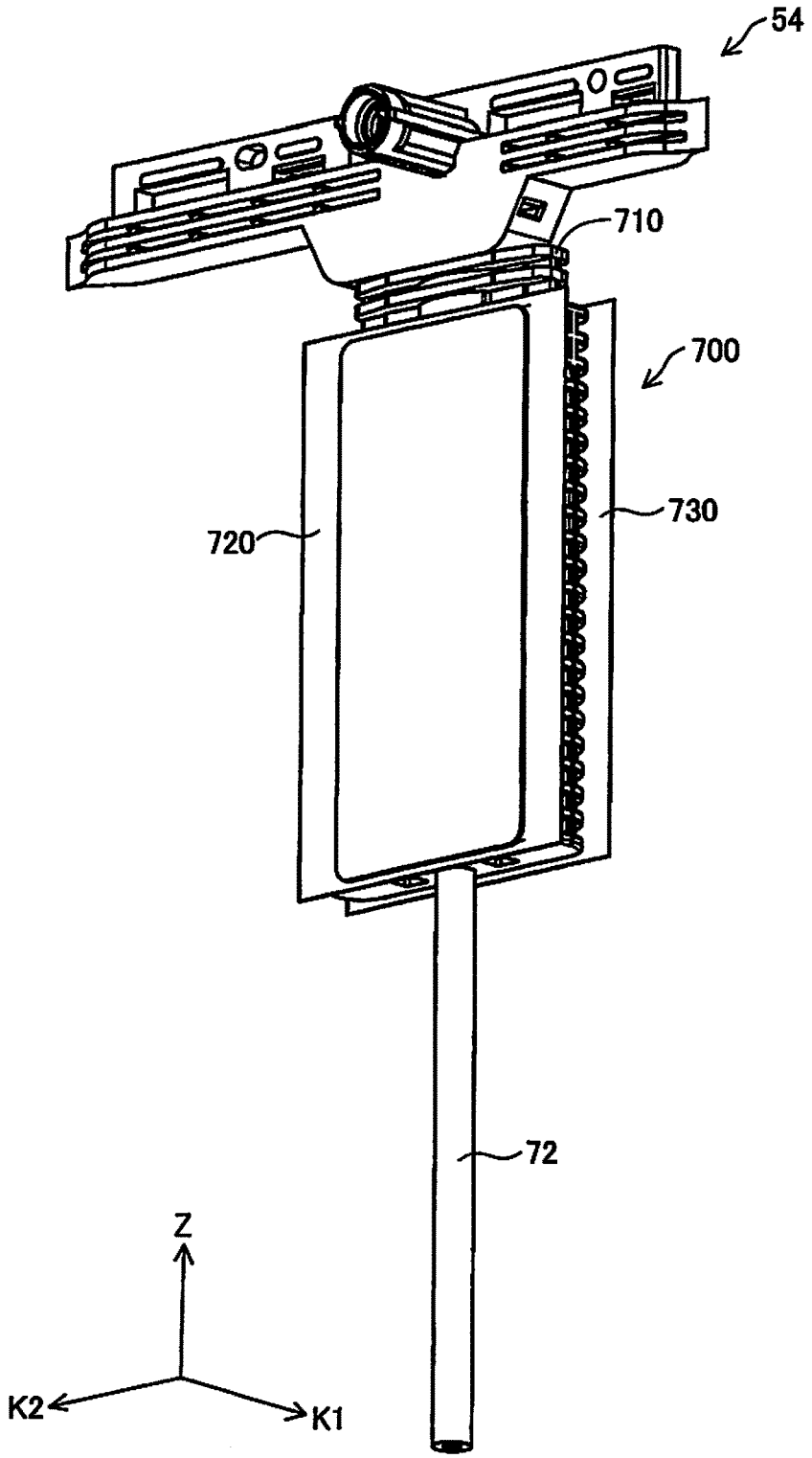
FIG. 54 is a perspective view illustrating a phase on completion of connection of a flow path.
Figure 58:
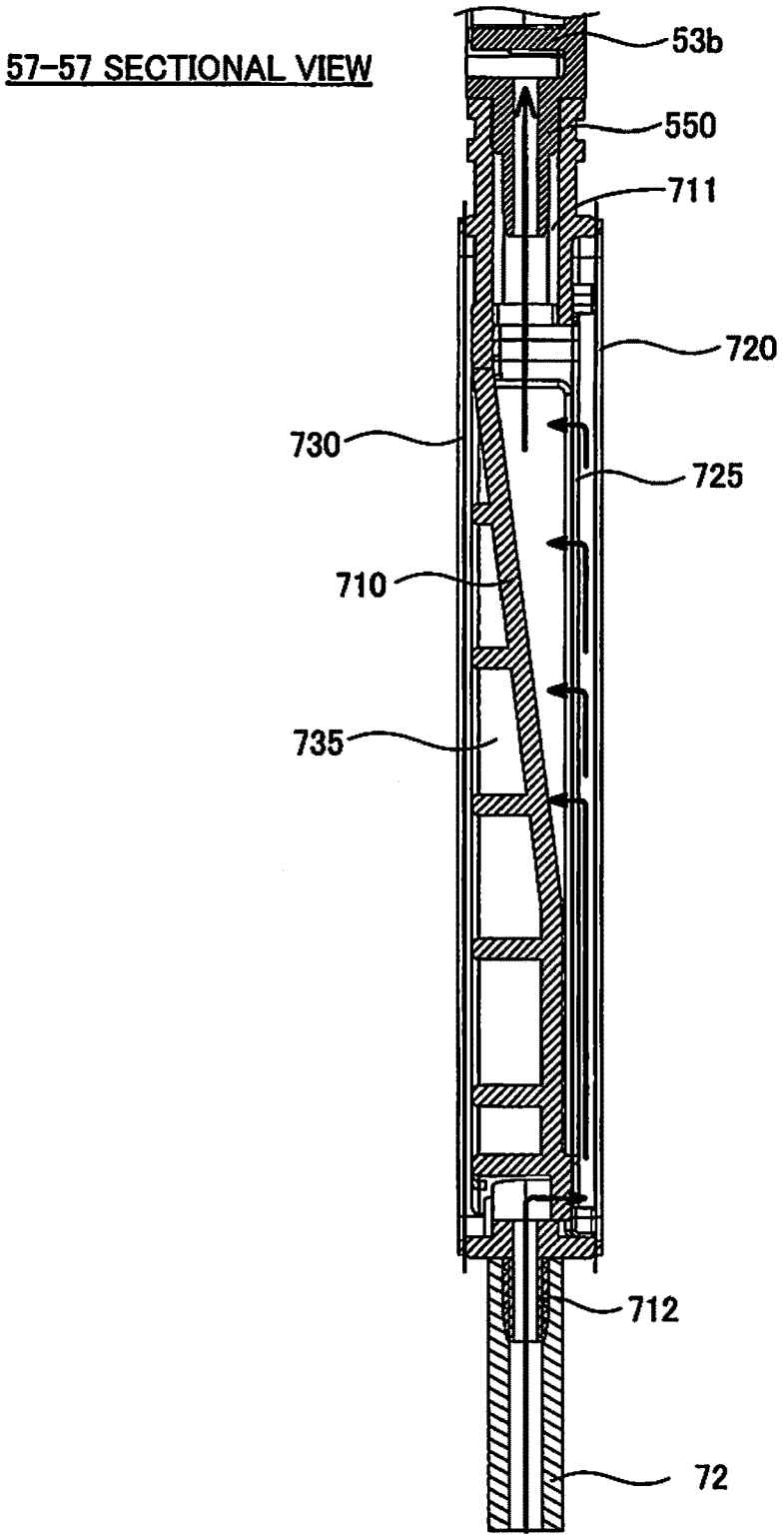
FIG. 58 is a sectional view of FIG. 57.

53 is a perspective view illustrating a preliminary phase for process P810 in the ink inclusion process (shown in FIG. 14). FIG. 54 is a perspective view illustrating a phase on completion of process P810. The filter unit 700 includes a flow path provided inside thereof (as shown in FIGS. 55 and 58) and is connected between the operation member 53 and a flow path member 72 as shown in FIG. 54.

Figure 55:
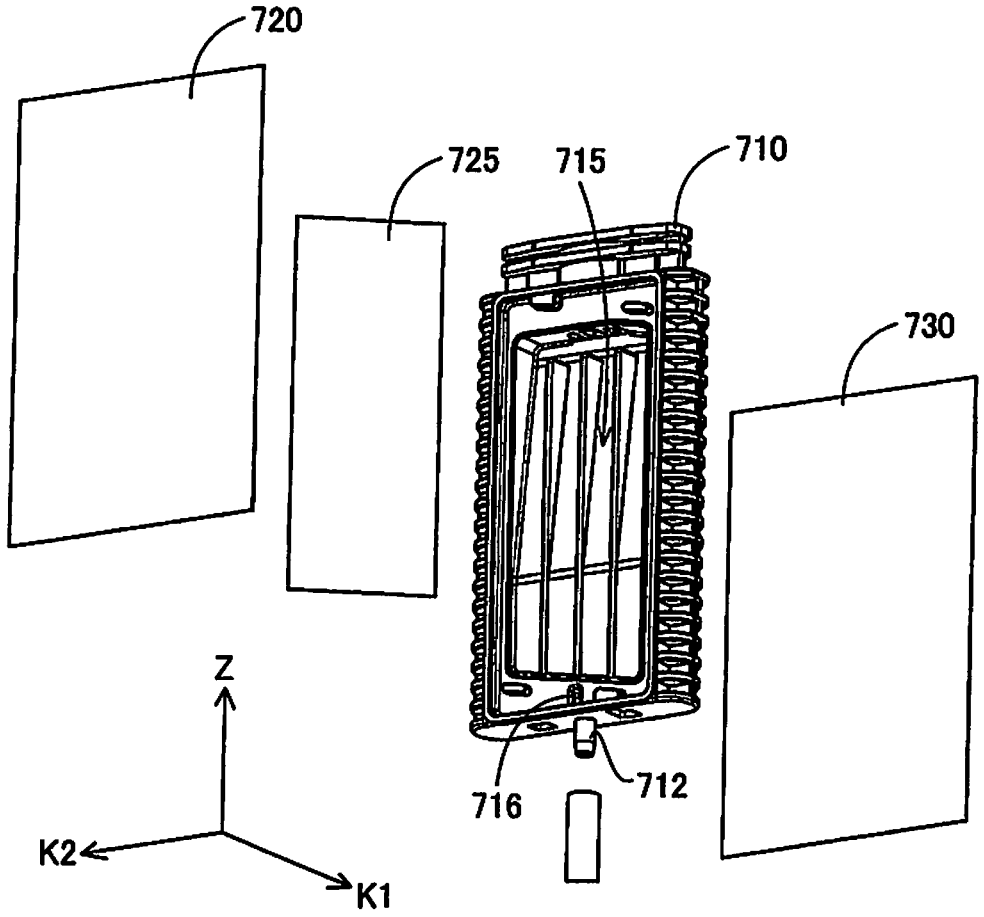
FIG. 55 is a perspective view illustrating a filter unit in the exploded state.
Figure 56:
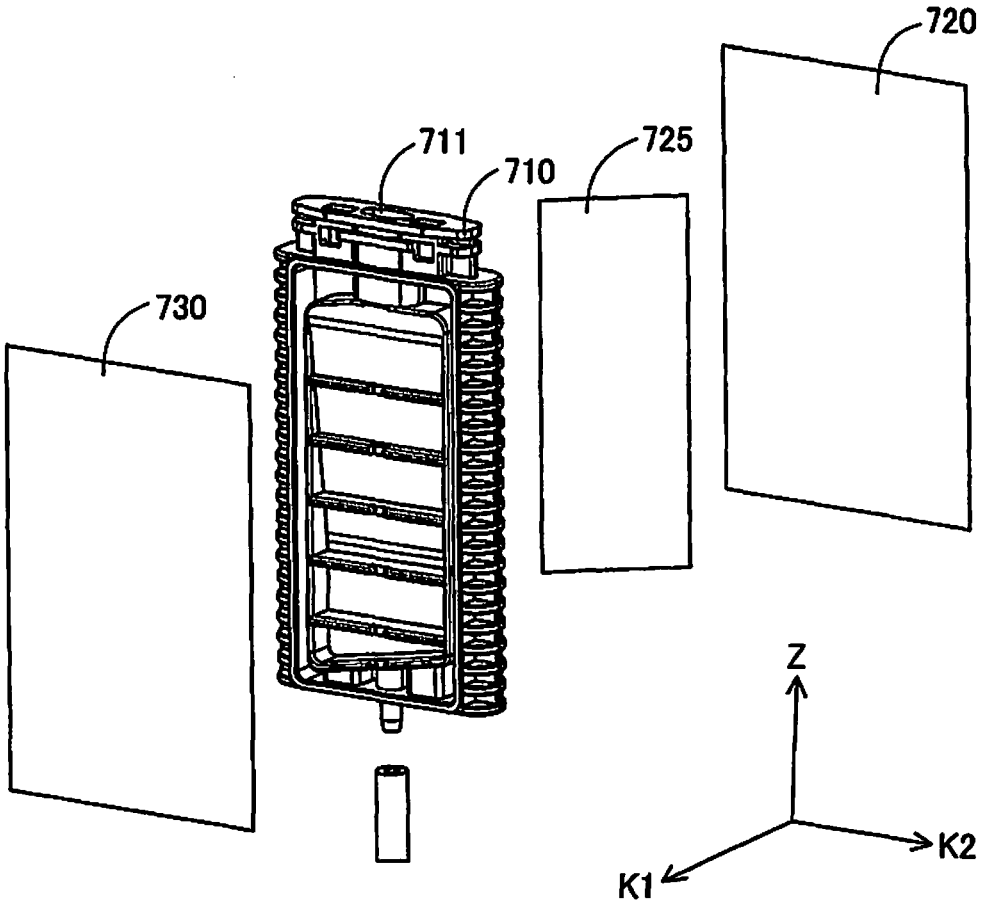
FIG. 56 is a perspective view illustrating the filter unit in the exploded state.

FIG. 55 and FIG. 56 are perspective views illustrating the filter unit 700 in the exploded state. The filter unit 700 includes a frame 710, a filter chamber film 720, a filter 725 and a deaeration chamber film 730. The frame 710 includes an upper connecting structure 711, a lower connecting structure 712, a flow path chamber 715, a through hole 716 and a deaeration chamber 735.

The frame 710 may be formed by, for example, resin molding. The filter 725 is configured to allow for transmission of ink but not to allow for transmission of impurities over a predetermined size. The filter chamber film 720 and the deaeration chamber film 730 are configured to allow for transmission of gas but not to allow for transmission of ink. The filter chamber film 720 and the deaeration chamber film 730 are made of an identical material.

The deaeration chamber film 730 seals the deaeration chamber 735 under the reduced pressure. The reduced pressure means the pressure lower than the atmospheric pressure. When the atmosphere of the deaeration chamber film 730 is at atmospheric pressure, the gas that externally comes into contact with the deaeration chamber film 730 passes through the deaeration chamber film 730 and is trapped in the deaeration chamber 735. This configuration causes the gas included in the liquid containing bag 52 during ink injection to be trapped at least partly in the deaeration chamber 735.

Figure 57:
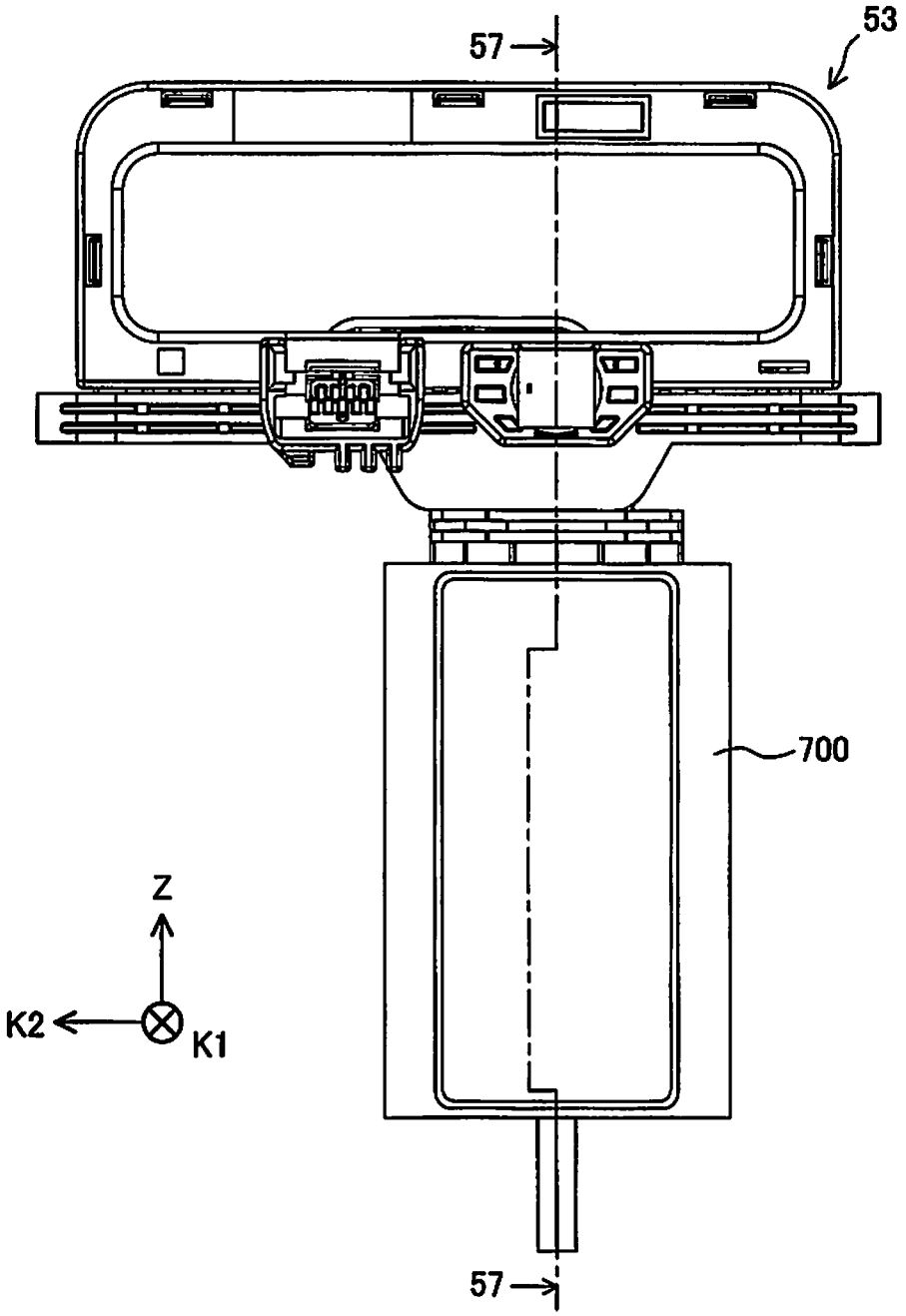
FIG. 57 is a front view illustrating connection of an operation member with the filter unit.

FIG. 57 is a front view illustrating connection of the operation member 53 with the filter unit 700. FIG. 58 is a 57-57 sectional view of FIG. 57.

As shown in FIG. 58, ink flowing in from the flow path member 72 passes through the through hole 716 (shown in FIG. 55, not shown in FIG. 58) and flows into a gap between the filter chamber film 720 and the filter 725. The ink flowing into this gap is filtered by the filter 725 and flows into the flow path chamber 715. The ink flowing into the flow path chamber 715 passes through the lead-out portion 550 and flows into the liquid supply assembly 53B.

The configuration of Embodiment 2 enables the gas and impurities to be removed from the ink that is to be supplied to the printer 10. Even in the configuration including the filter 725, the bypass 562 serving as the injection passage during ink injection avoids a significant increase in flow resistance of the entire injection passage.

Embodiment 3

Figure 59:
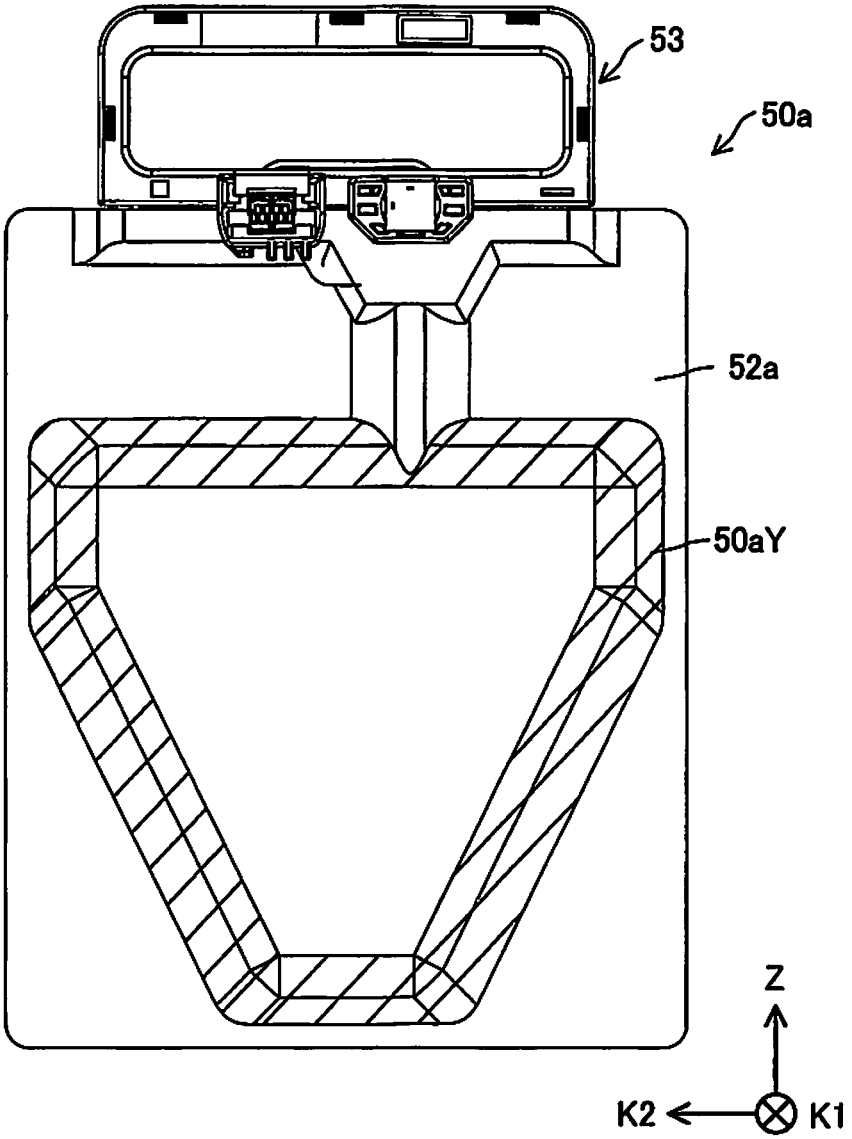
FIG. 59 is a front view illustrating a liquid container (Embodiment 3)
Figure 60:
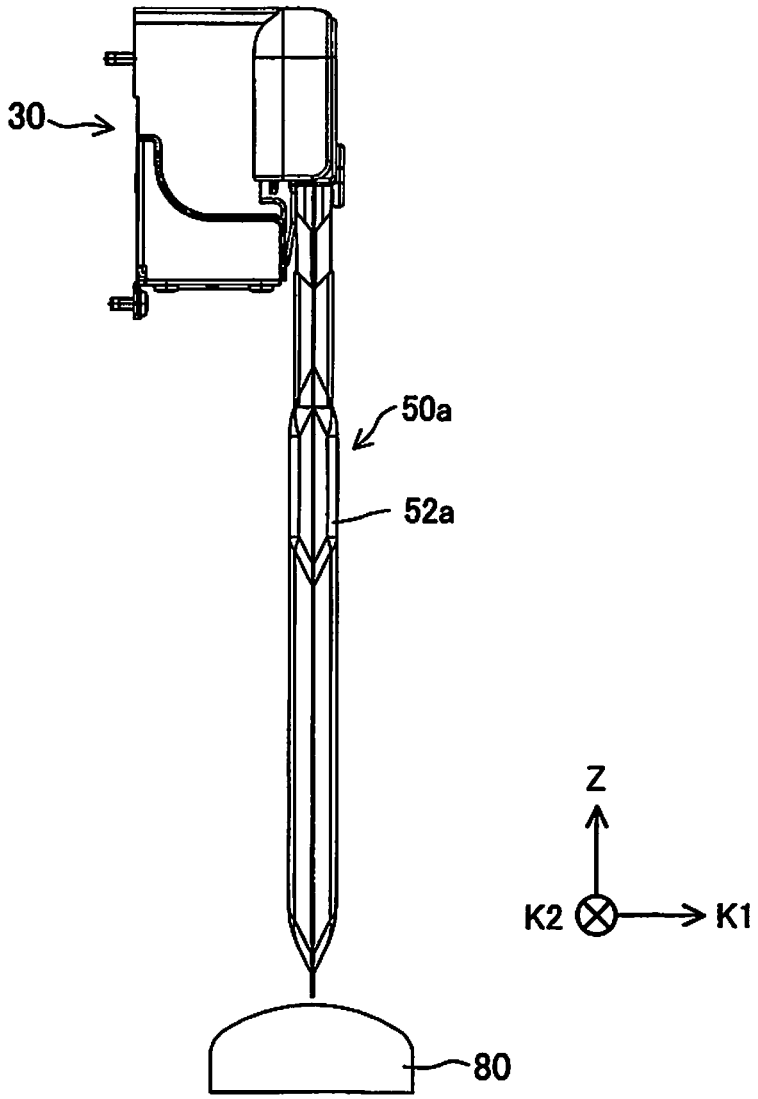
FIG. 60 is a side view illustrating the liquid container in the mounted state (Embodiment 3)

FIG. 59 is a front view illustrating a liquid container 50*a*. FIG. 60 is a side view illustrating the liquid container 50*a* in the mounted state and illustrates the state that the amount of remaining ink is approximately equal to zero. The liquid container 50*a* may be mounted to the mounting/demounting unit 30 as an alternative of the liquid container 50.

The liquid container 50*a* includes a liquid containing bag 52*a*. The liquid containing bag 52*a* is formed by joining two films with each other and does not have a gusset unlike the liquid container 50. A welded portion 50*a*Y in which the two films are welded to each other is shown by hatching in FIG. 59. The welded portion 50*a*Y is in a pentagonal shape and does not allow the liquid to be contained at the corners near the bottom for the purpose of reduction of the amount to be contained.

The liquid containing bag 52*a* is joined with an operation member 53. This operation member 53 is identical with the operation member 53 included in the liquid container 50 and is connected with a flow path member inside of the liquid containing bag 52*a*.

As shown in FIG. 60, the liquid container 50*a* does not abut on the abutment structure 80 in the mounted state. This is because the liquid containing bag 52*a* has a shorter length in the Z-axis direction than the liquid containing bag 52 of Embodiment 1. The liquid containing bag 52*a* does not have the gusset and is thus unlikely to provide the effect of reducing the amount of remaining ink in the state that the liquid containing bag 52*a* abuts on the abutment structure 80. The attitude of the liquid containing bag 52*a* without the gusset is likely to be inclined in the mounted state when the liquid containing bag 52*a* abuts on the abutment structure 80. It is thus preferable that the liquid containing bag without the gusset does not abut on the abutment structure 70.

Embodiment 4

Figure 61:
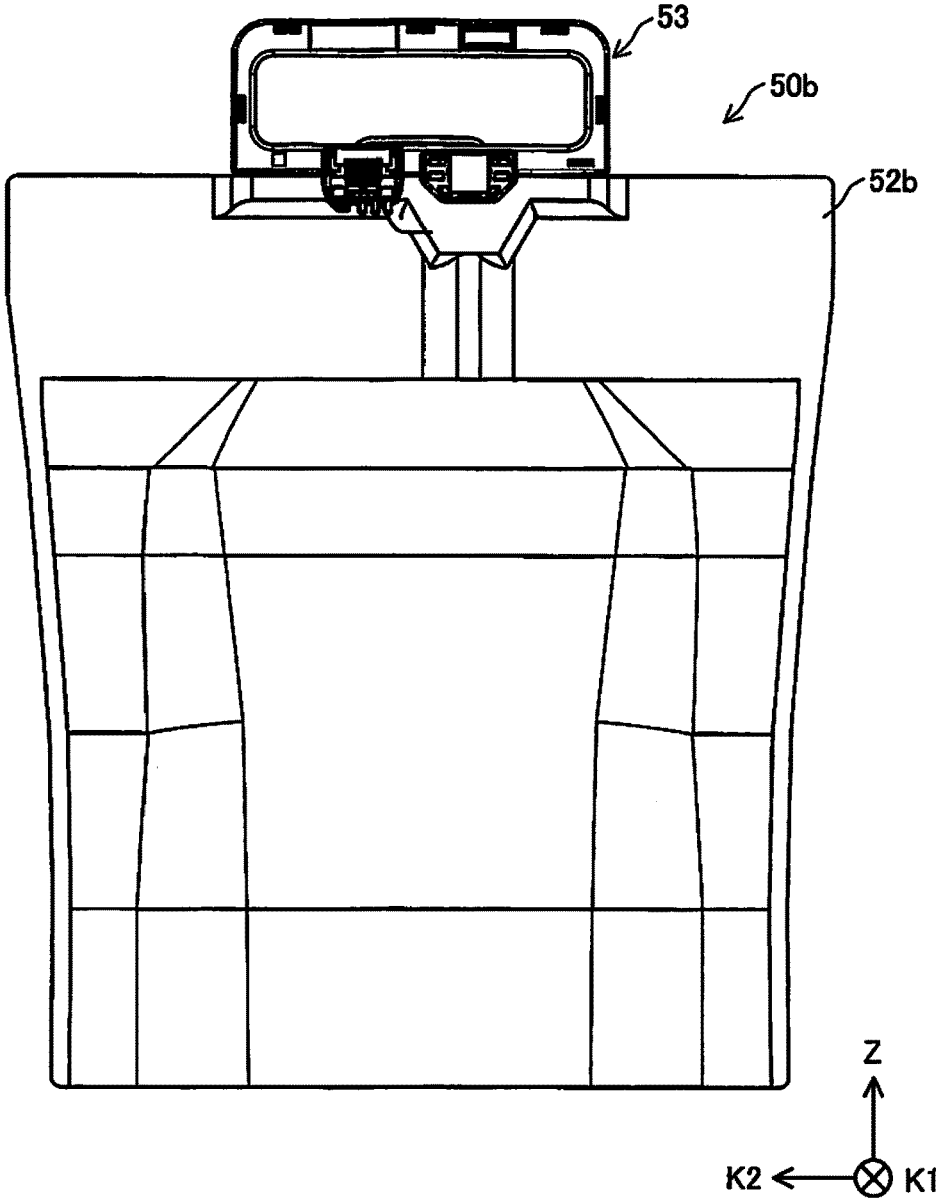
FIG. 61 is a front view illustrating a liquid container (Embodiment 4)

FIG. 61 is a front view illustrating a liquid container 50*b*. The liquid container 50*b* may be mounted to the mounting/demounting unit 30 as an alternative of the liquid container 50 or 50*a*. The liquid container 50*b* includes a liquid containing bag 52*b* and an operation member 53. This operation member 53 is identical with the operation member 53 included in the liquid container 50. The liquid containing bag 52*b* has a larger width in the K2-axis direction and accordingly enables a larger amount of ink to be contained, compared with the liquid containing bag 52.

As illustrated in Embodiments 3 and 4, the common operation member 53 may be used for various different liquid containing bags.

The horizontal direction is one example of the intersecting direction. Ink is one example of the liquid. The printer 10 is one example of the liquid consuming apparatus. The liquid container 50, 50*a* or 50*b* is one example of the liquid container or the liquid containing bag unit. The liquid containing bag 52 is one example of the liquid container body. The positioning structure 56 is one example of the first positioning structure. The liquid supply tube 57 is one example of the liquid supply passage. The substrate unit 58 is one example of the memory unit. The circuit board holding structure 59 is one example of the second positioning structure. The third sheet 523 is one example of the gusset. The filter unit 700 is one example of the gas trap portion. The upper connecting structure 711 is one example of the first opening. The lower connecting structure 712 is one example of the second opening. The flow path chamber 715 is one example of the flow path. The deaeration chamber film 730 is one example of the sealing member. The deaeration chamber 735 is one example of the decompression chamber.

The disclosure is not limited to any of the embodiments, the examples and the modifications described above but may be implemented by a diversity of other configurations without departing from the scope of the disclosure. For example, the technical features of any of the embodiments, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein. Some examples of modifications are given below.

Figure 62:
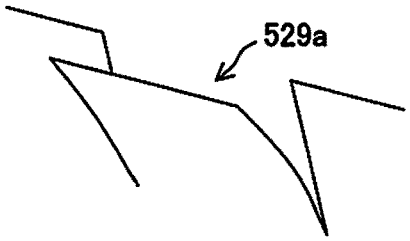
FIG. 62 is a diagram illustrating a cut in a film (modification).

A cut 529*a* may be provided as shown in FIG. 62, instead of the cutout portion 529 (shown in FIG. 10).

The abutment structure 80 may not be provided integrally with the housing space 26 but may be provided separately. For example, a soft member such as sponge may be fixed by means of an adhesive to serve as an abutment structure. In another example, a spring may be placed in the housing space 26, and the abutment structure 80 may be provided on the spring. This configuration further suppresses the liquid containing bag 52 from being damaged.

The liquid container 50 may have any attitude during ink injection. The liquid container 50 may be arranged in the reverse attitude to that of the embodiment or more specifically may be arranged such that the liquid containing bag 52 is located on the +Z-axis direction side of the operation member 53. The liquid container 50 may be laid such that the center axis CT of the liquid supply tube 57 faces in the +Z-axis direction or in the −Z-axis direction.

The liquid container 50 may be arranged in the attitude that causes the liquid containing bag 52 to be bent.

The attitude of the liquid container 50 at the time of pulling out the liquid injection member 13 may be changed from the attitude at the time of insertion of the liquid injection member 13.

All the three components or any two components among the linkage member 53A, the liquid supply assembly 53B and the pressing member 53C may be molded from the same material.

In the above embodiments, the liquid containing bag 52 is formed from the flexible material. This is, however, not restrictive but any material may be used as long as the liquid containing bag 52 can serve as a liquid container body configured to contain a liquid inside thereof. For example, the liquid containing bag 52 may be formed partly from a flexible material or may be formed from a hard material that does not change the volume irrespective of consumption of the liquid. Forming at least part of the liquid containing bag 52 from the flexible material causes the volume of the liquid containing bag 52 to be changed with a change in amount of ink contained in the liquid containing bag 52.

In the embodiments described above, the operation member 53 is formed in the frame-like shape. The shape is, however, not limited to this shape but may be any shape that can be held by the user. For example, the operation member 53 may be formed in a rod-like (plate-like) shape extended along the Z-axis direction.

In the embodiments described above, the linkage member 53A, the liquid supply unit 55, the circuit board holding structure 59 and the like are formed by combining the three components 53A, 53B and 53C. This configuration is, however, not restrictive. For example, an assembly may be integrally formed by assembling the three components 53A, 53B and 53C. The method employed for integral formation may be integral molding or may be a method of attaching the respective components 53A, 53B and 53C by means of an adhesive or the like. This facilitates manufacture of the liquid container 50. This enables the liquid supply unit 55 and the substrate unit 58 to be formed integrally and thereby ensures accurate positioning of the respective units 55 and 58 relative to each other. This also enables the linkage member 53A and the joint structure 549 to be formed integrally. This reduces the likelihood that the joint structure 549 is separated from the linkage member 53A by the weight of the liquid containing bag 52 when the user holds the linkage member 53A. The load generated by the dead weight of the liquid containing bag 52 when the user holds the linkage member 53A is applied to the linkage member 53A via the joint structure 549. This reduces an external force applied to the liquid containing bag 52 and thereby reduces the possibility that the liquid containing bag 52 is damaged. The liquid supply assembly 53B and the liquid containing bag 52 may also be molded integrally.

The disclosure is not limited to the inkjet printer or its liquid container 50 but is also applicable to any printing apparatus (liquid ejection apparatus) configured to eject any liquid other than ink and a liquid container configured to contain the liquid. For example, the disclosure may be applied to any of various liquid ejection apparatuses and their liquid containers given below:

(1) image recording apparatus such as a facsimile machine;

(2) color material ejection apparatus configured to eject a color material used for manufacturing color filters for an image display apparatus such as a liquid crystal display;

(3) electrode material ejection apparatus configured to eject an electrode material used for forming electrodes of, for example, an organic EL (electroluminescence) display and a field emission display (FED);

(4) liquid ejection apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid ejection apparatus for pinpoint ejection of lubricating oil on precision machines such as watches and cameras;

(9) liquid ejection apparatus configured to eject a transparent resin solution, such as an ultraviolet curable resin solution, onto a substrate in order to manufacture a hemispherical microlens (optical lens) used for, for example, optical communication elements;

(10) liquid ejection apparatus configured to eject an acidic or alkaline etching solution in order to etch a substrate or the like; and

(11) liquid ejection apparatus equipped with a liquid ejection head configured to eject a very small volume of droplets of any other liquid.

The "droplet" herein means the state of liquid ejected from the liquid ejection apparatus and may be in a granular shape, a teardrop shape or a tapered threadlike shape. The "liquid" herein may be any material ejectable from the liquid ejection apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks.

A laminated structure by stacking a plurality of films may be employed to form the first to the third films 521 to 523. In this laminated structure, for example, an outer layer may be formed from PET or nylon having excellent impact resistance and an inner layer may be formed from polyethylene having excellent ink resistance. Additionally, a film including a deposition layer of aluminum or the like may be used as one component of the laminated structure. This enhances the gas barrier property and thereby suppresses, for example, a change in concentration of ink contained in the liquid containing bag 52. The material of the liquid containing bag 52 may be determined arbitrarily as described above. One film may be folded and welded to the joint structures 549*a* and 549*b*. In this modification, one end portion may be regarded as being formed on a plurality of film members.

The shape and the size of the liquid containing bag 52 may be set arbitrarily. For example, the liquid containing bag 52K provided to contain black ink may have the larger volume (larger size) than another liquid containing bag, for example, the liquid containing bag 52C provided to contain another color ink (for example, cyan).

The positioning structure 56 may be attached to the operation member 53 by welding or the like, so that the operation member 53 may be provided integrally with the positioning structure 56. The positioning structure 56 is provided near the liquid supply port 572 to surround the circumference of the liquid supply port 572 except the upper portion. When the operation member 53 is formed from a material that is not readily deformable, the positioning structure 56 may be provided in the operation member 53 at a position some distance away from the liquid supply port 572.

The numbers of the cover members 22, the liquid containers 50 and the mounting/demounting units 30 are not limited to those described above. For example, the number of the liquid containers 50 may be three or less or may be five or more. The number of the mounting/demounting units 30 may be determined corresponding to the number of the liquid containers 50. The number of the cover members 22 may be one or may be three or more.

The number of the engagement elements 511A, 511B and 511C may be two or less or may be four or more.

The number of the engagement elements 513 may be four or more or may be two or less.

On the occasion of replacement of the substrate unit 58, the linkage member 53A may not be replaced. More specifically, the substrate unit 58 may be detached from the linkage member 53A and a new substrate unit 58 may be attached to the linkage member 53A. In this case, detachment of the linkage member 53A facilitates replacement of the substrate unit 58.

The flow path member may be omitted. Even in the configuration without the flow path member, the flexibility of the first to the third films achieves reduction of the remaining ink to some extent.

REFERENCE SIGNS LIST

10 printer, 11 recording mechanism, 12 ink tank, 13 liquid injection member, 16 paper feed tray, 17 paper eject tray, 20 liquid supply device, 20A first liquid supply device, 20B second liquid supply device, 22 cover member, 22A cover member, 22B cover member, 23 one end portion, 24 other end portion, 26 housing space, 26A housing space, 26B housing space, 27 guide structure, 30 mounting/demounting unit, 30C mounting/demounting unit, 30K mounting/demounting unit, 30M mounting/demounting unit, 30Y mounting/demounting unit, 35 stationary member, 36 liquid introduction mechanism, 38 contact mechanism, 40 movable member, 41 base portion, 42 supply assembly support structure, 48 board support structure, 50 liquid container, 50C liquid container, 50K liquid container, 50M liquid container, 50Y liquid container, 50*a* liquid container, 50*b* liquid container, 50*a*Y welded portion, 51W peripheral area, 52 liquid containing bag, 52C liquid containing bag, 52K liquid containing bag, 52M liquid containing bag, 52Y liquid containing bag, 52*a* liquid containing bag, 52*b* liquid containing bag, 53 operation member, 53A linkage member, 53B liquid supply assembly, 53C pressing member, 53*fa* first side, 53*fb* second side, 53W peripheral area, 54 grip portion, 54A one end portion, 54B other end portion, 55 liquid supply unit, 56 positioning structure, 57 liquid supply tube, 58 substrate unit, 59 circuit board holding structure, 70 flow path member, 71 hole, 72 flow path member, 74 engagement projection, 75 follower, 76 connecting structure, 79 cut portion, 80 abutment structure, 90 folding line, 99 sealing film, 102 apparatus first surface, 104 apparatus second surface, 106 apparatus third surface, 362 liquid introduction portion, 381 apparatus-side terminal, 385 board positioning structure, 402 first support surface, 403 second support surface, 404 third support surface, 407 groove, 420 heart-shaped cam, 477 positioning projection, 482 first board support surface, 501 one end, 502 other end, 503 first side end, 504 second side end, 511 engagement element, 511A engagement element, 511B engagement element, 511C engagement element, 511Da locking pawl, 513 engagement element, 513A engagement element, 513B engagement element, 513C engagement element, 513Da through hole, 515 engagement element, 517 protruded portion, 521 first film, 522 second film, 523 third film, 529 cutout portion, 541 grip surface, 542 receiving space, 545 pressed portion, 546 first connecting portion, 547 second connecting portion, 548 base portion, 549 joint structure, 549*a* joint structure, 549*b* joint structure, 550 lead-out portion, 551 valve mechanism, 552 valve seat, 554 valve element, 556 spring, 558 first chamber, 559 second chamber, 560 gouged portion, 562 bypass, 562A opening, 562B opening, 570 overhang portion, 571 main joint plane, 572 liquid supply port, 577 projection, 581 terminal, 582 circuit board, 583 storage device, 588 member engagement element, 592 first side wall portion, 592*t* groove, 593 second side wall portion, 593*t* groove, 594 bottom, 595 identification rib, 596 engagement groove, 601 receiving portion, 605 opening, 606 guiding portion, 606*a* inclined portion, 608 connecting portion, 612 engaging portion, 614 engagement wall, 615 protruded wall, 616 outlet portion, 616*a* inclined portion, 620 step, 633 all portion, 650 first rib, 660 second rib, 665 protrusion, 700 filter unit, 710 frame, 711 upper connecting structure, 712 lower connecting structure, 715 flow path chamber, 716 through hole, 720 filter chamber film, 725 filter, 730 deaeration chamber film, 735 deaeration chamber, 1000 liquid ejection system, SD cut section, CT center axis, St engagement position

The invention claimed is:

1. An injection method of injecting a liquid into a liquid container, the liquid container comprising a liquid container bag configured to contain a liquid therein and including a first film and a second film arranged to face each other, and a third film that is welded to the first and second films and forms a gusset; a liquid supply assembly located on one end portion of the liquid container bag and configured to have a liquid supply port provided to supply the liquid to a liquid consuming apparatus; and a flow path member placed inside of the liquid container bag and configured to form a flow path that is connected with the liquid supply assembly, the flow path member having an open end at one end of the flow path member, the open end opening in a neighborhood of the gusset, the injection method comprising:

placing the liquid container bag on a horizontal plane so that the gusset forms a bottom face of the liquid containing bag;

cutting at least part of the first film or the second film at a position vertically above the open end of the flow path member;

discharging a remaining ink from a cut part;

injecting the liquid from the cut part so that the liquid comes in contact with an outer peripheral surface of the flow path member; and closing the cut part.

2. The injection method according to claim 1, wherein the liquid container bag further comprises a grip portion linked with the liquid container bag and the liquid supply assembly, the grip portion forms at least a part of a frame surrounding a space, and the space forms a receiving space to grip the frame, and the cutting is performed in a state where the grip portion is held.

3. A liquid container in which the liquid is injected by the injection method according to claim 1.

* * * * *